US010060241B2

(12) United States Patent
Xu

(10) Patent No.: US 10,060,241 B2
(45) Date of Patent: Aug. 28, 2018

(54) METHOD FOR PERFORMING WELLBORE FRACTURE OPERATIONS USING FLUID TEMPERATURE PREDICTIONS

(71) Applicant: Schlumberger Technology Corporation, Sugar Land, TX (US)

(72) Inventor: Wenyue Xu, Medford, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 317 days.

(21) Appl. No.: 14/845,783

(22) Filed: Sep. 4, 2015

(65) Prior Publication Data

US 2016/0010443 A1 Jan. 14, 2016

Related U.S. Application Data

(63) Continuation-in-part of application No. 14/126,209, filed on Feb. 7, 2014, now abandoned, and a (Continued)

(51) Int. Cl.
*E21B 41/00* (2006.01)
*E21B 43/11* (2006.01)

(Continued)

(52) U.S. Cl.
CPC ..... *E21B 43/26* (2013.01); *E21B 43/267* (2013.01); *E21B 47/065* (2013.01)

(58) Field of Classification Search
CPC ..... E21B 43/26; E21B 43/267; E21B 49/00; E21B 43/00; E21B 43/16; E21B 47/06;

(Continued)

(56) References Cited

U.S. PATENT DOCUMENTS 4,834,181 A 5/1989 Uhri et al.
6,101,447 A 8/2000 Poe, Jr.

(Continued)

FOREIGN PATENT DOCUMENTS

CN 1993533 A 7/2007
WO 2013016734 A1 1/2013

OTHER PUBLICATIONS

Ruiz Martinez et al., "Analytical models of heat conduction in fractured rocks", Journal of Geophysical Research: Solid Earth, 2013, 16 pages.

(Continued)

*Primary Examiner* — Daniel P Stephenson
(74) *Attorney, Agent, or Firm* — Rachel E. Greene

(57) ABSTRACT

A method of performing an oilfield operation about a wellbore penetrating a subterranean formation. The method involves performing a fracture operation comprising injecting fluid into the formation and generating fractures about the wellbore. The fractures form a fracture network about the wellbore. The method further involves collecting during the performing data comprising injection temperature and pressure, generating a fluid distribution through the fracture network by performing real time simulations of the fracture network based on the collected data (the fluid distribution comprising temperature distribution), and performing a production operation comprising generating production based on the temperature distribution.

19 Claims, 21 Drawing Sheets

Related U.S. Application Data continuation-in-part of application No. 12/479,335, filed as application No. PCT/US2012/048877 on Jul. 30, 2012, now Pat. No. 8,498,852.

(60) Provisional application No. 61/574,130, filed on Jul. 28, 2011.

(51) Int. Cl.

| | |
|---|---|
| ***E21B 43/26*** | (2006.01) |
| ***E21B 43/267*** | (2006.01) |
| ***E21B 47/06*** | (2012.01) |
| ***E21B 49/00*** | (2006.01) |

(58) Field of Classification Search

CPC ..... E21B 49/006; G01V 2210/624; G01V 2210/66; G01V 99/005

See application file for complete search history.

(56) References Cited

U.S. PATENT DOCUMENTS

| | | | | |
|---|---|---|---|---|
| 7,363,162 | B2 | 4/2008 | Thambynayagam et al. | |
| 7,486,589 | B2 | 2/2009 | Lee et al. | |
| 7,516,793 | B2 * | 4/2009 | Dykstra | E21B 43/267 166/177.5 |
| 7,788,037 | B2 * | 8/2010 | Soliman | G01N 15/0826 702/12 |
| 7,788,074 | B2 | 8/2010 | Scheidt et al. | |
| 8,498,852 | B2 | 7/2013 | Xu et al. | |
| 9,367,653 | B2 * | 6/2016 | Madasu | E21B 43/267 |
| 2005/0125209 | A1 * | 6/2005 | Soliman | E21B 43/26 703/10 |
| 2005/0171751 | A1 * | 8/2005 | Siebrits | E21B 43/26 703/10 |
| 2006/0190178 | A1 * | 8/2006 | Zamora | G01V 1/34 702/9 |
| 2006/0219402 | A1 | 10/2006 | Lecampion | |
| 2007/0023184 | A1 * | 2/2007 | Jackson | E21B 43/006 166/250.07 |
| 2007/0193737 | A1 * | 8/2007 | Miller | E21B 28/00 166/249 |
| 2007/0193745 | A1 | 8/2007 | Fulton et al. | |
| 2007/0272407 | A1 * | 11/2007 | Lehman | E21B 43/26 166/250.1 |
| 2008/0133186 | A1 | 6/2008 | Li et al. | |
| 2008/0164021 | A1 * | 7/2008 | Dykstra | E21B 43/267 166/250.1 |
| 2008/0183451 | A1 * | 7/2008 | Weng | E21B 43/26 703/10 |
| 2008/0259727 | A1 | 10/2008 | Drew | |
| 2009/0151938 | A1 * | 6/2009 | Conkle | E21B 7/00 166/254.1 |
| 2010/0032156 | A1 * | 2/2010 | Petty | E21B 43/26 166/252.1 |
| 2010/0108316 | A1 | 5/2010 | England et al. | |
| 2010/0138196 | A1 * | 6/2010 | Hui | E21B 43/00 703/1 |
| 2010/0250215 | A1 * | 9/2010 | Kennon | G06F 17/5018 703/10 |
| 2010/0307755 | A1 | 12/2010 | Xu et al. | |
| 2011/0067857 | A1 * | 3/2011 | Underhill | E21B 43/26 250/1 |
| 2011/0162849 | A1 * | 7/2011 | Soliman | E21B 49/00 166/308.1 |
| 2012/0152548 | A1 | 6/2012 | Hinkel et al. | |
| 2014/0151033 | A1 | 6/2014 | Xu | |
| 2014/0151035 | A1 * | 6/2014 | Cohen | E21B 43/00 166/250.15 |
| 2014/0163939 | A1 * | 6/2014 | Bourbiaux | E21B 43/26 703/2 |
| 2015/0066463 | A1 * | 3/2015 | Shetty | E21B 41/00 703/10 |
| 2016/0010443 | A1 * | 1/2016 | Xu | E21B 43/26 166/250.1 |
| 2016/0070024 | A1 * | 3/2016 | Berard | G01V 99/005 703/10 |
| 2016/0265331 | A1 * | 9/2016 | Weng | E21B 43/267 |
| 2016/0266278 | A1 * | 9/2016 | Holderby | G01V 1/288 |
| 2016/0319641 | A1 * | 11/2016 | Camp | E21B 43/26 |
| 2017/0030819 | A1 * | 2/2017 | McCarty | G01N 15/082 |
| 2017/0160429 | A1 * | 6/2017 | Berard | G01V 99/005 |
| 2017/0212973 | A1 * | 7/2017 | Bourbiaux | G06F 17/11 |
| 2017/0370197 | A1 * | 12/2017 | Han et al. | E21B 41/0092 |

OTHER PUBLICATIONS

Arps, "Analysis of Decline Curves", SPE Journal Paper, Chapt. 2, pp. 128-247 (1944).

Van Everdingen et al., "The Application of the Laplace Transformation to Flow Problems in Reservoirs", Petroleum Transactions AIME, Dec. 1949, pp. 305-324.

Van Kruysdijk et al., "Semianalytical Modeling of Pressure Transients in Fractured Reservoirs," SPE 18169, SPE Tech. Conf. and Exhibition, Oct. 2-5, 1988, Houston, TX, pp. 619-630.

Ozkan et al., "New Solutions for Well-Test-Analysis Problems: Part 1—Analytical Considerations", SPE 18615, SPE Formation Evaluation, vol. 6, No. 3, SPE, Sep. 1991, pp. 359-368, Discussion pp. 309-311.

Kikani, "Pressure-Transient Analysis of Arbitrarily Shaped Reservoirs With the Boundary-Element Method", SPE 18159 SPE Formation Evaluation, Mar. 1992, pp. 53-60.

De Swaan et al., "Analytic Solutions for Determining Naturally Fractured Reservoir Properties by Well Testing," SPE Jrnl., pp. 117-22, Jun. 1976.

Larsen, "Pressure-Transient Behavior of Horizontal Wells With Finite-Conductivity Vertical Fractures", SPE 22076, Soc. of Petroleum Engr., Intl. Arctic Tech. Conf., May 29-31, 1991, Anchorage, AL, pp. 197-214.

Kuchuk et al., "Pressure Behavior of Horizontal Wells with Multiple Fractures", SPE 27971, 1994, Soc. of Petroleum Engrs., Inc., Univ. of Tulsa Centennial Petroleum Engr. Symp., Aug. 29-31, 1994, Tulsa, OK, 11 pages.

Chen et al., "A Multiple-fractured Horizontal Well in a Rectangular Drainage Region", SPE Journal, SPE 37072, vol. 2, No. 4, Dec. 1997. pp. 455-465.

Brown et al., "Practical Solutions for Pressure Transient Responses of Fractured Horizontal Wells in Unconventional Reservoirs", SPE 125043, SPE Tech. Conf. and Exhibition in New Orleans, LA, 2009, 18 pages.

Bello, "Rate Transient Analysis in Shale Gas Reservoirs with Transient Linear Behavior", PhD Dissertation May 2009; 190 pages.

Bello et al., "Multi-stage Hydraulically Fractured Horizontal Shale Gas Well Rate Transient Analysis", SPE 126754, North Africa Tech. Conf. and Exhibition, Feb. 14-17, 2010, Cairo, Egypt, 17 pages.

Meyer et al, "Optimization of Multiple Transverse Hydraulic Fractures in Horizontal Wellbores", 2010, SPE 131732, SPE Unconventional Gas Conf., Feb. 23-25, 2010, Pittsburgh, PA, USA, 37 pages.

Thompson et al., "Advancements in Shale Gas Production Forecasting—A Marcellus Case Study," SPE 144436, North American Unconventional Gas Conf. and Exhibition, Jun. 14-16, 2011, The Woodlands, TX, USA, 12 pgaes.

Gringarten et al., "The Use of Source and Green's Functions in Solving Unsteady-Flow Problems in Reservoirs", Society of Petroleum Engineers Journal 3818, Oct. 1973, vol. 13, No. 5, pp. 285-296.

Cinco et al., "Transient Pressure Behavior for a Well With a Finite-Conductivity Vertical Fracture", SPE 6014, Society of Petroleum Engineers Journal, Aug. 15, 1976, pp. 253-264.

Warren et al., "The Behavior of Naturally Fractured Reservoirs", SPE Journal, vol. 3, No. 3, Sep. 1963, pp. 245-255.

Xu et al., "Quick Estimate of Initial Production from Stimulated Reservoirs with Complex Hydraulic Fracture Network," SPE 146753, SPE Annual Tech. Conf. and Exhibition, Denver, CO., Oct. 30-Nov. 2, 2011, 13 pages.

(56) References Cited

OTHER PUBLICATIONS

Xu, et al., "Characterization of Hydraulically-Induced Fracture Network Using Treatment and Microseismic Data in a Tight-Gas Sand Formation: A Geomechanical Approach", SPE 125237, SPE Tight Gas Completions Conf., Jun. 15-17, 2009, San Antonio, TX, USA, 5 pages.
Xu, et al., "Characterization of Hydraulically-Induced Shale Fracture Network Using an Analytical/Semi-Analytical Model", SPE 124697, SPE Annual Tech. Conf. and Exh., Oct. 4-7, 2009, New Orleans, LA, 7 pages.
Xu et al., "Fracture Network Development and Proppant Placement During Slickwater Fracturing Treatment of Barnett Shale Laterals", SPE 135484, SPE Tech. Conf. and Exhibition, Sep. 19-22, 2010, Florence, Italy, 6 pages.
Xu, et al., "Wiremesh: A Novel Shale Fracturing Simulator", SPE 132218, Intl. Oil and Gas Conf. and Exh. in China, Jun. 10, 2010, Beijing, China, 6 pages.
StimMAP LIVE Monitoring Process—Microseismic Fracture Monitoring with Accurate Answers in Real Time, Schlumberger, 07-ST-137, 2008, pp. 1-12.
Ambrose, et al., "Life-Cycle Decline Curve Estimation for Tight/Shale Gas Reservoirs", SPE 140519—SPE Hydraulic Fracturing Technology Conference and Exhibition, The Woodlands, Texas, Jan. 24-26, 2011, pp. 1-15.
Anonymous, "MANGROVE: Engineered Stimulation Design in the Petrel Platform", Schlumberger Brochure, 2013, pp. 1-2.
Cipolla, et al., "Hydraulic Fracture Monitoring to Reservoir Simulation: Maximizing Value", SPE 133877—SPE Annual Technical Conference and Exhibition, Florence, Italy, Sep. 19-22, 2010, pp. 1-26.
Economides, et al., "Petroleum production systems", PTR Prentice Hall, Technology & Engineering, 1994, pp. 421-457.
Fan, et al., "Understanding Gas Production Mechanism and Effectiveness of Well Stimulation in the Haynesville Shale Through Reservoir Simulation", CSUG/SPE 136696—SPE Canadian Unconventional Resources & International Petroleum Conference, Calgary, Alberta, Canada, Oct. 19-21, 2010, 15 pages.
Lolon, et al., "Application of 3-D Reservoir Simulator for Hydraulically Fractured Wells", SPE 110093—Asia Pacific Oil and Gas Conference and Exhibition, Jakarta, Indonesia, 2007, 8 pages.
Mayerhofer, et al., "Integration of microseismic fracture mapping results with numerical fracture network production modeling in the Barnett shale", SPE 102103—SPE Annual Technical Conference and Exhibition, San Antonio, Texas, Sep. 24-27, 2006, 8 pages.
Meyer, et al., "A Discrete Fracture Network Model for Hydraulically Induced Fractures: Theory, Parametric and Case Studies", SPE 140514—SPE Hydraulic Fracturing Technology Conference and Exhibition, The Woodlands, Texas, Jan. 24-26, 2011, 36 pages.
Meyer, B.R., "Three-Dimensional Hydraulic Fracturing Simulation on Personal Computers: Theory and Comparison Studies", SPE 19329—SPE Eastern Regional Meeting, Morgantown, West Virginia, Oct. 24-27, 1989, 18 pages.
Stehfest, H., "Algorithm 368: Numerical Inversion of Laplace Transforms", Communications of the ACM, vol. 13 (1), 1970, pp. 47-49.
Valko, et al., "Hydraulic Fracture Mechanics", First Edition, John Wiley & Sons, 1995, pp. 75, 189-265.
Warpinski, et al., "Review of Hydraulic Fracture Mapping Using Advanced Accelerometer-Based Receiver Systems", Sandia National Laboratories, 1977, pp. 1-11.
Weng, et al., "Modeling of Hydraulic-Fracture-Network Propagation in a Naturally Fractured Formation", SPE 140253—SPE Hydraulic Fracturing Technology Conference, The Woodlands, Texas, Jan. 24-26, 2011, 18 pages.
Van Kruysdijk et al., "A Boundary Element Solution of the Transient Pressure Response of Multiple Fractured Horizontal Wells", presented at the 2nd European Conf. on the Mathematics of Oil Recovery, Cambridge, UK, 1989, 25 pages.

* cited by examiner

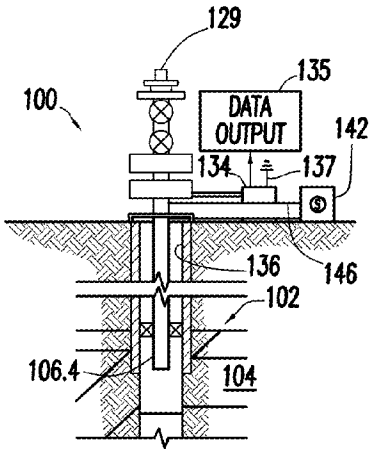
FIG. 1.1
FIG. 1.2
FIG. 1.3
FIG. 1.4
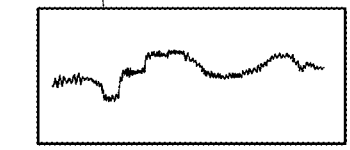
FIG. 2.1
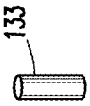
FIG. 2.2
FIG. 2.3
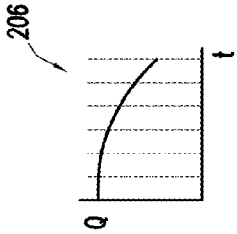
FIG. 2.4

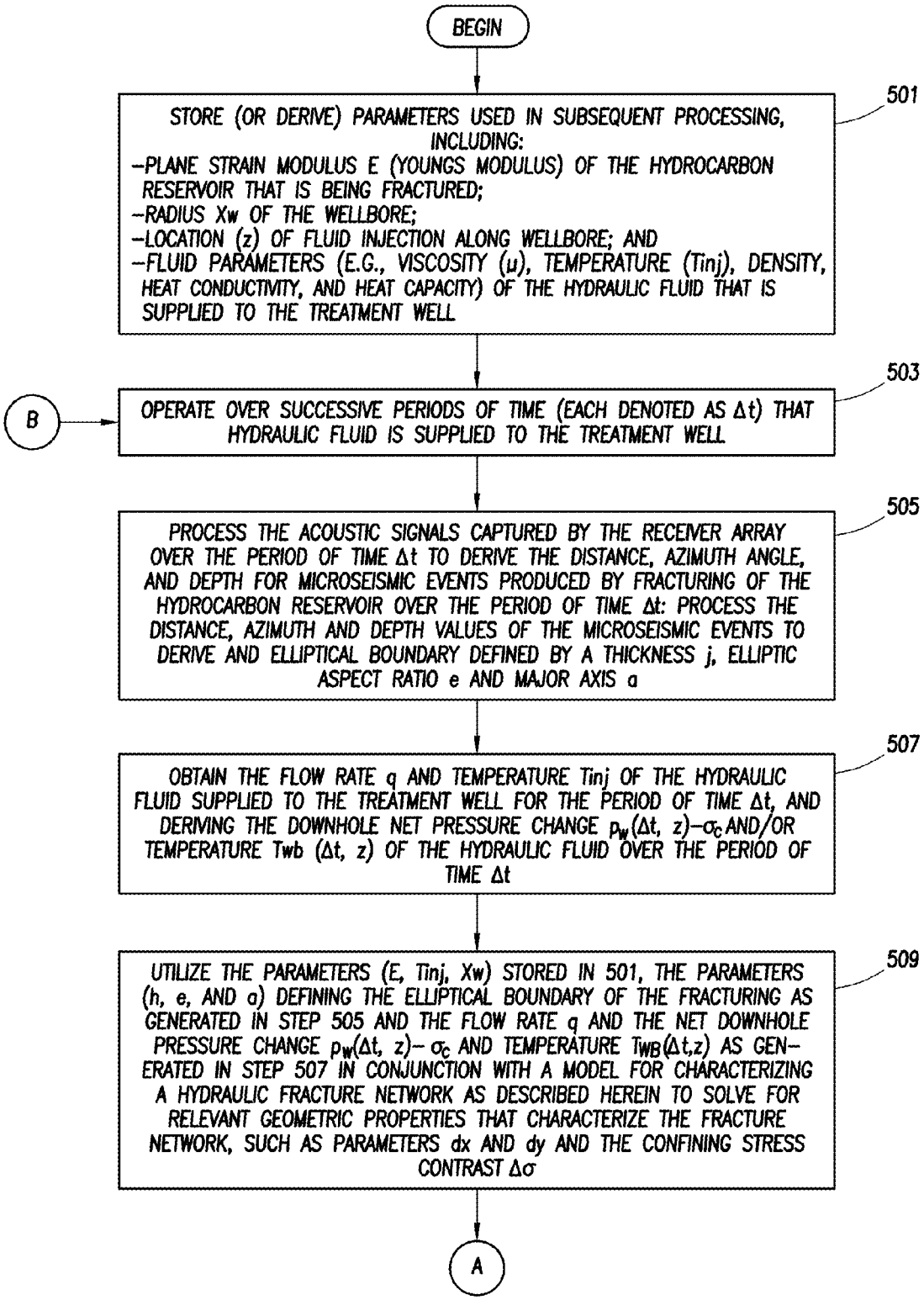
FIG.5.1.1

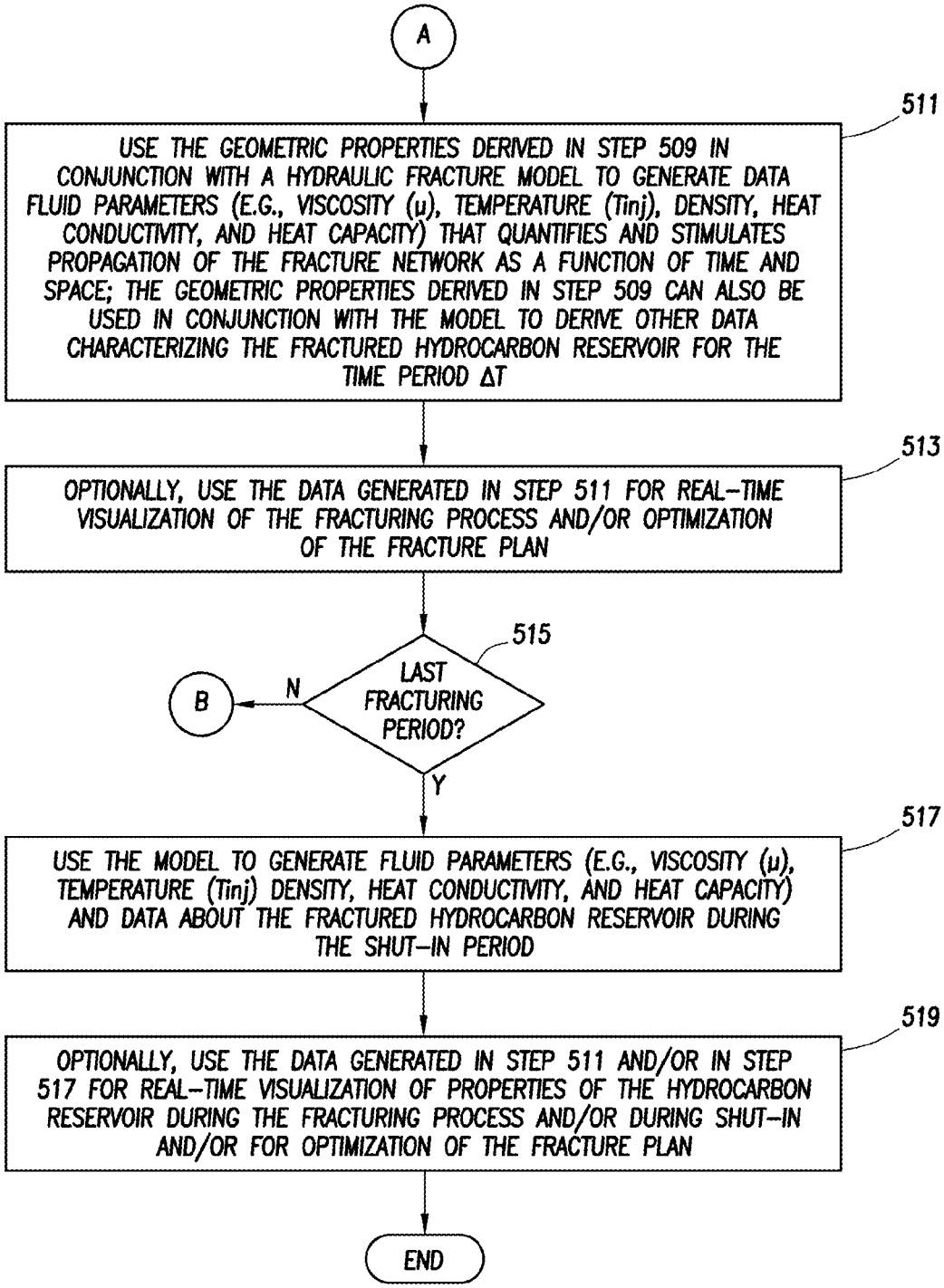
FIG.5.1.2

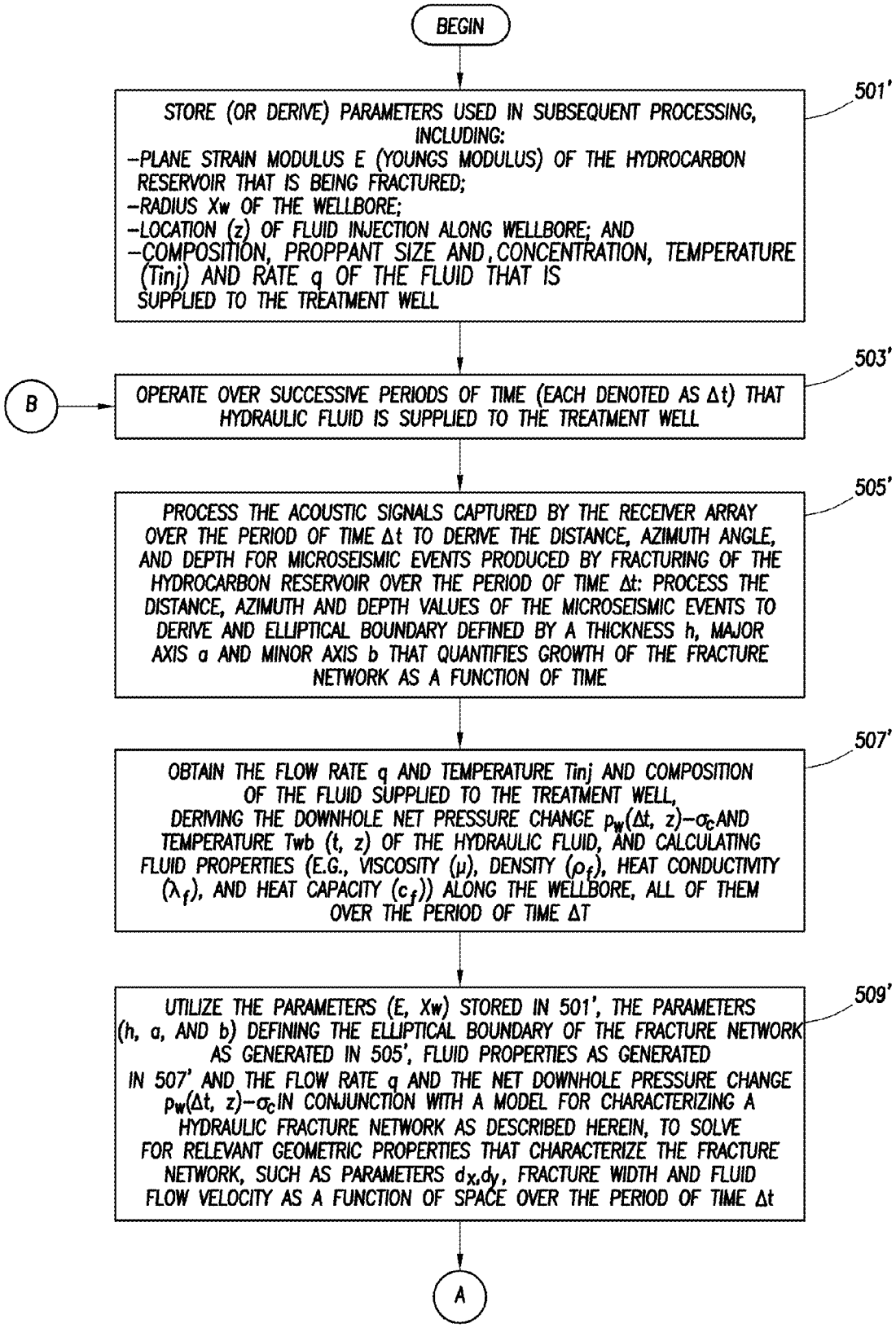
FIG.5.2.1

FIG.5.2.2
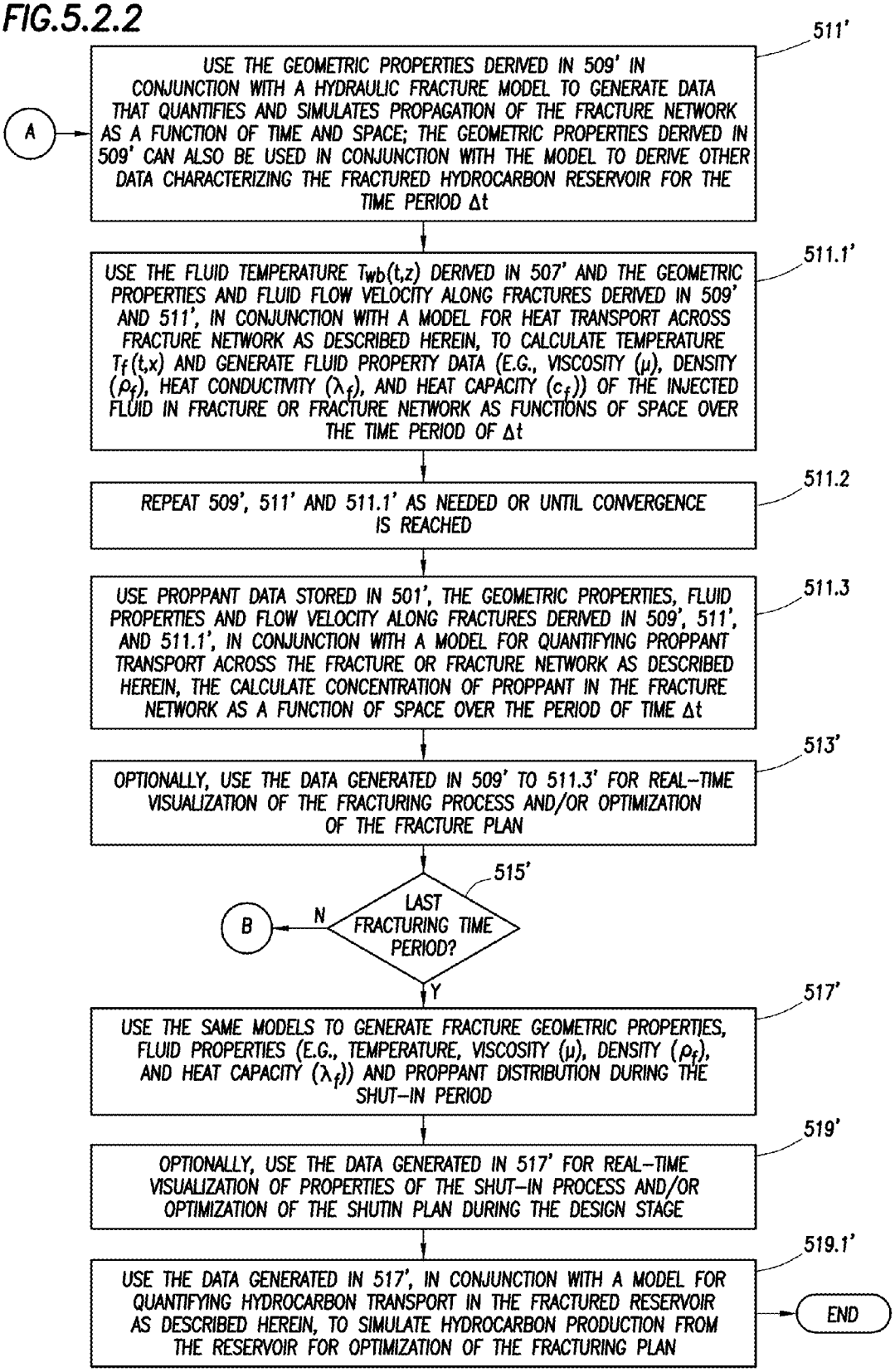

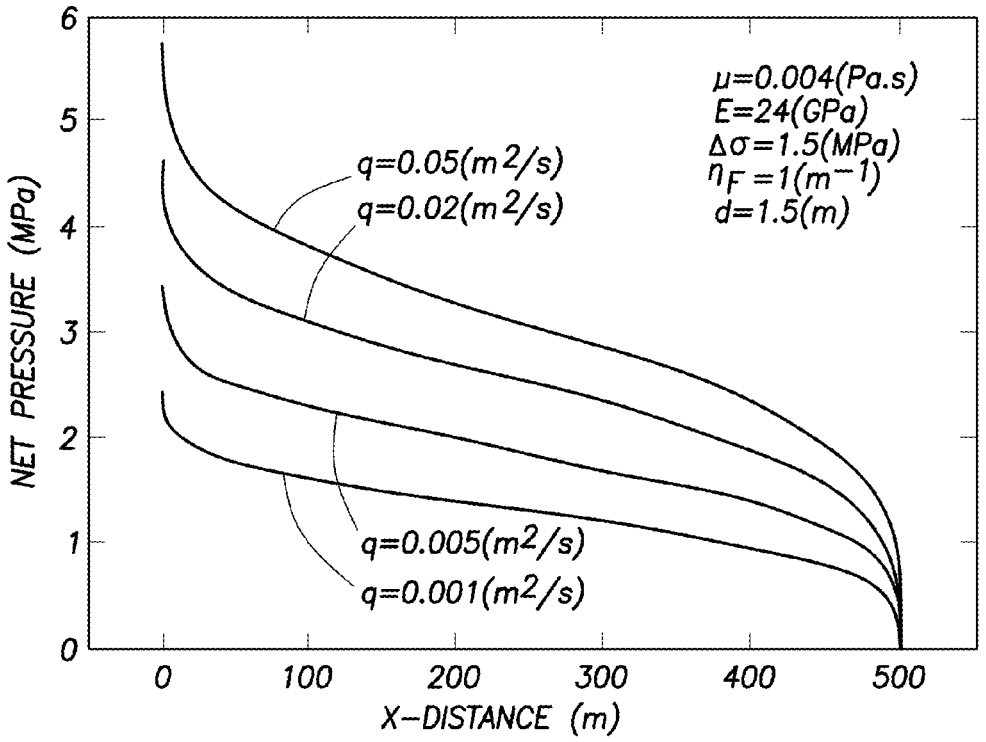
FIG.6.1
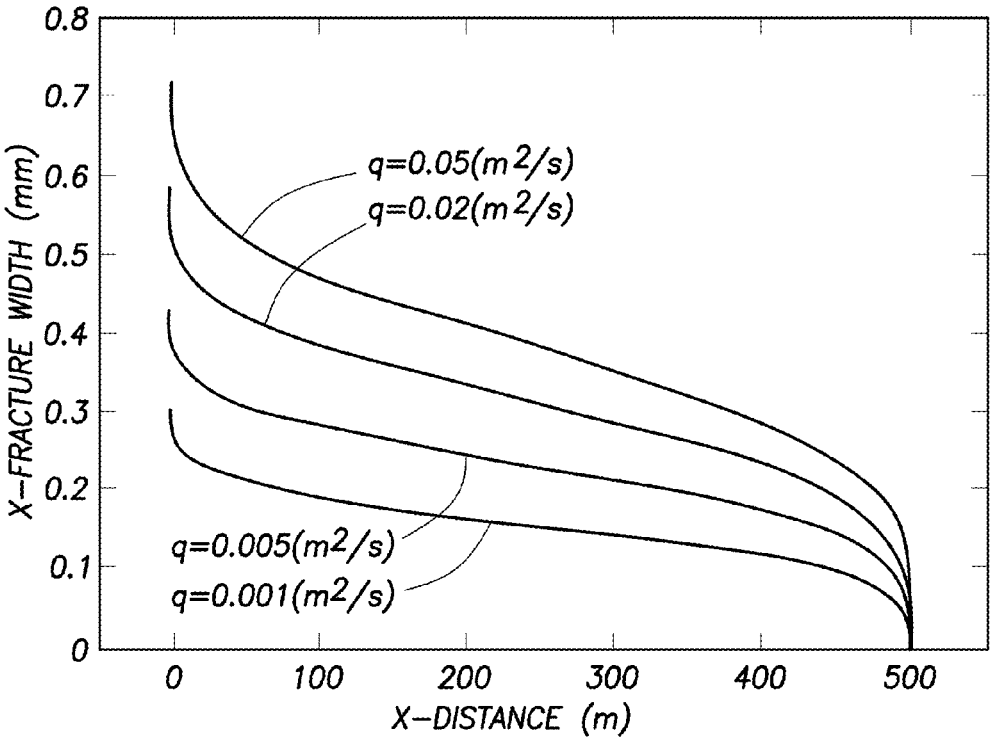
FIG.6.2

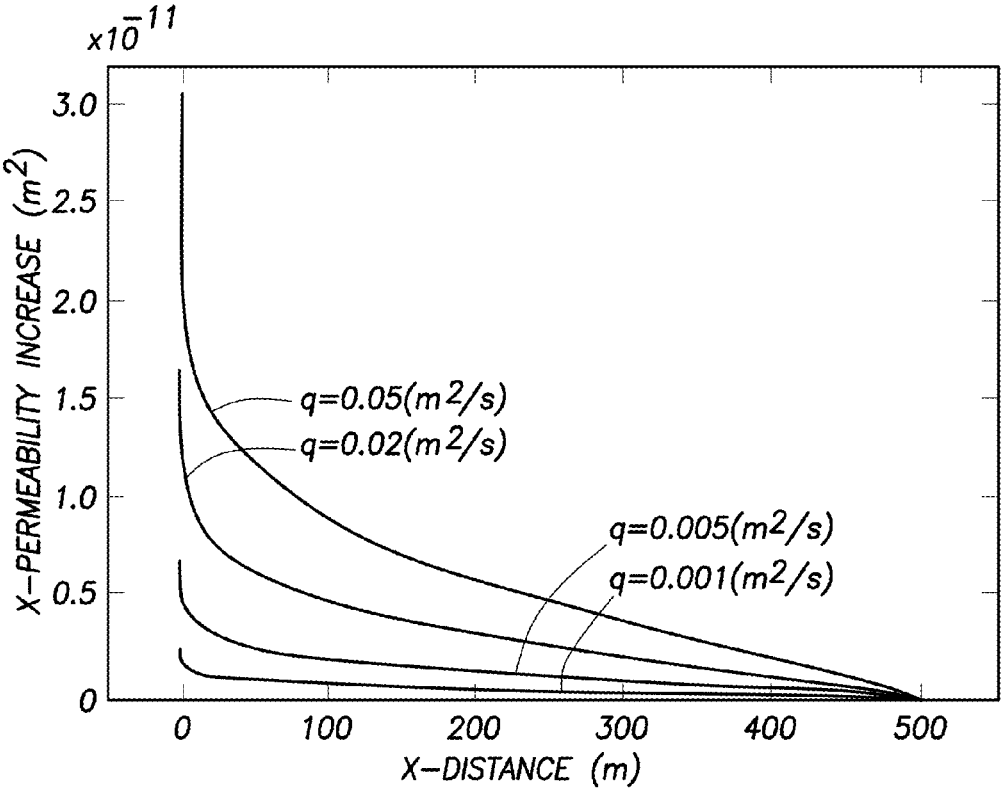
FIG.6.3
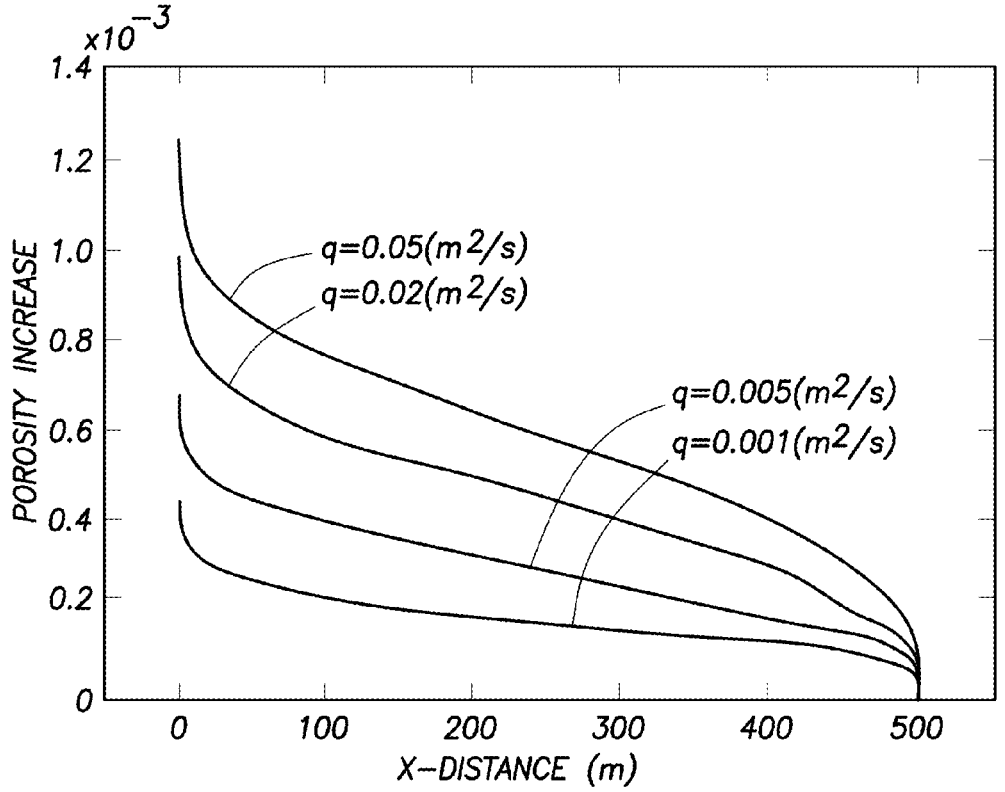
FIG.6.4

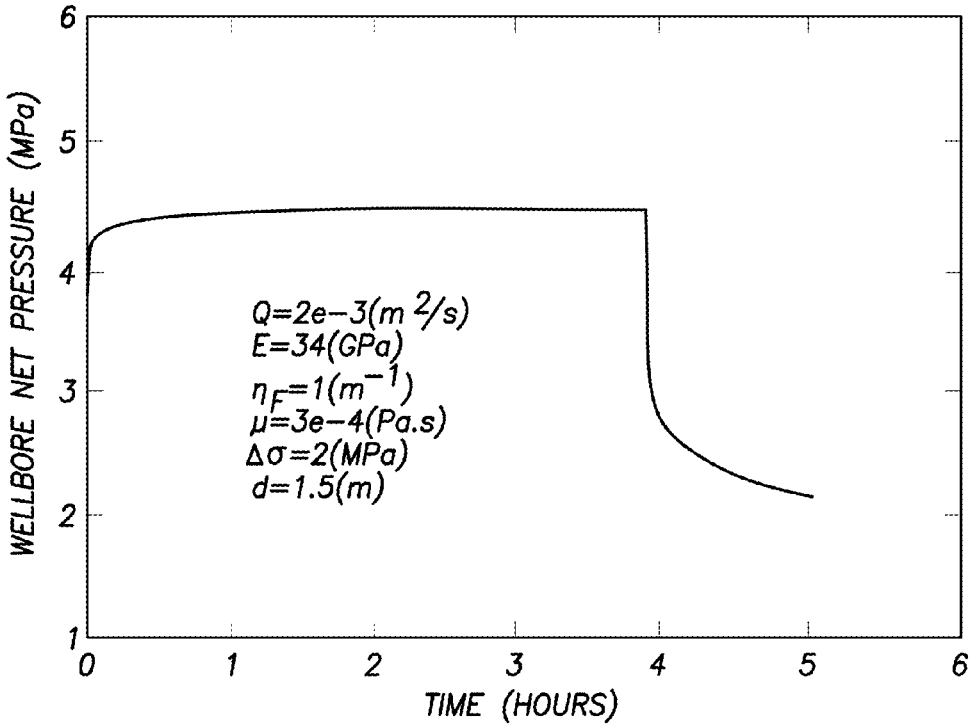
FIG.7.1
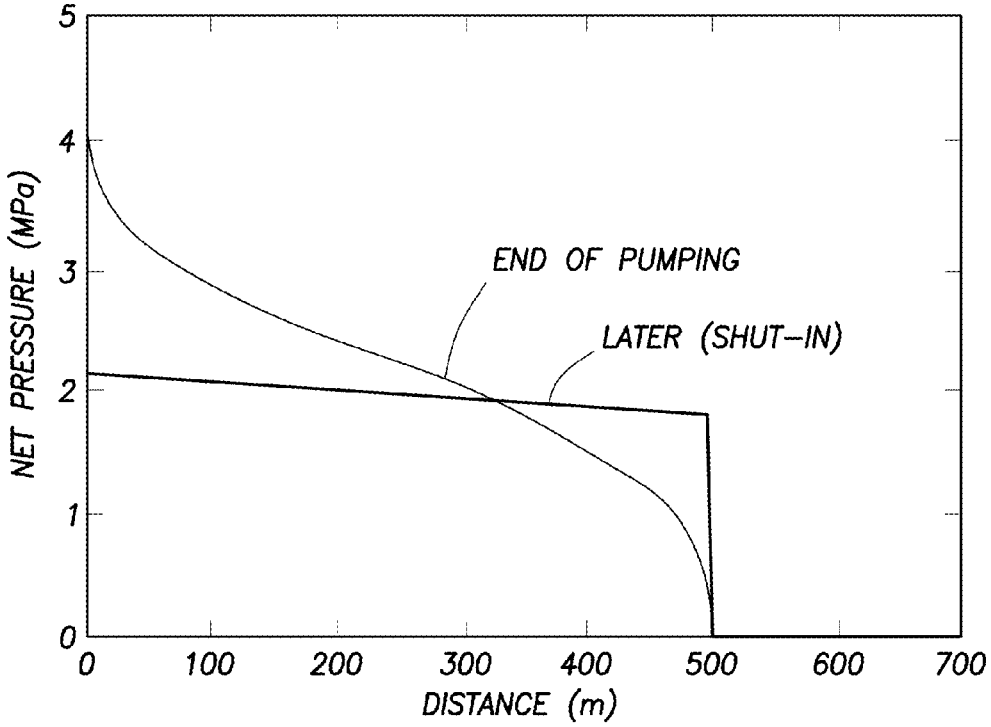
FIG.7.2

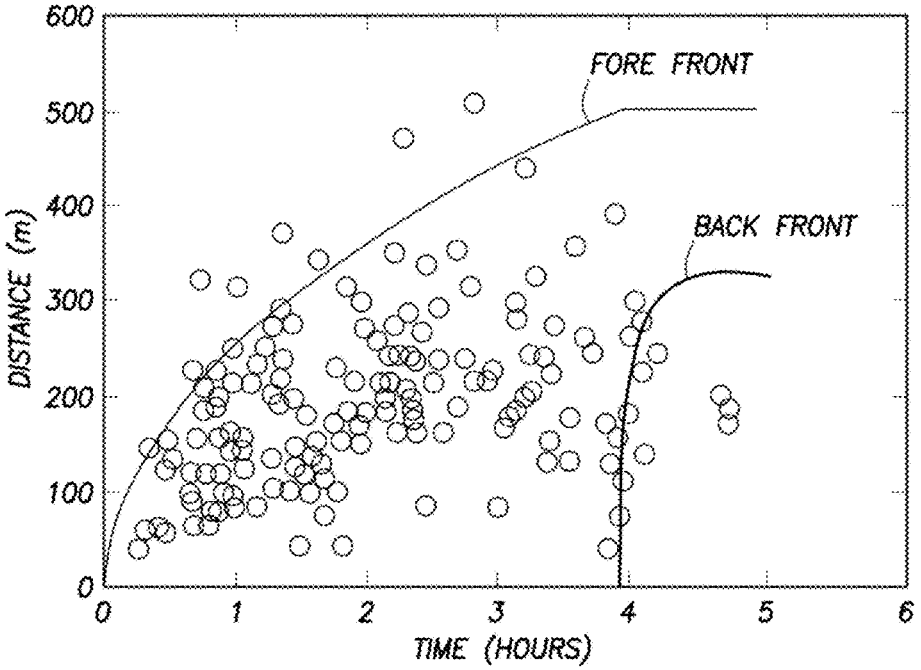
FIG.7.3
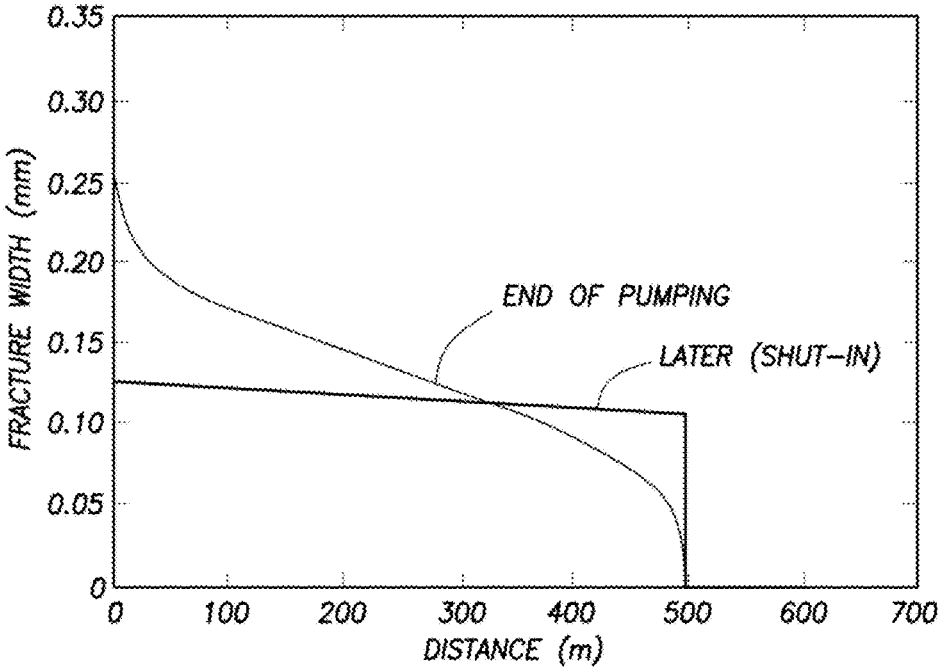
FIG.7.4

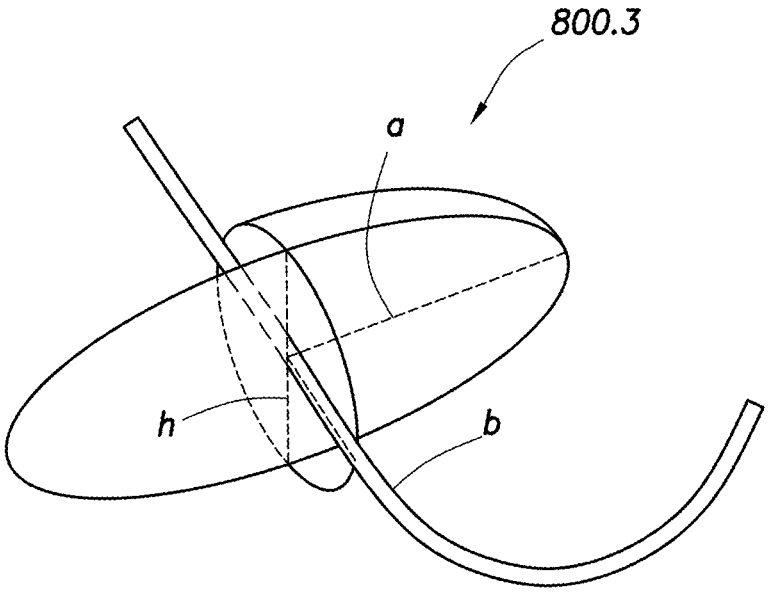
FIG.8.1
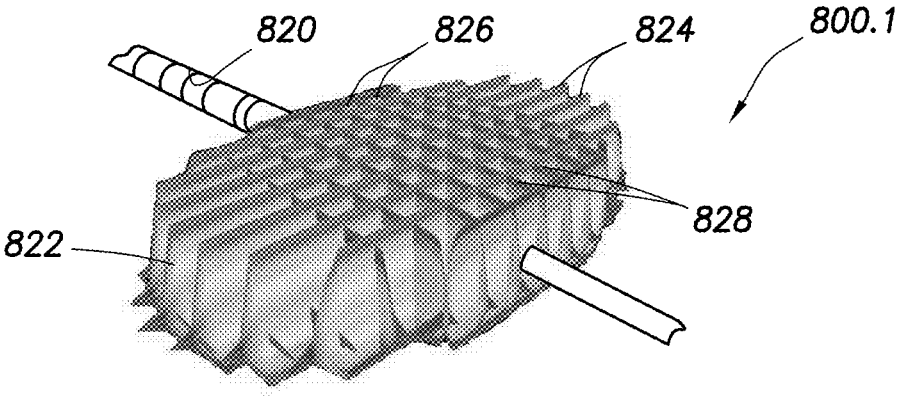
FIG.8.2

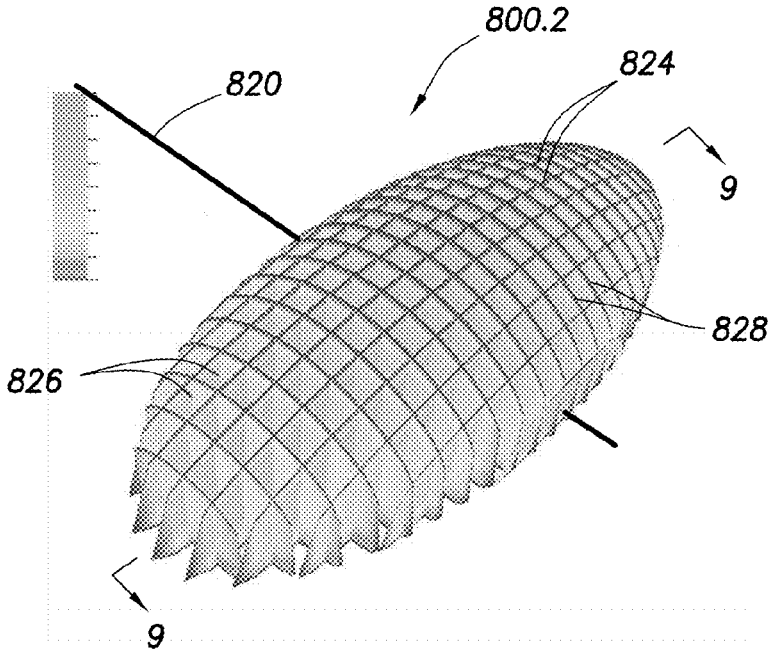
FIG.8.3
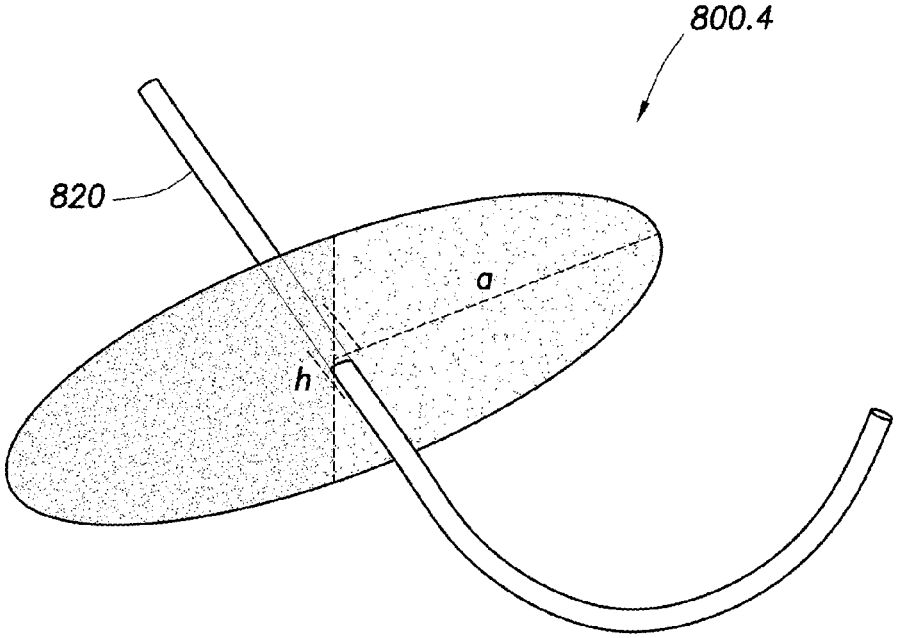
FIG.8.4

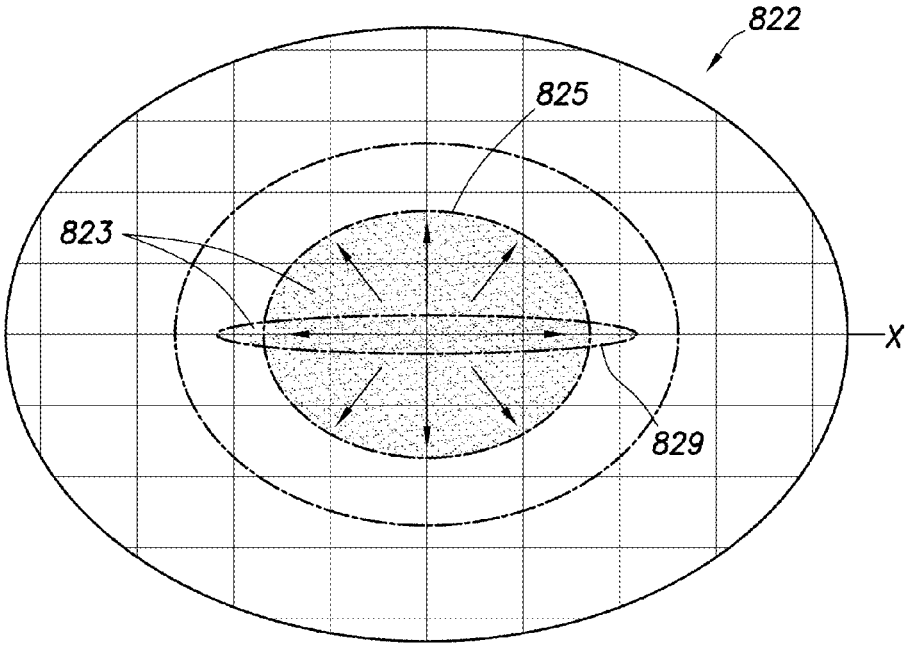
FIG.9.1
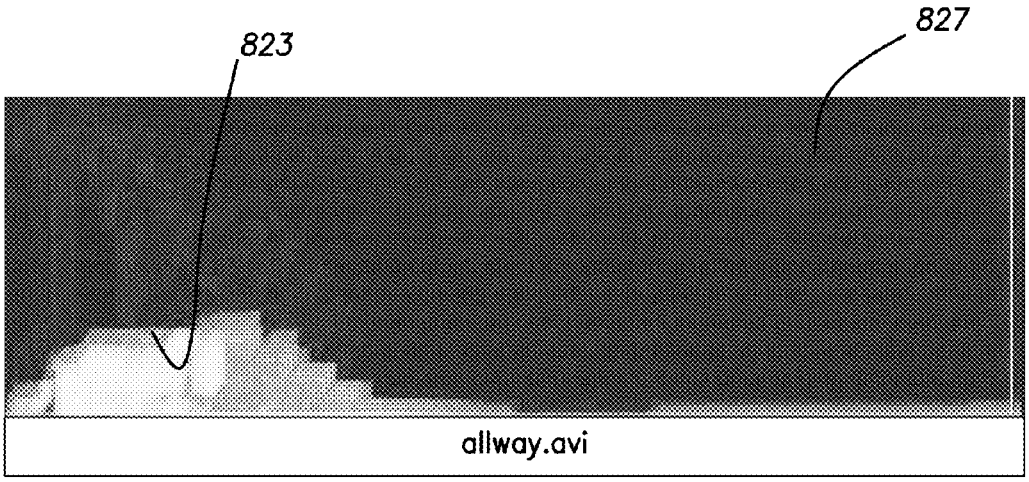
FIG.9.2

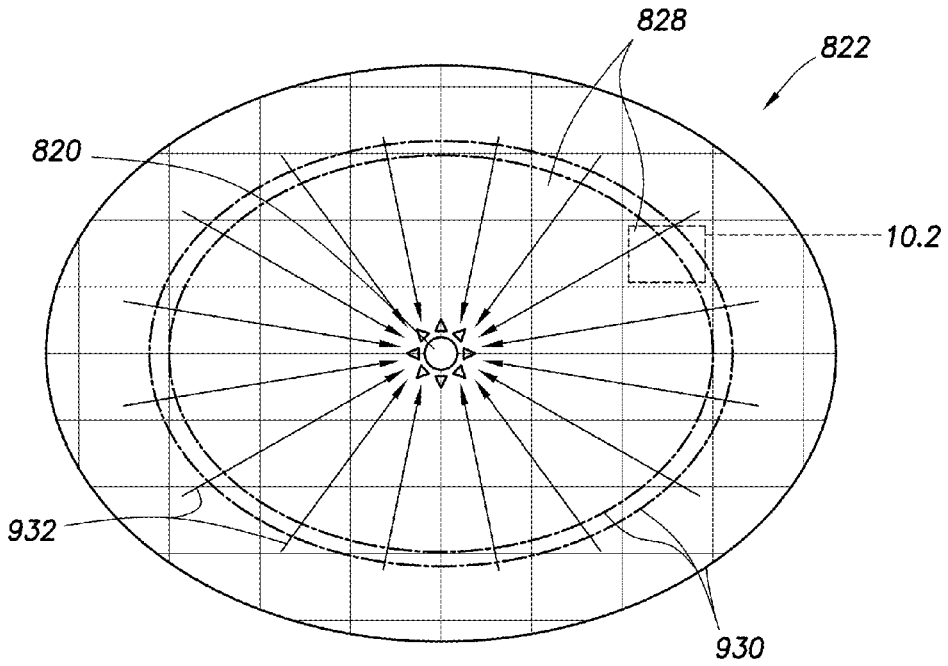
FIG. 10.1
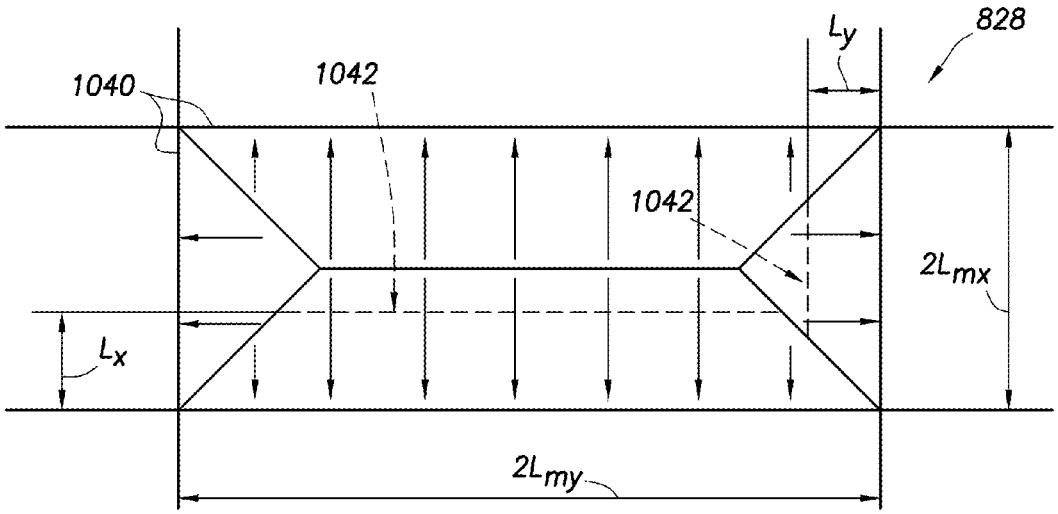
FIG. 10.2

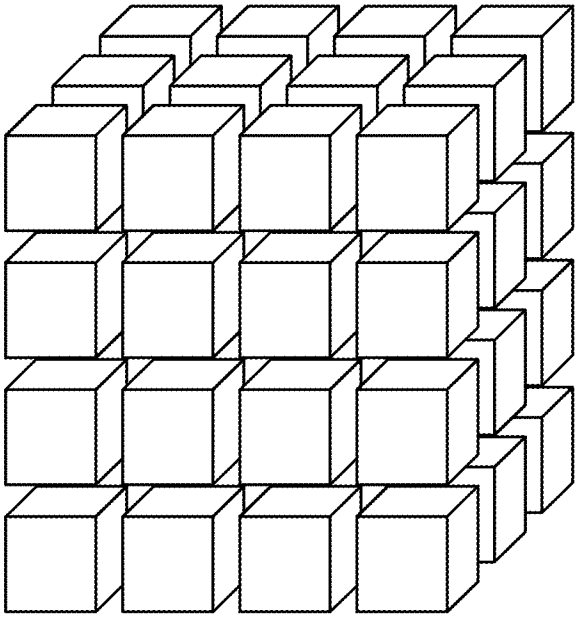
FIG. 11.2
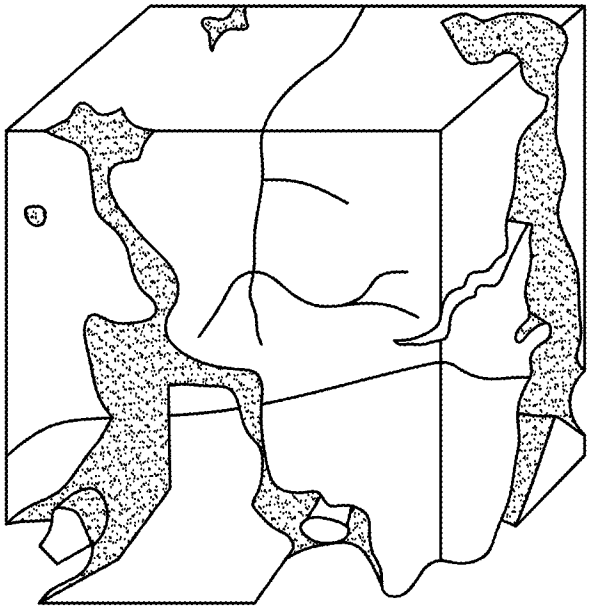
FIG. 11.1

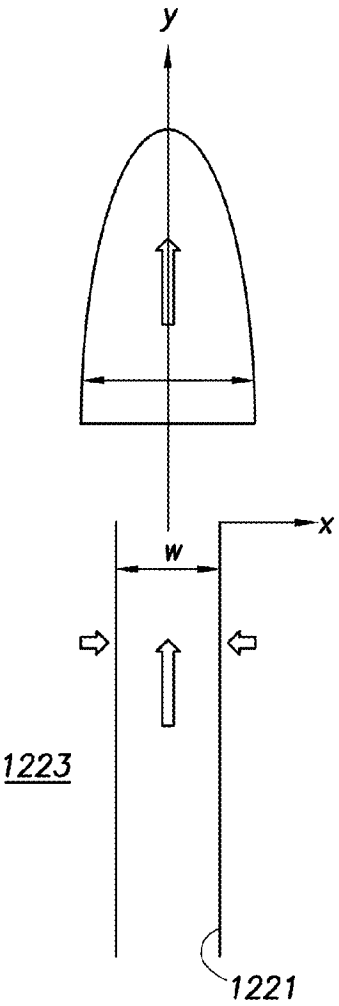
FIG. 12.2
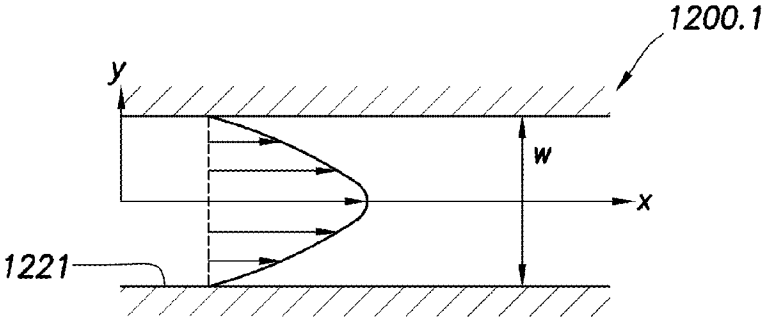
FIG. 12.1

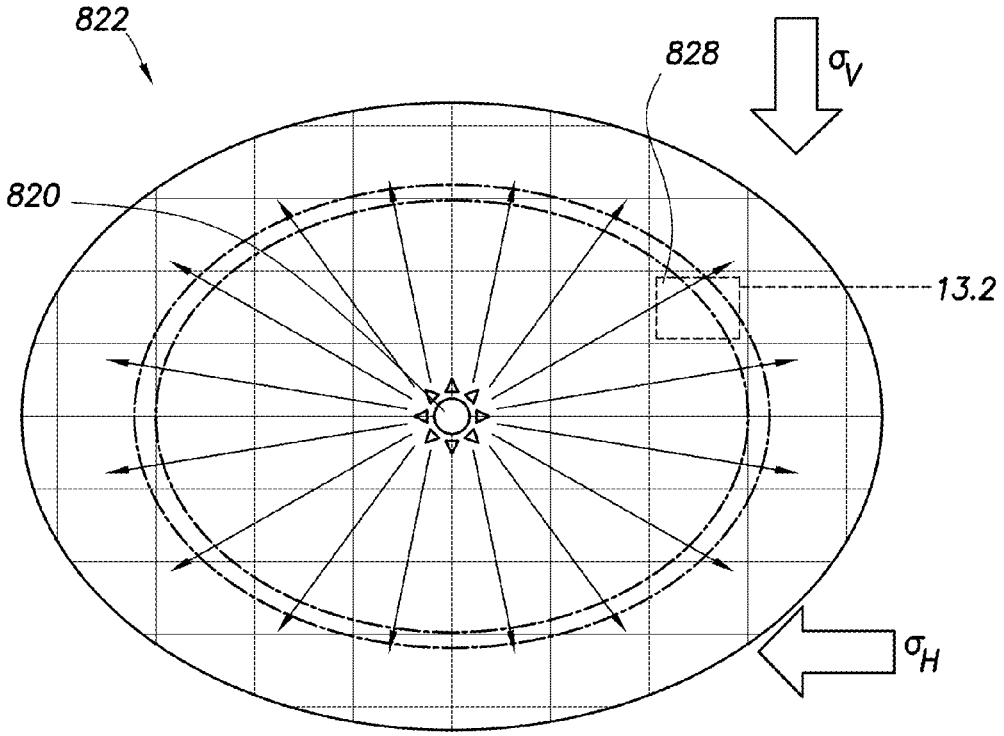
FIG. 13.1
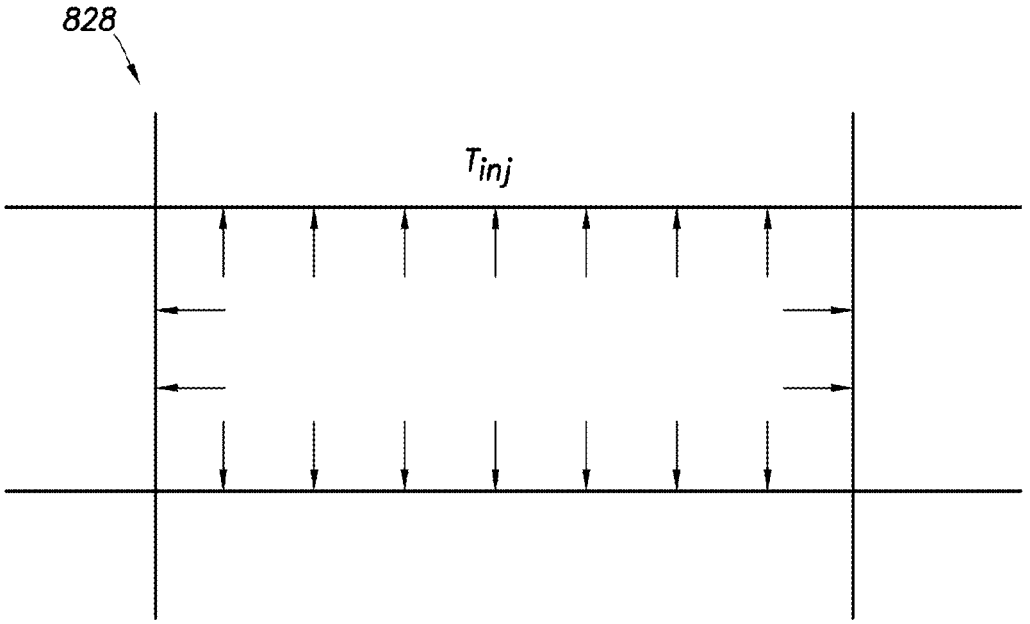
FIG. 13.2

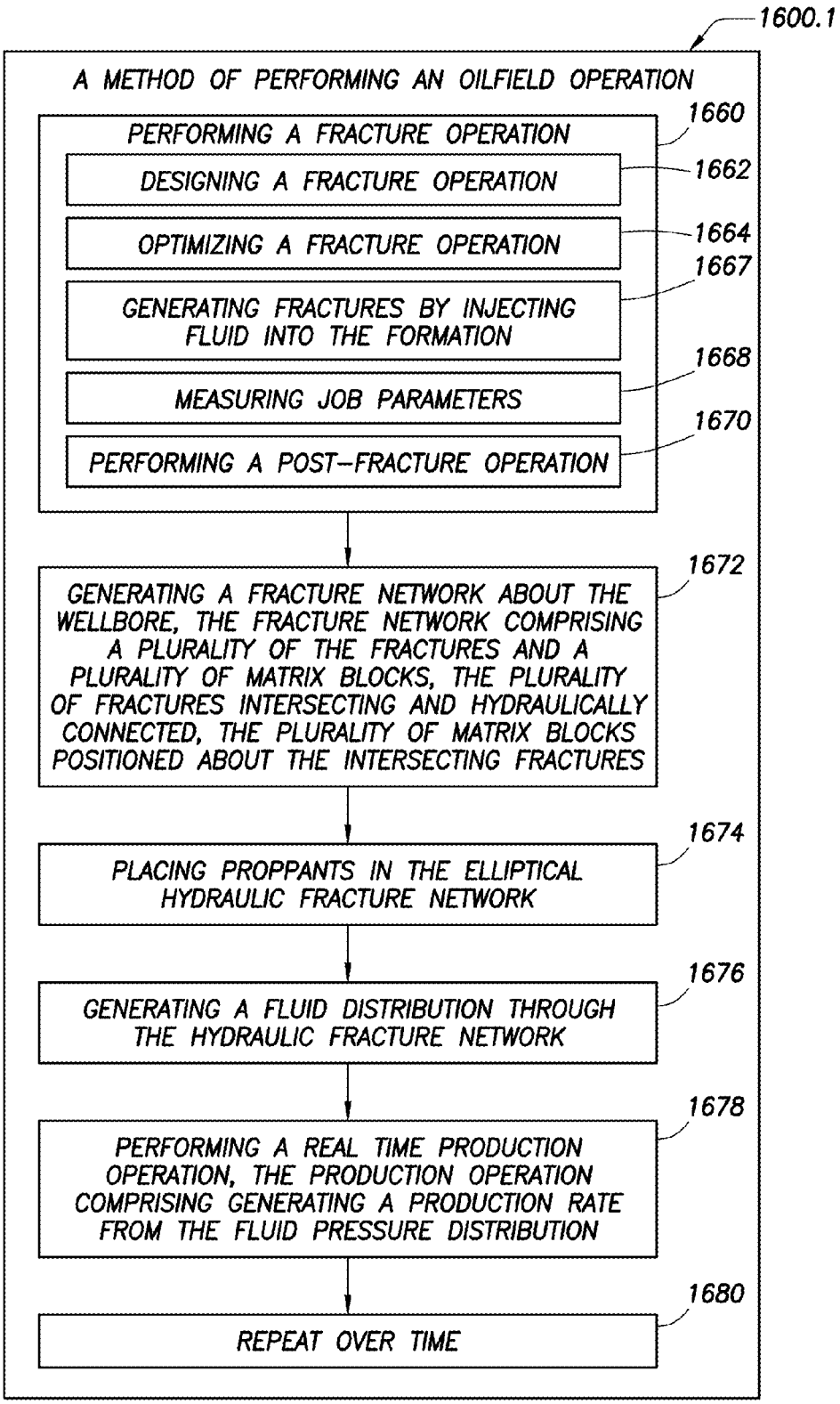
FIG. 16.1

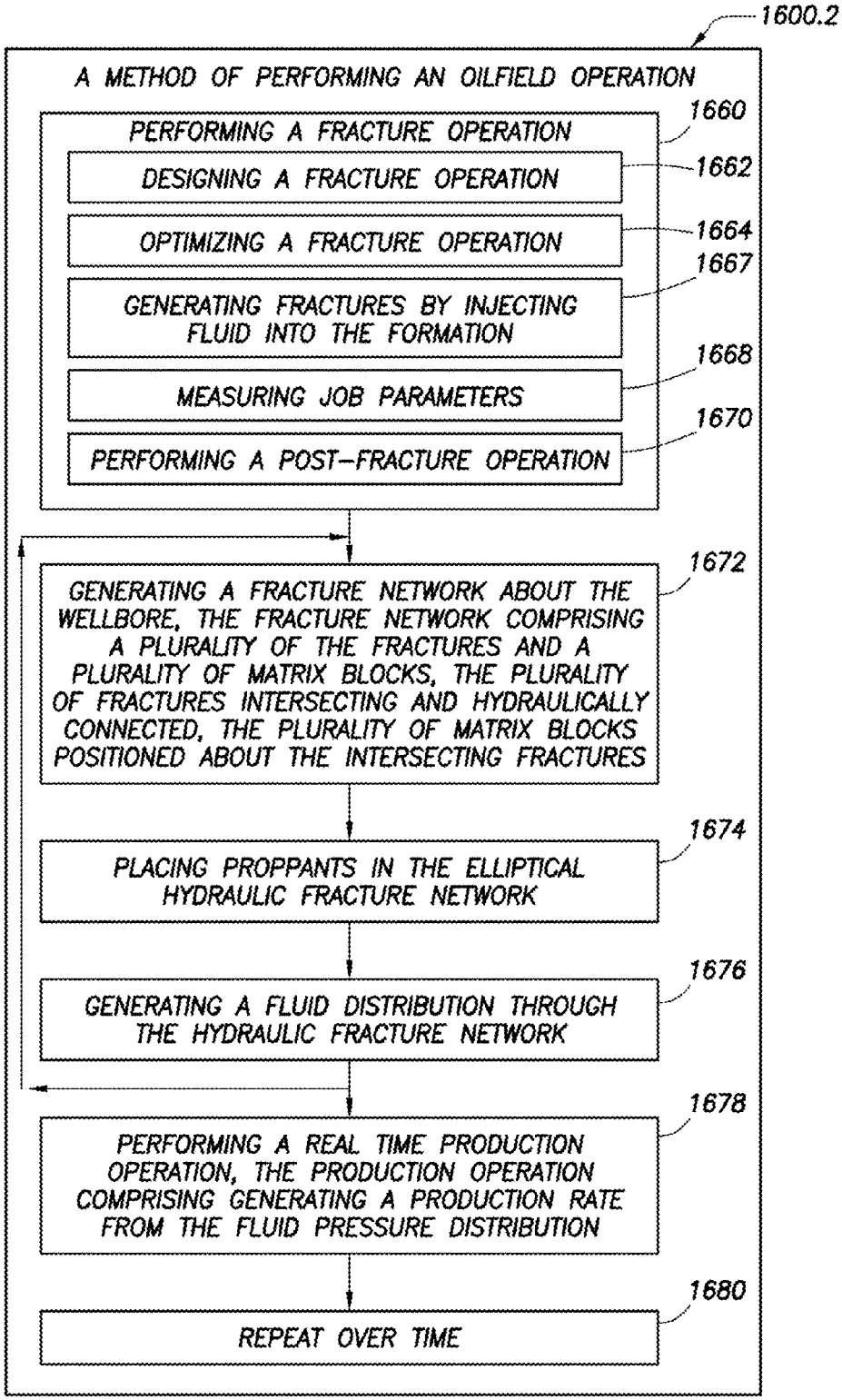
FIG. 16.2

METHOD FOR PERFORMING WELLBORE FRACTURE OPERATIONS USING FLUID TEMPERATURE PREDICTIONS

CROSS-REFERENCE TO RELATED APPLICATIONS

This application is a continuation in part of U.S. patent application Ser. No. 14/126,209 filed Jun. 30, 2012, which claims priority to U.S. Provisional Application No. 61/574,130 filed on Jul. 28, 2011 and which is a continuation in part of U.S. patent application Ser. No. 12/479,335, filed on Jun. 5, 2009 and which claims priority to PCT Application No. PCT/US2012/048877 filed Jul. 30, 2012, the entire contents of all four applications are hereby incorporated by reference herein.

BACKGROUND

The present disclosure relates generally to methods and systems for performing wellsite operations. More particularly, this disclosure is directed to methods and systems for performing fracture and production operations, such as investigating subterranean formations and characterizing hydraulic fracture networks in a subterranean formation.

In order to facilitate the recovery of hydrocarbons from oil and gas wells, the subterranean formations surrounding such wells can be hydraulically fractured. Hydraulic fracturing may be used to create cracks in subsurface formations to allow oil or gas to move toward the well. A formation is fractured by introducing a specially engineered fluid (referred to as "fracturing fluid" or "fracturing slurry" herein) at high pressure and high flow rates into the formation through one or more wellbore. Hydraulic fractures may extend away from the wellbore hundreds of feet in two opposing directions according to the natural stresses within the formation. Under certain circumstances, they may form a complex fracture network.

The fracturing fluids may be loaded with proppants, which are sized particles that may be mixed with the fracturing fluid to help provide an efficient conduit for production of hydrocarbons to flow from the formation/reservoir to the wellbore. Proppant may comprise naturally occurring sand grains or gravel, man-made or specially engineered proppants, e.g. fibers, resin-coated sand, or high-strength ceramic materials, e.g. sintered bauxite. The proppant collects heterogeneously or homogenously inside the fracture to "prop" open the new cracks or pores in the formation. The proppant creates a plane of permeable conduits through which production fluids can flow to the wellbore. The fracturing fluids are preferably of high viscosity, and therefore capable of carrying effective volumes of proppant material. Fluid viscosity may vary with fluid temperature.

The fracturing fluid may be realized by a viscous fluid, sometimes referred to as "pad" that is injected into the treatment well at a rate and pressure sufficient to initiate and propagate a fracture in hydrocarbon formation. Injection of the "pad" is continued until a fracture of sufficient geometry is obtained to permit placement of the proppant particles. After the "pad," the fracturing fluid may consist of a fracturing fluid and proppant material. The fracturing fluid may be gel, oil based, water based, brine, acid, emulsion, foam, or any other similar fluid. The fracturing fluid can contain several additives, viscosity builders, drag reducers, fluid-loss additives, corrosion inhibitors and the like. In order to keep the proppant suspended in the fracturing fluid until such time as all intervals of the formation have been fractured as desired, the proppant may have a density close to the density of the fracturing fluid utilized. Sometimes certain type of fibers may be used together with the proppant for various purposes, such as enhanced proppant-carrying, proppant segmenting, selective fracture growth, leakoff prevention, etc.

Proppants may be comprised of any of the various commercially available fused materials, such as silica or oxides. These fused materials can comprise any of the various commercially available glasses or high-strength ceramic products. Following the placement of the proppant, the well may be shut-in for a time sufficient to permit the pressure to bleed off into the formation or to permit the degradation of fibers, cross-linked gel or filter cake, depending on fluid temperature. The shut-in process causes the fracture to close and exert a closure stress on the propping agent particles. The shut-in period may vary from a few minutes to several days.

Current hydraulic fracture monitoring methods and systems may map where the fractures occur and the extent of the fractures. Some methods and systems of microseismic monitoring may process seismic event locations by mapping seismic arrival times and polarization information into three-dimensional space through the use of modeled travel times and/or ray paths. These methods and systems can be used to infer hydraulic fracture propagation over time.

Conventional hydraulic fracture models may also assume a bi-wing type induced fracture. These bi-wing fractures may be short in representing the complex nature of induced fractures in some unconventional reservoirs with preexisting natural fractures. Published models may map the complex geometry of discrete hydraulic fractures based on monitoring microseismic event distribution.

In some cases, models may be constrained by accounting for either the amount of pumped fluid or mechanical interactions both between fractures and injected fluid and among the fractures. Some of the constrained models may provide a fundamental understanding of involved mechanisms, but may be complex in mathematical description and/or require computer processing resources and time in order to provide accurate simulations of hydraulic fracture propagation.

Unconventional formations, such as shales, are being developed as reservoirs of hydrocarbon production. Once considered as source rocks and seals, shale formations are now considered as tight-porosity and low-permeability unconventional reservoirs. Hydraulic fracturing of shale formations may be used to stimulate and produce from the reservoir. The effectiveness and efficiency of a fracturing job may ultimately be judged by production from the stimulated reservoir.

Patterns of hydraulic fractures created by the fracturing stimulation may be complex and form a fracture network as indicated by the distribution of associated microseismic events. Models of complex hydraulic fracture networks (HFNs) have been developed to represent the created hydraulic fractures. Examples of fracture models are provided in U.S. Pat. Nos. 6,101,447, 7,363,162, 7,788,074, 8,498,852, 20080133186, 20100138196, and 20100250215.

Due to the complexity of HFNs, production from a stimulated shale reservoir may be numerically simulated. Numerical simulation for stimulation job design and post-job analysis may be time-consuming, and it may be inconvenient to construct a numerical model and carry out runs for each of the numerous designs of a stimulation job. Analytical solutions to HFN models and associated calculations for predicting fluid temperature or proppant transport are constantly sought to enhance stimulation job design and post-job analysis.

SUMMARY

The present application discloses methods and systems for characterizing hydraulic fracturing of a subterranean formation based upon inputs from sensors measuring field data in conjunction with a hydraulic fracture network model. The fracture model constrains geometric properties of the hydraulic fractures of the subterranean formation using the field data in a manner that significantly reduces the complexity of the fracture model and thus reduces the processing resources and time required to provide accurate characterization of the hydraulic fractures of the subterranean formation. Such characterization can be generated in real-time to manually or automatically manipulate surface and/or downhole physical components supplying fracturing fluids to the subterranean formation to adjust the hydraulic fracturing process as desired, such as by optimizing the fracturing plan for the site (or for other similar fracturing sites).

In some embodiments, the methods and systems of the present disclosure are used to design wellbore placement and hydraulic fracturing stages during the planning phase in order to optimize hydrocarbon production. In some embodiments, the methods and systems of the present disclosure are used to adjust the hydraulic fracturing process in real-time by controlling the flow rates, temperature, compositions, and/or properties of the fracturing fluid supplied to the subterranean formation. In some embodiments, the methods and systems of the present disclosure are used to adjust the hydraulic fracturing process by modifying the fracture dimensions in the subterranean formation in real time.

The method and systems of the present disclosure may also be used to facilitate hydrocarbon production from a well and from subterranean fracturing (whereby the resulting fracture dimensions, directional positioning, orientation, and geometry, and the placement of a proppant within the fracture more closely resemble the desired results).

In another aspect, the disclosure relates to a method of performing an oilfield operation about a wellbore penetrating a subterranean formation. The method involves performing a fracture operation. The fracture operation involves generating a plurality of fractures about the wellbore and generating a fracture network about the wellbore. The fracture network includes the fractures and a plurality of matrix blocks positioned thereabout. The fractures are intersecting, partially or fully propped, and hydraulically connected. The matrix blocks are positioned about the fractures. The method also involves generating rate of hydrocarbon flow through the fracture network, generating a hydrocarbon fluid distribution based on the flow rate, and performing a production operation, the production operation comprising generating a production rate from the hydrocarbon fluid distribution.

In another aspect, the disclosure relates to a method of performing an oilfield operation about a wellbore penetrating a subterranean formation. The method involves performing a fracture operation. The fracture operation involves stimulating the wellbore and generating a fracture network about the wellbore. The stimulating involves injecting fluid into the subterranean formation such that fractures are generated about the wellbore. The fracture network includes the fractures and a plurality of matrix blocks positioned thereabout. The fractures are intersecting and hydraulically connected. The plurality of matrix blocks is positioned about the fractures. The method also involves placing proppants in the fracture network, generating rate of hydrocarbon flow through the fracture network, generating a hydrocarbon fluid distribution based on the flow rate, and performing a production operation. The production operation involves generating a production rate from the hydrocarbon fluid distribution.

Finally, in another aspect, the disclosure relates to a method of performing an oilfield operation about a wellbore penetrating a subterranean formation. The method involves designing a fracture operation based on job parameters and performing the fracture operation. The fracture operation involves generating a fracture network about the wellbore. The fracture network includes a plurality of fractures and a plurality of matrix blocks. The fractures are intersecting and hydraulically connected. The matrix blocks are positioned about the fractures. The method also involves optimizing the fracture operation by adjusting the fracture operation based on a comparison of a simulated production rate with actual data, generating a rate of hydrocarbon flow through the fracture network, generating a hydrocarbon fluid distribution based on the flow rate, and performing a production operation. The simulated production rate is based on the fracture network. The production operation involves generating a production rate from the hydrocarbon fluid distribution.

In yet another aspect, the disclosure relates to a method of performing an oilfield operation about a wellbore penetrating a subterranean formation. The method involves performing a fracture operation comprising injecting fluid into the formation and generating fractures about the wellbore. The fractures form a fracture network about the wellbore. The method further involves collecting during the performing data comprising injection temperature and pressure, generating a fluid and proppant distribution through the fracture network by performing real time simulations of the fracture network based on the collected data (the fluid distribution comprising temperature distribution), and performing a production operation comprising generating production from the reservoir embedded with the generated fractures. The method may involve optimizing the fracturing operation during its design stage based on comparison of predicted production corresponding to various fracturing designs with different job parameters. The method may also involve optimizing the fracture operation by adjusting the generating based on a comparison of the predicted production with actual production.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Embodiments of the system and method for characterizing wellbore stresses are described with reference to the following figures. The same numbers are used throughout the figures to reference like features and components.

FIGS. 1.1-1.4 are schematic views illustrating various oilfield operations at a wellsite;

FIGS. 2.1-2.4 are schematic views of data collected by the operations of FIGS. 1.1-1.4;

FIGS. 5.1.1 and 5.1.2, collectively, depict a flow chart illustrating operations carried out by the hydraulic fracturing site of FIG. 4 for fracturing treatment of the illustrative treatment well in accordance with the present disclosure;

FIGS. 5.2.1 and 5.2.2, collectively, depict a flow chart illustrating another version of the operations carried out by the hydraulic fracturing site of FIG. 4 for fracturing treatment of the illustrative treatment well in accordance with the present disclosure;

FIGS. 6.1-6.4 depict exemplary display screens for visualizing properties of the treatment well and fractured hydrocarbon reservoir during the fracturing treatment of the illustrative treatment well of FIG. 4 in accordance with the present disclosure;

FIGS. 7.1-7.4 depict exemplary display screens for visualizing properties of the treatment well and fractured hydrocarbon reservoir during the fracturing treatment and during a subsequent shut-in period of the illustrative treatment well of FIG. 4 in accordance with the present disclosure;

FIGS. 8.1-8.4 are schematic diagrams illustrating various aspects of an elliptical hydraulic fracture network about a well in accordance with the present disclosure;

FIG. 9.1 is a schematic diagram illustrating a cross-sectional view of the elliptical hydraulic fracture network of FIG. 8.3 depicting proppant placement therein. FIG. 9.2 is a picture of proppant extending into a fracture network in accordance with the present disclosure;

FIG. 10.1 is a schematic diagram illustrating a cross-sectional view of the elliptical hydraulic fracture network of FIG. 8.1. FIG. 10.2 is a detailed view of a matrix block of the network of FIG. 10.1 in accordance with the present disclosure;

FIGS. 11.1 and 11.2 are various schematic diagrams depicting fluid flow through a porous medium in accordance with the present disclosure;

FIGS. 12.1 and 12.2 are schematic diagrams illustrating fluid flow through a fracture in accordance with the present disclosure;

FIGS. 13.1 and 13.2 are schematic diagrams illustrating a cross-sectional view of the elliptical hydraulic fracture network and a matrix block, respectively, in accordance with the present disclosure;

FIGS. 16.1-16.2 are flow charts depicting methods for performing a production operation in accordance with the present disclosure.

DETAILED DESCRIPTION

Figure 3:
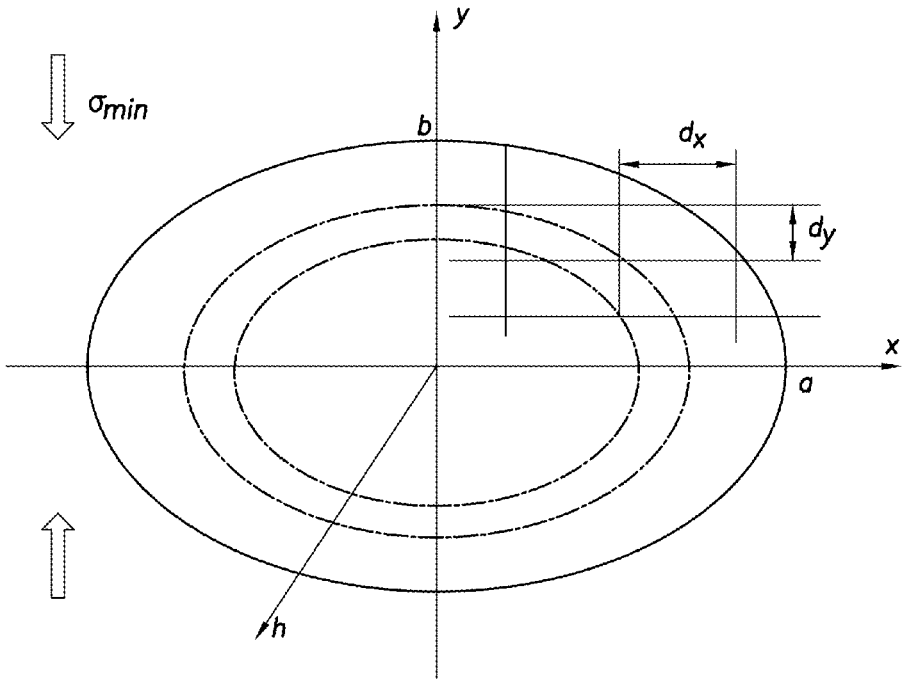
FIG. 3 is a pictorial illustration of geometric properties of an exemplary hydraulic fracture model in accordance with the present disclosure.

The description that follows includes exemplary systems, apparatuses, methods, and instruction sequences that embody techniques of the subject matter herein. However, it is understood that the described embodiments may be practiced without these specific details.

The present disclosure relates to techniques for performing fracture operations to predict temperature of fracturing fluid. The fracture operations involve fracture modeling that utilize elliptical wiremesh modeling and proppant transport modeling to estimate production. The techniques may involve viscosity and/or temperature estimations.

Oilfield Operations

FIGS. 1.1-1.4 depict various oilfield operations that may be performed at a wellsite, and FIGS. 2.1-2.4 depict various information that may be collected at the wellsite. FIGS. 1.1-1.4 depict simplified, schematic views of a representative oilfield or wellsite 100 having subsurface formation 102 containing, for example, reservoir 104 therein and depicting various oilfield operations being performed on the wellsite 100. FIG. 1.1 depicts a survey operation being performed by a survey tool, such as seismic truck 106.1, to measure properties of the subsurface formation. The survey operation may be a seismic survey operation for producing sound vibrations. In FIG. 1.1, one such sound vibration 112 generated by a source 110 reflects off a plurality of horizons 114 in an earth formation 116. The sound vibration(s) 112 may be received in by sensors, such as geophone-receivers 118, situated on the earth's surface, and the geophones 118 produce electrical output signals, referred to as data received 120 in FIG. 1.1.

In response to the received sound vibration(s) 112 representative of different parameters (such as amplitude and/or frequency) of the sound vibration(s) 112, the geophones 118 may produce electrical output signals containing data concerning the subsurface formation. The data received 120 may be provided as input data to a computer 122.1 of the seismic truck 106.1, and responsive to the input data, the computer 122.1 may generate a seismic and microseismic data output 124. The seismic data output may be stored, transmitted or further processed as desired, for example by data reduction.

FIG. 1.2 depicts a drilling operation being performed by a drilling tool 106.2 suspended by a rig 128 and advanced into the subsurface formations 102 to form a wellbore 136 or other channel. A mud pit 130 may be used to draw drilling mud into the drilling tools via flow line 132 for circulating drilling mud through the drilling tools, up the wellbore 136 and back to the surface. The drilling mud may be filtered and returned to the mud pit. A circulating system may be used for storing, controlling, or filtering the flowing drilling muds. In this illustration, the drilling tools are advanced into the subsurface formations to reach reservoir 104. Each well may target one or more reservoirs. The drilling tools may be adapted for measuring downhole properties using logging while drilling tools. The logging while drilling tool may also be adapted for taking a core sample 133 as shown, or removed so that a core sample may be taken using another tool.

A surface unit 134 may be used to communicate with the drilling tools and/or offsite operations. The surface unit may communicate with the drilling tools to send commands to the drilling tools, and to receive data therefrom. The surface unit may be provided with computer facilities for receiving, storing, processing, and/or analyzing data from the operation. The surface unit may collect data generated during the drilling operation and produce data output 135 which may be stored or transmitted. Computer facilities, such as those of the surface unit, may be positioned at various locations about the wellsite and/or at remote locations.

Sensors (S), such as gauges, may be positioned about the oilfield to collect data relating to various operations as described previously. As shown, the sensor (S) may be positioned in one or more locations in the drilling tools and/or at the rig to measure drilling parameters, such as weight on bit, torque on bit, pressures, temperatures, flow rates, compositions, rotary speed and/or other parameters of the operation. Sensors (S) may also be positioned in one or more locations in the circulating system.

The data gathered by the sensors may be collected by the surface unit and/or other data collection sources for analysis or other processing. The data collected by the sensors may be used alone or in combination with other data. The data may be collected in one or more databases and/or transmitted on or offsite. All or select portions of the data may be selectively used for analyzing and/or predicting operations of the current and/or other wellbores. The data may be historical data, real time data or combinations thereof. The real time data may be used in real time, or stored for later use. The data may also be combined with historical data or other inputs for further analysis. The data may be stored in separate databases, or combined into a single database.

The collected data may be used to perform analysis, such as modeling operations. For example, the seismic data output may be used to perform geological, geophysical, and/or reservoir engineering analysis. The reservoir, wellbore, surface, and/or processed data may be used to perform reservoir, wellbore, geological, and geophysical or other simulations. The data outputs from the operation may be generated directly from the sensors, or after some preprocessing or modeling. These data outputs may act as inputs for further analysis.

The data may be collected and stored at the surface unit 134. One or more surface units may be located at the wellsite, or connected remotely thereto. The surface unit may be a single unit, or a complex network of units used to perform the necessary data management functions throughout the oilfield. The surface unit may be a manual or automatic system. The surface unit 134 may be operated and/or adjusted by a user.

The surface unit may be provided with a transceiver 137 to allow communications between the surface unit and various portions of the current oilfield or other locations. The surface unit 134 may also be provided with, or functionally connected to, one or more controllers for actuating mechanisms at the wellsite 100. The surface unit 134 may then send command signals to the oilfield in response to data received. The surface unit 134 may receive commands via the transceiver or may itself execute commands to the controller. A processor may be provided to analyze the data (locally or remotely), make the decisions, and/or actuate the controller. In this manner, operations may be selectively adjusted based on the data collected. Portions of the operation, such as controlling drilling, weight on bit, pump rates or other parameters, may be optimized based on the information. These adjustments may be made automatically based on computer protocol, and/or manually by an operator. In some cases, well plans may be adjusted to select optimum operating conditions, or to avoid problems.

FIG. 1.3 depicts a wireline operation being performed by a wireline tool 106.3 suspended by the rig 128 and into the wellbore 136 of FIG. 1.2. The wireline tool 106.3 may be adapted for deployment into a wellbore 136 for generating well logs, performing downhole tests and/or collecting samples. The wireline tool 106.3 may be used to provide another method and apparatus for performing a seismic survey operation. The wireline tool 106.3 of FIG. 1.3 may, for example, have an explosive, radioactive, electrical, or acoustic energy source 144 that sends and/or receives electrical signals to the surrounding subsurface formations 102 and fluids therein.

The wireline tool 106.3 may be operatively connected to, for example, the geophones 118 and the computer 122.1 of the seismic truck 106.1 of FIG. 1.1. The wireline tool 106.3 may also provide data to the surface unit 134. The surface unit 134 may collect data generated during the wireline operation and produce data output 135 which may be stored or transmitted. The wireline tool 106.3 may be positioned at various depths in the wellbore to provide a survey or other information relating to the subsurface formation.

Sensors (S), such as gauges, may be positioned about the wellsite 100 to collect data relating to various operations as described previously. As shown, the sensor (S) is positioned in the wireline tool 106.3 to measure downhole parameters which relate to, for example, porosity, permeability, fluid composition, and/or other parameters of the operation.

FIG. 1.4 depicts a production operation being performed by a production tool 106.4 deployed from a production unit or Christmas tree 129 and into the completed wellbore 136 of FIG. 1.3 for drawing fluid from the downhole reservoirs into surface facilities 142. Fluid flows from reservoir 104 through perforations in the casing (not shown) and into the production tool 106.4 in the wellbore 136 and to the surface facilities 142 via a gathering network 146.

Sensors (S), such as gauges, may be positioned about the oilfield to collect data relating to various operations as described previously. As shown, the sensor (S) may be positioned in the production tool 106.4 or associated equipment, such as the Christmas tree 129, gathering network, surface facilities, and/or the production facility, to measure fluid parameters, such as fluid composition, flow rates, pressures, temperatures, and/or other parameters of the production operation.

While simplified wellsite configurations are shown, it will be appreciated that the oilfield or wellsite 100 may cover a portion of land, sea and/or water locations that hosts one or more wellsites. Production may also include injection wells (not shown) for added recovery or for storage of hydrocarbons, carbon dioxide, or water, for example. One or more gathering facilities may be operatively connected to one or more of the wellsites for selectively collecting downhole fluids from the wellsite(s).

It should be appreciated that FIGS. 1.2-1.4 depict tools that can be used to measure not just properties of an oilfield, but also properties of non-oilfield operations, such as mines, aquifers, storage, and other subsurface facilities. Also, while certain data acquisition tools are depicted, it will be appreciated that various measurement tools (e.g., wireline, measurement while drilling (MWD), logging while drilling (LWD), core sample, etc.) capable of sensing parameters, such as seismic two-way travel time, density, resistivity, production rate, etc., of the subsurface formation and/or its geological formations may be used. Various sensors (S) may be located at various positions along the wellbore and/or the monitoring tools to collect and/or monitor the desired data. Other sources of data may also be provided from offsite locations.

The oilfield configuration of FIGS. 1.1-1.4 depict examples of a wellsite 100 and various operations usable with the techniques provided herein. Part, or all, of the oilfield may be on land, water and/or sea. Also, while a single oilfield measured at a single location is depicted, reservoir engineering may be utilized with any combination of one or more oilfields, one or more processing facilities, and one or more wellsites.

FIGS. 2.1-2.4 are graphical depictions of examples of data collected by the tools of FIGS. 1.1-1.4, respectively. FIG. 2.1 depicts a seismic trace 202 of the subsurface formation of FIG. 1.1 taken by seismic truck 106.1. The seismic trace may be used to provide data, such as a two-way response over a period of time. FIG. 2.2 depicts a core sample 133 taken by the drilling tools 106.2. The core sample may be used to provide data, such as a graph of the density, porosity, permeability or other physical property of the core sample over the length of the core. Tests for density and viscosity may be performed on the fluids in the core at varying pressures and temperatures. FIG. 2.3 depicts a well log 204 of the subsurface formation of FIG. 1.3 taken by the wireline tool 106.3. The wireline log may provide a resistivity or other measurement of the formation at various depts. FIG. 2.4 depicts a production decline curve or graph 206 of fluid flowing through the subsurface formation of FIG. 1.4 measured at the surface facilities 142. The production decline curve may provide the production rate Q as a function of time t.

The respective graphs of FIGS. 2.1, 2.3, and 2.4 depict examples of static measurements that may describe or provide information about the physical characteristics of the formation and reservoirs contained therein. These measurements may be analyzed to define properties of the formation(s), to determine the accuracy of the measurements and/or to check for errors. The plots of each of the respective measurements may be aligned and scaled for comparison and verification of the properties.

FIG. 2.4 depicts an example of a dynamic measurement of the fluid properties through the wellbore. As the fluid flows through the wellbore, measurements are taken of fluid properties, such as flow rates, pressures, composition, etc. As described below, the static and dynamic measurements may be analyzed and used to generate models of the subsurface formation to determine characteristics thereof. Similar measurements may also be used to measure changes in formation aspects over time.

Fracture Operations

In one aspect, these techniques employ a model for characterizing a hydraulic fracture network as described below. Such a model includes a set of equations that quantify the complex physical process of fracture propagation in a formation driven by fluid injected through a wellbore. In one embodiment, these equations are posed in terms of 12 model parameters: wellbore radius $x_w$ and wellbore net pressure pw−σc, fluid injection rate q and duration $t_p$, matrix plane strain modulus E, fluid viscosity μ (or other fluid flow parameter(s) for non-Newtonian fluids), confining stress contrast Δσ, fracture network sizes h, a, e, and fracture spacing dx and dy.

Various fracture networks as used herein may have natural and/or man-made fractures. To facilitate production from a wellbore, the wellbore may be stimulated by performing fracture operations. For example, a hydraulic fracture network can be produced by pumping fluid into a formation. A hydraulic fracture network can be represented by two perpendicular sets of parallel planar fractures. The fractures parallel to the x-axis may be equally separated by distance dy and those parallel to the y-axis are separated by distance dx as illustrated in FIG. 3. Consequently, the numbers of fractures, per unit length, parallel to the x-axis and the y-axis, respectively, are $$n_x = \frac{1}{d_y} \text{ and } n_y = \frac{1}{d_x}. \tag{1}$$

The pumping of fracturing fluid over time produces a propagating fracture network that can be represented by an expanding volume in the form of an ellipse (FIG. 3) subject to stress $\sigma_{min}$ with height h, major axis a, minor axis b or aspect ratio e:

$$e = \frac{b}{a}. \tag{2}$$

The governing equation for mass conservation of the injected fluid in the fractured subterranean formation is given by:

$$2\pi ex\frac{\partial(\phi\rho)}{\partial t} + 4\frac{\partial(Bx\rho\bar{v}_e)}{\partial x} = 0, \tag{3a}$$

or $$\frac{2\pi y}{e}\frac{\partial(\phi p)}{\partial t} + 4\frac{\partial}{\partial y}\left(\frac{By\rho\bar{v}_e}{e}\right) = 0, \tag{3b}$$

which for an incompressible fluid becomes respectively $$2\pi ex\frac{\partial\phi}{\partial t} + 4\frac{\partial(Bx\bar{v}_e)}{\partial x} = 0, \tag{3c}$$

or $$\frac{2\pi y}{e}\frac{\partial\phi}{\partial t} + 4\frac{\partial}{\partial y}\left(\frac{By\bar{v}_e}{e}\right) = 0, \tag{3d}$$

where ϕ is the porosity of the formation,

ρ is the density of injected fluid $\bar{v}_e$ is an average fluid velocity perpendicular to the elliptic boundary, and B is the elliptical integral given by $$B = \frac{\pi}{2}\left[1 - \left(\frac{1}{2}\right)^2(1-e^2) - \left(\frac{1\cdot 3}{2\cdot 4}\right)^2\frac{(1-e^2)^2}{3} - \left(\frac{1\cdot 3\cdot 5}{2\cdot 4\cdot 6}\right)^2\frac{(1-e^2)^3}{5} - \dots\right] \tag{4}$$

The average fluid velocity $\bar{v}_e$ may be approximated as $$\begin{aligned}\bar{v}_e &\approx \frac{1}{2}[v_{ex}(x, y=0) + v_{ey}(x=0, y=ex)] \\ &\approx \frac{1}{2}(1+e)v_{ex}(x, y=0) \\ &\approx \frac{1}{2}(1+1/e)v_{ey}(x=0, y=ex)\end{aligned} \tag{5}$$

with $$v_{ex}(x, y=0) = -\left[\frac{k_x}{\mu}\frac{\partial p}{\partial x}\right]_{(x,y=0)}, \tag{6a}$$

$$v_{ey}(x=0, y=ex) = -\left[\frac{k_y}{\mu}\frac{\partial p}{\partial y}\right]_{(x=0,y=ex)}, \tag{6b}$$

where p is fluid pressure,

μ is fluid viscosity, and $k_x$ and $k_y$ are permeability factors for the formation along the x-direction and the y-direction, respectively.

For the sake of mathematical simplicity, equations below are presented for an incompressible fluid as an example, with the understanding that fluid compressibility may be accounted for by using a corresponding equation of state for the injected fluid.

Using equations (5) and (6), governing equations (3a,3b) can be written as $$2\pi ex\frac{\partial\phi}{\partial t}-2\frac{\partial}{\partial x}\left(\frac{B(1+e)xk_x}{\mu}\frac{\partial p}{\partial x}\right)=0, \tag{7a}$$

or $$\frac{2\pi y}{e}\frac{\partial\phi}{\partial t}-2\frac{\partial}{\partial y}\left(\frac{B(1+e)yk_y}{e^2\mu}\frac{\partial p}{\partial y}\right)=0. \tag{7b}$$

The width w of a hydraulic fracture may be calculated as $$w=\frac{2l}{E}(p-\sigma_c)H(p-\sigma_c), \tag{8}$$

$$H(p-\sigma_c)=\begin{cases}0 & p\le\sigma_c\\ 1 & p>\sigma_c\end{cases}$$

where H is the Heaviside step function, $\sigma_c$ is the confining stress perpendicular to the fracture, E is the plane strain modulus of the formation, and l is the characteristic length scale of the fracture segment and given by the expression $$l=d+(h-d)H(d-h) \tag{9}$$

where h and d are the height and the length, respectively, of the fracture segment.

When mechanical interaction between adjacent fractures is accounted for, assuming that the size of stimulated formation is much larger than either the height of the ellipse or the averaged length of fractures, the width of fractures parallel to the x-axis and the y-axis, respectively, can be expressed as $$w_x=\frac{2d_x}{A_{Ex}E}(p-\sigma_{cy})H(p-\sigma_{cy}), \tag{10a}$$

$$w_y=\frac{2d_y}{A_{Ey}E}(p-\sigma_{cx})H(p-\sigma_{cx}) \tag{10b}$$

where $\sigma_{cx}$ and $\sigma_{cy}$ are the confining stresses, respectively, along the x-direction and the y-direction, respectively, and $A_{Ex}$ and $A_{Ey}$ are the coefficients for defining the effective plane strain modulus along the x-axis and y-axis, respectively.

represented by the following expressions $$A_{Ex}=\frac{d_x[2l_x+(d_y-2l_x)H(d_y-2l_x)]}{d_yl_x}, \tag{11a}$$

$$A_{Ey}=\frac{d_y[2l_y+(d_x-2l_y)H(d_x-2l_y)]}{d_xl_y}. \tag{11b}$$

where $l_x$ and $l_y$ are the characteristic length scale along the x-axis and the y-axis, respectively.

The value of the coefficient ($A_{Ex}$) for the effective plane strain modulus along the x-axis can be simplified for different cases of $d_x$, $d_y$, and h by any one of Tables 1-2 listed below. The value of the coefficient ($A_{Ey}$) for the effective plane strain modulus along the y-axis can be simplified for different cases of $d_x$, $d_y$, and h by any one of Tables 3-5 listed below.

TABLE 1

Coefficient $A_{Ex}$ for different cases of $d_x$, $d_y$, h

| $A_{Ex}$ | | | | | | |
|---|---|---|---|---|---|---|
| $d_x \ge d_y$ | | | $d_x < d_y$ | | | |
| | $d_x > h$ | | $d_x \le h$ | | $d_x > h$ | |
| $d_x \le h$ | $d_y \le 2h$ | $d_y > 2h$ | $d_y \le 2d_x$ | $d_y > 2d_x$ | $d_y \le 2h$ | $d_y > 2h$ |
| $\frac{2d_x}{d_y}$ | $\frac{2d_x}{d_y}$ | $\frac{d_x}{h}$ | $\frac{2d_x}{d_y}$ | 1 | $\frac{2d_x}{d_y}$ | $\frac{d_x}{h}$ |

TABLE 2

Coefficient $A_{Ex}$ for different cases of $d_x$, $d_y$, h

| $A_{Ex}$ | | | | | | |
|---|---|---|---|---|---|---|
| $d_x \ge d_y$ | | | $d_x < d_y$ | | | |
| | $d_x > h$ | | $d_y \le h$ | | $d_y > h$ | |
| $d_x \le h$ | $d_y \le 2h$ | $d_y > 2h$ | $d_y \le 2d_x$ | $d_y > 2d_x$ | $d_y \le 2h$ | $d_y > 2h$ |
| $\frac{2d_x}{d_y}$ | $\frac{2d_x}{d_y}$ | $\frac{d_x}{h}$ | $\frac{2d_x}{d_y}$ | 1 | $\frac{2d_x}{d_y}$ | $\frac{d_x}{h}$ |

TABLE 3

Coefficient $A_{Ey}$ for different cases of $d_x$, $d_y$, h

| $A_{Ey}$ | | | | | | |
|---|---|---|---|---|---|---|
| $d_y \ge d_x$ | | | $d_y < d_x$ | | | |
| | $d_y > h$ | | $d_y \le h$ | | $d_y > h$ | |
| $d_y \le h$ | $d_x \le 2h$ | $d_x > 2h$ | $d_x \le 2d_y$ | $d_x > 2d_y$ | $d_x \le 2h$ | $d_x > 2h$ |
| $\frac{2d_y}{d_x}$ | $\frac{2d_y}{d_x}$ | $\frac{d_y}{h}$ | $\frac{2d_y}{d_x}$ | 1 | $\frac{2d_y}{d_x}$ | $\frac{d_y}{h}$ |

TABLE 4a

Coefficient $A_{Ey}$ for different cases of $d_x$, $d_y$, h

| $A_{Ey}$ | | | | | |
|---|---|---|---|---|---|
| $d_x \ge d_y$ | | | | | |
| | | $d_x > h$ | | | |
| $d_x \le h$ | | $d_y \le h$ | | $d_y > h$ | |
| $d_x \le 2d_y$ | $d_x > 2d_y$ | $d_x \le 2d_y$ | $d_x > 2d_y$ | $d_x \le 2h$ | $d_x > 2h$ |
| $\frac{2d_y}{d_x}$ | 1 | $\frac{2d_y}{d_x}$ | 1 | $\frac{2d_y}{d_x}$ | $\frac{d_y}{h}$ |

TABLE 4b

| Coefficient $A_{Ey}$ for different cases of $d_x$, $d_y$, h | | | | | |
|---|---|---|---|---|---|
| $A_{Ey}$ | | | | | |
| $d_x < d_y$ | | | | | |
| $d_x \le h$ | | | | | |
| $d_y \le h$ | | $d_y > h$ | | $d_x > h$ | |
| $d_x \le 2d_y$ | $d_x > 2d_y$ | $d_x \le 2h$ | $d_x > 2h$ | $d_x \le 2h$ | $d_x > 2h$ |
| $\frac{2d_y}{d_x}$ | 1 | $\frac{2d_y}{d_x}$ | $\frac{d_y}{h}$ | $\frac{2d_y}{d_x}$ | $\frac{d_y}{h}$ |

TABLE 5

| Coefficient $A_{Ey}$ for different cases of $d_x$, $d_y$, h | | | | | | | | |
|---|---|---|---|---|---|---|---|---|
| $A_{Ey}$ | | | | | | | | |
| $d_x \ge d_y$ | | | | | | | | |
| | | $d_x > h$ | | | | $d_x < d_y$ | | |
| $d_x \le h$ | | $d_y \le h$ | | $d_y > h$ | | | $d_x > h$ | |
| $d_x \le 2d_y$ | $d_x > 2d_y$ | $d_x \le 2d_y$ | $d_x > 2d_y$ | $d_x \le 2h$ | $d_x > 2h$ | $d_x \le h$ | $d_x \le 2h$ | $d_x > 2h$ |
| $\frac{2d_y}{d_x}$ | 1 | $\frac{2d_y}{d_x}$ | 1 | $\frac{2d_y}{d_x}$ | $\frac{d_y}{h}$ | $\frac{2d_y}{d_x}$ | $\frac{2d_y}{d_x}$ | $\frac{d_y}{h}$ |

The increase in porosity of the fractured formation ($\Delta\phi$) can be calculated as $$\Delta\phi = n_x w_x + n_y w_y - n_x n_y w_x w_y \approx \frac{2d_x}{d_y A_{Ex} E}(p-\sigma_{cy})H(p-\sigma_{cy}) + \frac{2d_y}{d_x A_{Ey} E}(p-\sigma_{cx})H(p-\sigma_{cx}) \tag{12}$$

The fracture permeability along the x-axis ($k_x$) and the fracture permeability along the y-axis ($k_y$) can be determined as $$k_x = \frac{n_x w_x^3}{12} = \frac{2d_x^3}{3E^3 d_y A_{Ex}^3}(p-\sigma_{cy})^3 H(p-\sigma_{cy}), \tag{13a}$$

and $$k_y = \frac{n_y w_y^3}{12} = \frac{2d_y^3}{3E^3 d_x A_{Ey}^3}(p-\sigma_{cx})^3 H(p-\sigma_{cx}), \tag{13b}$$

along the x-axis and y-axis, respectively.

For $p>\sigma_{cy}$ and a negligible virgin formation permeability as compared to the fracture permeability along the x-axis, the governing equation (7a) can be integrated from $x_w$ to x using equation (13a) for the permeability ($k_x$) to yield $$4(p-\sigma_{cy})^3 \frac{dp}{dx} = \frac{3A_{Ex}^3 d_y E^3 \mu}{(1+e)Bd_x^3 x}\left(2\pi\int_{x_w}^{x}\frac{\partial\phi}{\partial t}es\,ds - q\right). \tag{14a}$$

Similarly for $p>\sigma_{cx}$, the governing equation (7b) can be integrated from $x_w$ to y using equation (12b) for the permeability ($k_y$) to yield $$4(p-\sigma_{cx})^3 \frac{dp}{dy} = \frac{3e^2 A_{Ey}^3 d_x E^3 \mu}{(1+e)Bd_y^3 y}\left(2\pi\int_{x_w}^{y}\frac{\partial\phi}{\partial t}\frac{s}{e}\,ds - q\right). \tag{14b}$$

In equations (13a) and (13b), $x_w$ is the radius of the wellbore and q is the rate of fluid injection into the formation via the wellbore. The inject rate q is treated as a constant and quantified in volume per unit time per unit length of the wellbore.

Equation (14a) can be integrated from x to a and yields a solution for the net pressure inside the fracture along the x-axis as $$p-\sigma_{cy} = \left[\frac{3}{(1+e)B}\int_x^a \frac{A_{Ex}^3 d_y E^3 \mu}{d_x^3 r}\left(q - 2\pi\int_{x_w}^{r}\frac{\partial\phi}{\partial t}es\,ds\right)dr\right]^{1/4}. \tag{15a}$$

Equation (14b) can be integrated from y to b yields a solution for the net pressure inside the fractures along the y-axis as $$p-\sigma_{cx} = \left[\frac{3e^2}{(1+e)B}\int_y^b \frac{A_{Ey}^3 d_x E^3 \mu}{d_y^3 r}\left(q - 2\pi\int_{x_w}^{r}\frac{\partial\phi}{\partial t}\frac{s}{e}\,ds\right)dr\right]^{1/4}. \tag{15b}$$

For uniform $\sigma_c$, E, $\mu$, n and d, equation (15a) reduces to $$p-\sigma_{cy} = A_{px}\left[q\ln\left(\frac{a}{x}\right) - 2\pi e\int_x^a\left(\int_{x_w}^{r}\frac{\partial\phi}{\partial t}s\,ds\right)\frac{1}{r}\,dr\right]^{1/4} \tag{16a}$$

$$A_{px} = \left(\frac{3A_{Ex}^3 d_y E^3 \mu}{(1+e)Bd_x^3}\right)^{1/4}.$$

Similarly, equation (15b) reduces to $$p-\sigma_{cx} = e^{1/2}A_{py}\left[q\ln\left(\frac{b}{y}\right) - \frac{2\pi}{e}\int_y^b\left(\int_{x_w}^{r}\frac{\partial\phi}{\partial t}s\,ds\right)\frac{1}{r}\,dr\right]^{1/4} \tag{16b}$$

$$A_{py} = \left(\frac{3A_{Ey}^3 d_x E^3 \mu}{(1+e)Bd_y^3}\right)^{1/4}.$$

The wellbore pressure $P_w$ is given by the following expressions:

$$p_w = \sigma_{cy} + A_{px}\left[q\ln\left(\frac{a}{x_w}\right) - 2\pi e\int_{x_w}^a\left(\int_{x_w}^{r}\frac{\partial\phi}{\partial t}s\,ds\right)\frac{1}{r}\,dr\right]^{1/4}, \tag{17a}$$

$$p_w = \sigma_{cx} + e^{1/2}A_{py}\left[q\ln\left(\frac{b}{x_w}\right) - \frac{2\pi}{e}\int_{x_w}^b\left(\int_{x_w}^{r}\frac{\partial\phi}{\partial t}s\,ds\right)\frac{1}{r}\,dr\right]^{1/4}. \tag{17b}$$

By requiring the two expressions (17a, 17b) for the wellbore pressure $p_w$, to be equal, one obtains the difference between confining stresses ($\Delta\sigma_c$), which is also referred herein to as stress contrast $\Delta\sigma_c$, as $$\Delta\sigma_c = \sigma_{cx} - \sigma_{cy} \tag{18}$$
$$= A_{px}\left[q\ln\left(\frac{a}{x_w}\right) - 2\pi e\int_{x_w}^{a}\left(\int_{x_w}^{r}\frac{\partial\phi}{\partial t}s\,ds\right)\frac{1}{r}\,dr\right]^{1/4} - e^{1/2}A_{py}\left[q\ln\left(\frac{ea}{x_w}\right) - \frac{2\pi}{e}\int_{x_w}^{ea}\left(\int_{x_w}^{r}\frac{\partial\phi}{\partial t}s\,ds\right)\frac{1}{r}\,dr\right]^{1/4}.$$

Assuming negligible leakoff and incompressible fluid, the time $t_p$ for the ellipse edge propagating from $x_w$ to a along the x-axis and $x_w$ to b along the y-axis is determined as $$\frac{qt_p}{\pi} = e\int_{x_w}^{a}\Delta\phi_x x\,dx + \frac{1}{e}\int_{x_w}^{b}\Delta\phi_y y\,dy \tag{19a}$$
$$= e\int_{x_w}^{a}\frac{2d_x(p_x-\sigma_{cy})}{d_yA_{Ex}E}x\,dx + e\int_{x_w}^{x_\sigma}\frac{2d_y(p_x-\sigma_{cx})}{d_xA_{Ey}E}x\,dx + \frac{1}{e}\int_{x_\sigma}^{b}\left[\frac{2d_x(p_y-\sigma_{cy})}{d_yA_{Ex}E} + \frac{2d_y(p_y-\sigma_{cx})}{d_xA_{Ey}E}\right]y\,dy,$$

or $$\frac{qt_p}{\pi e} = \int_{x_w}^{a}[\Delta\phi_x(x) + \Delta\phi_y(y=ex)]x\,dx \tag{19b}$$
$$= \frac{2}{E}\left[\int_{x_w}^{x_\sigma}\left(\frac{d_x}{d_yA_{Ex}} + \frac{d_y}{d_xA_{Ey}}\right)(p_x-\sigma_{cy})x\,dx + \int_{x_\sigma}^{a}\frac{d_x}{d_yA_{Ex}}(p_x-\sigma_{cy})x\,dx\right] + \frac{2}{E}\int_{x_w}^{a}\left(\frac{d_x}{d_yA_{Ex}} + \frac{d_y}{d_xA_{Ey}}\right)(p_x-\sigma_{cx})x\,dx + \frac{2\Delta\sigma_c}{E}\left(\int_{x_w}^{a}\frac{d_x}{d_yA_{Ex}}x\,dx - \int_{x_w}^{x_\sigma}\frac{d_y}{d_xA_{Ey}}x\,dx\right),$$

where $x_\sigma$ is defined as $x_w \le x\sigma < a$ where $p \le \sigma_{cx}$ if $x \le x_\sigma$ $p > \sigma_{cx}$ if $x > x_\sigma$ $p = \sigma_{cx}$ if $x = x_\sigma$ Equation (15a) can be rewritten for the case $p=\sigma_{cx}$ at $x=x_\sigma$ as follows $$\Delta\sigma_c = \left[\frac{3}{(1+e)B}\int_{x_\sigma}^{a}\frac{A_{Ex}^3d_yE^3\mu}{d_x^3r}\left(q - 2\pi\int_{x_w}^{r}\frac{\partial\phi}{\partial t}es\,ds\right)dr\right]^{1/4}. \tag{20}$$

The surface area of the open fractures may be calculated as follows $$S \approx \pi ab\times 2hn_x + \pi x_\sigma b\times 2hn_y, \tag{21}$$
$$= 2\pi eah\left(\frac{a}{d_y} + \frac{x_\sigma}{d_x}\right).$$

For a quasi-steady state, governing equations (7a) and (7b) reduce to $$-2B(1+e)\frac{xk_x}{\mu}\frac{dp}{dx} = q, \tag{22a}$$

$$-\frac{2B(1+e)}{e^2}\frac{yk_y}{\mu}\frac{dp}{dy} = q. \tag{22b}$$

Moreover, for the quasi-steady state, the pressure equations (15a) and (15b) reduce to $$p - \sigma_{cy} = \left[\frac{3}{(1+e)B}\int_{x}^{a}\frac{A_{Ex}^3d_yE^3q\mu}{d_x^3r}dr\right]^{1/4}, \tag{23a}$$

$$p - \sigma_{cx} = \left[\frac{3e^2}{(1+e)B}\int_{y}^{b}\frac{A_{Ey}^3d_xE^3q\mu}{d_y^3r}dr\right]^{1/4}. \tag{23b}$$

For the quasi-steady state and uniform properties of $\sigma_c$, E, ,μ, n and d, equations (16a) and (16b) reduce to $$p - \sigma_{cy} = A_{px}\left(q\ln\frac{a}{x}\right)^{1/4}, \tag{24a}$$

$$p - \sigma_{cx} = e^{1/2}A_{py}\left(q\ln\frac{b}{y}\right)^{1/4}. \tag{24b}$$

Correspondingly, for the quasi-steady state, the wellbore pressure equations (17a) and (17b) reduce to $$p_w = \sigma_{cy} + A_{px}\left(q\ln\frac{a}{x_w}\right)^{1/4}, \tag{25a}$$

$$p_w = \sigma_{cx} + e^{1/2}A_{py}\left(q\ln\frac{ea}{x_w}\right)^{1/4}, \tag{25b}$$

By requiring the two expressions (25a, 25b) for the wellbore pressure $p_w$ to be equal, one obtains $$\left[1 - e^{1/2}A_{ea}\frac{d_x}{d_y}\left(\frac{A_{Ey}}{A_{Ex}}\right)^{3/4}\right](p_w - \sigma_{cy}) = \Delta\sigma_c, \tag{26}$$
$$A_{ea} = \left[\frac{\ln(ea/x_w)}{\ln(a/x_w)}\right]^{1/4}.$$

For the quasi-steady state and uniform properties of $\sigma_c$, E, μ, n and d, equations (19a) and (19b), respectively, reduce to $$\frac{qt_p}{\pi} = \frac{eA_\phi d_y^{1/4}A_{Ex}^{3/4}}{d_x^{3/4}}\left[\left(\frac{d_x}{d_yA_{Ex}} + \frac{d_y}{d_xA_{Ey}}\right)\int_{x_w}^{x_\sigma}\left(\ln\frac{a}{x}\right)^{1/4}x\,dx + \frac{d_x}{d_yA_{Ex}}\int_{x\sigma}^{a}\left(\ln\frac{a}{x}\right)^{1/4}x\,dx\right] + \frac{A_\phi d_x^{1/4}A_{Ey}^{3/4}}{e^{1/2}d_y^{3/4}}\left(\frac{d_x}{d_yA_{Ex}} + \frac{d_y}{d_xA_{Ey}}\right)\int_{x_w}^{b}\left(\ln\frac{b}{y}\right)^{1/4}y\,dy + \frac{\Delta\sigma_c}{E}\left[\frac{d_x}{ed_yA_{Ex}}(b^2 - x_w^2) - \frac{ed_y}{d_xA_{Ey}}(x_\sigma^2 - x_w^2)\right], \tag{27a}$$
$$A_\phi = \left[\frac{48}{(1+e)BE}\right]^{1/4},$$

and

-continued $$\frac{qt_p}{\pi e} = A_\phi\left(\frac{d_y A_{Ex}^3}{d_x^3}\right)^{1/4}\left[\left(\frac{d_x}{d_y A_{Ex}} + \frac{d_y}{d_x A_{Ey}}\right)\int_{x_w}^{x_\sigma}\left(\ln\frac{a}{x}\right)^{1/4} x\,dx + \frac{d_x}{d_y A_{Ex}}\int_{x_\sigma}^{a}\left(\ln\frac{a}{x}\right)^{1/4} x\,dx\right] + e^{1/2}A_\phi\left(\frac{d_x A_{Ey}^3}{d_y^3}\right)^{1/4}\left(\frac{d_x}{d_y A_{Ex}} + \frac{d_y}{d_x A_{Ey}}\right)\int_{x_w}^{a}\left(\ln\frac{a}{x}\right)^{1/4} x\,dx + \frac{\Delta\sigma_c}{E}\left[\frac{d_x}{d_y A_{Ex}}(a^2 - x_w^2) - \frac{d_y}{d_x A_{Ey}}(x_\sigma^2 - x_w^2)\right], \tag{27b}$$

$$A_\phi = \left[\frac{48q\mu}{(1+e)BE}\right]^{1/4}.$$

Correspondingly, equation (20) can be solved to yield $$x_\sigma = a\exp\left[-\frac{1}{q}\left(\frac{\Delta\sigma_c}{A_{px}}\right)^4\right]. \tag{28}$$

The integrations in equation (27) can be numerically evaluated rather easily for a given $x_\sigma$.

1. Constraints on the Parameters of the Model Using Field Data

In general, given the rest of the equations, equations (25a), (26) and (27) can be solved to obtain any three of the model parameters. Certain geometric and geomechanical parameters of the model as described above can be constrained using field data from a fracturing treatment and associated microseismic events. In one embodiment, the geometric properties (dx and dy) and the stress contrast ($\Delta\sigma_c$) are constrained given wellbore radius xw and wellbore net pressure pw−σc, fluid injection rate q and duration tp, matrix plane strain modulus E, fluid viscosity μ, and fracture network sizes h, a, e, as follows. Note that since xσ in equation (27) is calculated using equation (28) as a function of $\Delta\sigma_c$, the solution procedure is necessarily of an iterative nature.

Given these values, the value of $d_x^3/(A_{Ex}^3, d_y)$ is determined according to equation (25a) by $$\frac{d_x^3}{A_{Ex}^3 d_y} = d_0^2 \tag{29}$$

$$d_0 = \left[\frac{3E^3 q\mu\ln(a/x_w)}{(p_w - \sigma_{cy})^4(1+e)B}\right]^{1/2},$$

If ($2d_y \geq d_x \geq d_y$) and ($d_x \leq h$), equation (29) leads to $$d_y = \sqrt{8}\,d_0. \tag{30}$$

Equations (26) and (27) become, respectively, $$\left[1 - A_{ea}\left(\frac{ed_y}{d_x}\right)^{1/2}\right](p_w - \sigma_{cy}) = \Delta\sigma_c, \tag{31}$$

and $$\frac{qt_a}{\pi} = \frac{eA_\phi}{2^{1/4}d_y^{1/2}}\left[2\int_{x_w}^{x_\sigma}\left(\ln\frac{a}{x}\right)^{1/4} x\,dx + \int_{x_\sigma}^{a}\left(\ln\frac{a}{x}\right)^{1/4} x\,dx\right] + \frac{2^{3/4}A_\phi}{e^{1/2}d_x^{1/2}}\int_{x_w}^{b}\left(\ln\frac{b}{y}\right)^{1/4} y\,dy + \frac{\Delta\sigma_c}{2E}\left[\frac{b^2 - x_w^2}{e} - e(x_\sigma^2 - x_w^2)\right]. \tag{32}$$

Using solution (30), equations (31) and (32) can be solved to obtain $$\Delta\sigma_c = \left\{\frac{qt_a}{\pi} - \frac{eA_\phi}{2^{1/4}d_y^{1/2}}\left[2\int_{x_w}^{x_\sigma}\left(\ln\frac{a}{x}\right)^{1/4} x\,dx + \int_{x_\sigma}^{a}\left(\ln\frac{a}{x}\right)^{1/4} x\,dx\right] - \frac{2^{3/4}A_\phi}{e^{1/2}d_x^{1/2}}\int_{x_w}^{b}\left(\ln\frac{b}{y}\right)^{1/4} y\,dy\right\}\frac{2eE}{b^2 - x_w^2 - e^2(x_\sigma^2 - x_w^2)}, \tag{33}$$

and $$d_x = \sqrt{8}\,d_0 e A_{ea}^2\left(\frac{p_w - \sigma_{cy}}{p_w - \sigma_{cy} - \Delta\sigma_c}\right)^2. \tag{34}$$

If ($h \geq d_x > 2d_y$), equations (26) and (27) become, respectively, $$\left[1 - \frac{e^{1/2}}{2^{3/4}}A_{ea}\left(\frac{d_x}{d_y}\right)^{1/4}\right](p_w - \sigma_{cy}) = \Delta\sigma_c, \tag{35}$$

and $$\frac{qt_a}{\pi} = \frac{2^{3/4}eA_\phi}{d_y^{1/2}}\left[\left(\frac{1}{2} + \frac{d_y}{d_x}\right)\int_{x_w}^{x_\sigma}\left(\ln\frac{a}{x}\right)^{1/4} x\,dx + \frac{1}{2}\int_{x_\sigma}^{a}\left(\ln\frac{a}{x}\right)^{1/4} x\,dx\right] + \frac{A_\phi d_x^{1/4}}{e^{1/2}d_y^{3/4}}\left(\frac{1}{2} + \frac{d_y}{d_x}\right)\int_{x_w}^{b}\left(\ln\frac{b}{y}\right)^{1/4} y\,dy + \frac{\Delta\sigma_c}{E}\left[\frac{1}{2e}(b^2 - x_w^2) - \frac{ed_y}{d_x}(x_\sigma^2 - x_w^2)\right]. \tag{36}$$

Combined with solution (30) and replacing $\Delta\sigma_c$ with equation (35), equation (36) can be solved for $d_x$, $\Delta\sigma_c$ can then be calculated using equation (35).

If ($d_x > h \geq d_y$), equation (29) leads to solution (30). Furthermore, if ($d_x \leq 2d_y$), equations (26) and (27) lead to solutions (33) and (34). On the other hand, if ($d_x > 2d_y$), equations (26) and (27) lead to equations (35) and (36).

If ($d_x \geq d_y$) and ($h < d_y \leq 2h$), equation (29) leads to solution (30). Furthermore, if ($d_x \leq 2h$), equations (26) and (27) lead to solutions (33) and (34). On the other hand, if ($d_x > 2h$), equations (26) and (27) become, respectively, $$\left[1 - A_{ea}\left(\frac{8e^2 d_0^2 d_x}{h^3}\right)^4\right](p_w - \sigma_{cy}) = \Delta\sigma_c, \tag{37}$$

and $$\frac{qt_a}{2\pi e} = \frac{A_\phi}{2d_0^{1/2}}\left[\left(1 + \frac{2h}{d_x}\right)\int_{x_w}^{x_\sigma}\left(\ln\frac{a}{x}\right)^{1/4} x\,dx + \int_{x_\sigma}^{a}\left(\ln\frac{a}{x}\right)^{1/4} x\,dx\right] - \frac{h(x_\sigma^2 - x_w^2)(p_w - \sigma_{cy})}{Ed_x}\left[1 - \left(\frac{8e^2 d_0^2 d_x}{h^3}\right)^4\right]. \tag{38}$$

Equation (38) can be solved for $d_x$ and then $\Delta\sigma_c$ can be calculated by equation (37).

If ($d_x \geq d_y > 2h$), equation (29) leads to $$d_y = \frac{h^3}{d_0^2}. \tag{39}$$

Equations (26) and (27) becomes, respectively, $$\left[1 - e^{1/2} A_{ea}\left(\frac{d_0^2 d_x}{h^3}\right)^{7/4}\right](p_w - \sigma_{cy}) = \Delta\sigma_c, \tag{40}$$

and $$\frac{qt_a}{2\pi e} = \frac{A_\phi d_0^{3/2}}{h^2}\left[\left(1 + \frac{h^3}{d_0^2 d_x}\right)\int_{x_w}^{x_\sigma}\left(\ln\frac{a}{x}\right)^{1/4} x\,dx + \int_{x_\sigma}^{a}\left(\ln\frac{a}{x}\right)^{1/4} x\,dx\right] - \frac{h(x_\sigma^2 - x_w^2)(p_w - \sigma_{cy})}{Ed_x}\left[1 - e^{1/2}\left(\frac{d_0^2 d_x}{h^3}\right)^{7/4}\right]. \tag{41}$$

Equation (41) can be solved for $d_x$ and then $\Delta\sigma_c$ can be calculated by equation (40).

If ($d_x < d_y \le 2d_x$) and ($d_x \le h$), equations (29), (26) and (27) lead to solutions (30), (33) and (34).

If ($d_y > 2d_x$) and ($d_x \le h$), equations (29), (26) and (27) become, respectively, $$d_x^3 = d_0^2 d_y, \tag{42}$$

$$\left[1 - 2^{3/4} A_{ea}\left(\frac{ed_0}{d_x}\right)^{1/2}\right](p_w - \sigma_{cy}) = \Delta\sigma_c, \tag{43}$$

and $$\frac{qt_a}{2\pi e} = \frac{A_\phi d_0^{3/2}}{d_x^2}\left[\left(1 + \frac{d_x^2}{2d_0^2}\right)\int_{x_w}^{x_\sigma}\left(\ln\frac{a}{x}\right)^{1/4} x\,dx + \int_{x_\sigma}^{a}\left(\ln\frac{a}{x}\right)^{1/4} x\,dx\right] - \frac{(x_\sigma^2 - x_w^2)\Delta\sigma_c}{2E}. \tag{44}$$

Equations (42), (43) and (44) can be solved for $d_x$, $d_y$ and $\Delta\sigma_c$.

If ($h < d_x < d_y \le 2h$), equation (29), (26) and (27) lead to solutions (30), (33) and (34).

If ($2h < d_x \le 2h < d_y$), equation (29) leads to solution (39). Equations (26) and (27) become, respectively:

$$\left[1 - 2^{3/4} e^{1/2} A_{ea}\left(\frac{d_0}{d_x}\right)^{1/2}\right](p_w - \sigma_{cy}) = \Delta\sigma_c \tag{45}$$

and $$\frac{qt_a}{2\pi e} = \frac{A_\phi d_0^{3/2}}{d_x^2}\left[\left(1 + \frac{h^2}{2d_0^2}\right)\int_{x_w}^{x_\sigma}\left(\ln\frac{a}{x}\right)^{1/4} x\,dx + \int_{x_\sigma}^{a}\left(\ln\frac{a}{x}\right)^{1/4} x\,dx\right] - \frac{2(x_\sigma^2 - x_w^2)\Delta\sigma_c}{E} \tag{46}$$

Equations (45) and (46) can be solved to obtain $$\Delta\sigma_c = \frac{E}{2(x_\sigma^2 - x_w^2)}\left\{\frac{A_\phi d_0^{3/2}}{h^2}\left[\left(1 + \frac{h^2}{2d_0^2}\right)\int_{x_w}^{x_\sigma}\left(\ln\frac{a}{x}\right)^{1/4} x\,dx + \int_{x_\sigma}^{a}\left(\ln\frac{a}{x}\right)^{1/4} x\,dx\right] - \frac{qt_a}{2\pi e}\right\} \tag{47}$$

and $$d_x = 2^{3/2} ed_0\left(\frac{p_w - \sigma_{cy}}{p_w - \sigma_{cy} - \Delta\sigma_c}\right)^2 \tag{48}$$

If ($2h < d_x < d_y$), equation (29) leads to solution (39) while equations (26) and (27) become equations (40) and (41), respectively.

In many circumstances, such as where the formation is shale, the fracture network may consist of a number of parallel equally-spaced planar fractures whose spacing d is usually smaller than fracture height h. In other cases, the opposite is true. Both can lead to significant simplifications. An example is presented below.

2. Simplification of Model for Parallel Equally-Spaced Planar Fractures Whose Spacing DX and DY are Smaller than Fracture Height H The assumption that fracture spacing d is usually smaller than fracture height h leads to $$l_x = d_x$$

$$l_y = d_y. \tag{49}$$

Consequently, equations (11a) and (11b) can be simplified as $$A_{Ex} = \frac{1}{d_y}[2d_x + (d_y - 2d_x)H(d_y - 2d_x)], \tag{50a}$$

$$A_{Ey} = \frac{1}{d_x}[2d_y + (d_x - 2d_y)H(d_y - 2d_y)]. \tag{50b}$$

Equations (50a) and (50b) can be used to simplify equations (10a) and (10b) as follows $$w_x = \frac{2d_x d_y (p - \sigma_{cy})H(p - \sigma_{cy})}{[2d_x + (d_y - 2d_x)H(d_y - 2d_x)]E}, \tag{51a}$$

$$w_y = \frac{2d_y d_x (p - \sigma_{cx})H(p - \sigma_{cx})}{[2d_y + (d_x - 2d_y)H(d_x - 2d_y)]E}. \tag{51b}$$

Equations (50a) and (50b) can also be used to simplify equation (12) as follows $$\Delta\phi = \frac{2d_x(p - \sigma_{cy})H(p - \sigma_{cy})}{[2d_x + (d_y - 2d_x)H(d_y - 2d_x)]E} + \frac{2d_y(p - \sigma_{cx})H(p - \sigma_{cx})}{[2d_y + (d_x - 2d_y)H(d_x - 2d_y)]E}. \tag{52}$$

Equations (50a) and (50b) can be used to simplify equations (13a) and (13b) as follows $$k_x = k_{x0} + \frac{2d_x^3 d_y^2}{3[2d_x + (d_y - 2d_x)H(d_y - 2d_x)]^3 E^3}(p - \sigma_{cy})^3 H(p - \sigma_{cy}), \tag{53a}$$

$$k_y = k_{y0} + \frac{2d_y^3 d_x^2}{3[2d_y + (d_x - 2d_y)H(d_x - 2d_y)]^3 E^3}(p - \sigma_{cx})^3 H(p - \sigma_{cx}). \tag{53b}$$

These equations can be simplified in the following situations.

SITUATION I ($2d_x \ge d_y \ge d_x/2$):

With ($2d_x \ge d_y \ge d_x/2$), equations (50a) and (50b) become $$A_{Ex} = \frac{2d_x}{d_y}, \tag{54a}$$

$$A_{Ey} = \frac{2d_y}{d_x}. \tag{54b}$$

Furthermore, equations (51a) and (51b) become $$w_x = \frac{d_y(p-\sigma_{cy})H(p-\sigma_{cy})}{E}, \tag{55a}$$

$$w_y = \frac{d_x(p-\sigma_{cx})H(p-\sigma_{cx})}{E}. \tag{55b}$$

Furthermore, equation (52) becomes $$\Delta\phi = \frac{1}{E}(p-\sigma_{cy})H(p-\sigma_{cy}) + \frac{1}{E}(p-\sigma_{cx})H(p-\sigma_{cx}). \tag{56}$$

Furthermore, equations (53a) and (53b) become $$k_x = k_{x0} + \frac{d_y^2}{12E^3}(p-\sigma_{cy})^3 H(p-\sigma_{cy}), \tag{57a}$$

$$k_y = k_{y0} + \frac{d_x^2}{12E^3}(p-\sigma_{cx})^3 H(p-\sigma_{cx}). \tag{57b}$$

Furthermore, equations (24a) and (24b) become $$p-\sigma_{cy} = \frac{A_p}{d_y^{1/2}}\left(q\ln\frac{a}{x}\right)^{1/4}, \tag{58a}$$

$$p-\sigma_{cx} = \frac{e^{1/2}A_p}{d_x^{1/2}}\left(q\ln\frac{b}{y}\right)^{1/4}, \tag{58b}$$

where $$A_p = \left[\frac{24E^3\mu}{(1+e)B}\right]. \tag{59}$$

Furthermore, equations (25a) and (25b) become $$p_w-\sigma_{cy} = \frac{A_p}{d_y^{1/2}}\left(q\ln\frac{a}{x_w}\right)^{1/4}, \tag{60a}$$

$$p_w-\sigma_{cx} = \frac{e^{1/2}A_p}{d_x^{1/2}}\left(q\ln\frac{ea}{x_w}\right)^{1/4}, \tag{60b}$$

and furthermore, equation (26) becomes $$\left[1-\left(\frac{ed_y}{d_x}\right)^{1/2}A_{ea}\right](p_w-\sigma_{cy}) = \Delta\sigma_c. \tag{61}$$

Equation (60a) can be solved for $d_y$ as follows $$d_y = \frac{A_p^2}{(p_w-\sigma_{cy})^2}\left(q\ln\frac{a}{x_w}\right)^{1/2}. \tag{62}$$

With ($2d_x \geq d_y \geq d_x/2$), equations (27) and (28) become $$\frac{qt_a}{\pi} = \frac{eA_\phi}{2^{1/4}d_y^{1/2}}\left[2\int_{x_w}^{x_\sigma}\left(\ln\frac{a}{x}\right)^{1/4}x\,dx + \int_{x_\sigma}^{a}\left(\ln\frac{a}{x}\right)^{1/4}x\,dx\right] + \frac{2^{3/4}A_\phi}{e^{1/2}d_x^{1/2}}\int_{x_w}^{b}\left(\ln\frac{b}{y}\right)^{1/4}y\,dy + \frac{\Delta\sigma_c}{2e}\left[\frac{b^2-x_w^2}{e} - e(x_\sigma^2-x_w^2)\right], \tag{63a}$$

$$\frac{qt_a}{\pi e} = \frac{2^{3/4}A_\phi}{d_y^{1/2}}\left[\int_{x_w}^{x_\sigma}\left(\ln\frac{a}{x}\right)^{1/4}x\,dx + \frac{1}{2}\int_{x_\sigma}^{a}\left(\ln\frac{a}{x}\right)^{1/4}x\,dx\right] + \frac{2^{3/4}A_\phi e^{1/2}}{d_x^{1/2}}\int_{x_w}^{a}\left(\ln\frac{a}{x}\right)^{1/4}x\,dx + \frac{\Delta\sigma_c(a^2-x_\sigma^2)}{2E}, \tag{63b}$$

and $$x_\sigma = a\exp\left[-\frac{d_y^2}{q}\left(\frac{\Delta\sigma_c}{A_p}\right)^4\right]. \tag{64}$$

Equations (61), (63) and (64) can be solved iteratively for $d_x$ and $\Delta\sigma_c$.

SITUATION II ($2d_x < d_y$):

With ($2d_x < d_y$), equations (50a) and (50b) become $$A_{Ex} = 1, \tag{65a}$$

$$A_{Ey} = \frac{2d_y}{d_x}. \tag{65b}$$

Furthermore, equations (51a) and (51b) become $$w_x = \frac{2d_x(p-\sigma_{cy})H(p-\sigma_{cy})}{E}. \tag{66a}$$

$$w_y = \frac{d_x(p-\sigma_{cx})H(p-\sigma_{cx})}{E}. \tag{66b}$$

Furthermore, equation (52) becomes $$\Delta\phi = \frac{2d_x}{d_yE}(p-\sigma_{cy})H(p-\sigma_{cy}) + \frac{1}{E}(p-\sigma_{cx})H(p-\sigma_{cx}). \tag{67}$$

Furthermore, equations (53a) and (53b) become $$k_x = k_{x0} + \frac{2d_x^3}{3d_yE^3}(p-\sigma_{cy})^3 H(p-\sigma_{cy}), \tag{68a}$$

$$k_y = k_{y0} + \frac{d_x^2}{12E^3}(p-\sigma_{cx})^3 H(p-\sigma_{cx}). \tag{68b}$$

Furthermore, equations (24a) and (24b) become $$p-\sigma_{cy} = \left(\frac{d_y}{8d_x^3}\right)^{1/4}A_p\left(q\ln\frac{a}{x}\right)^{1/4}, \tag{69a}$$

$$p-\sigma_{cx} = \frac{e^{1/2}A_p}{d_x^{1/2}}\left(q\ln\frac{b}{y}\right)^{1/4}, \tag{69b}$$

Furthermore, equations (25a) and (25b) become $$p_w - \sigma_{cy} = \left(\frac{d_y}{8d_x^3}\right)^{1/4} A_p\left(q\ln\frac{a}{x_w}\right)^{1/4}, \tag{70a}$$

$$p_w - \sigma_{cx} = \frac{e^{1/2}A_p}{d_x^{1/2}}\left(q\ln\frac{ea}{x_w}\right)^{1/4}, \tag{70b}$$

And furthermore, equation (26) becomes $$\left[1 - \left(\frac{8e^2 d_x}{d_y}\right)^{1/4} A_{ea}\right](p_w - \sigma_{cy}) = \Delta\sigma_c. \tag{71}$$

With ($2d_x<d_y$), equations (27) and (28) lead to $$\frac{qt_a}{\pi} = \frac{eA_\phi d_y^{1/4}}{2d_x^{3/4}}\left[\left(1 + \frac{2d_x}{d_y}\right)\int_{x_w}^{x_\sigma}\left(\ln\frac{a}{x}\right)^{1/4} x dx + \frac{2d_x}{d_y}\int_{x_\sigma}^{a}\left(\ln\frac{a}{x}\right)^{1/4} x dx\right] + \frac{A_\phi}{2^{1/4}e^{1/2}d_x^{1/2}}\left(1 + \frac{2d_x}{d_y}\right)\int_{x_w}^{b}\left(\ln\frac{b}{y}\right)^{1/4} y dy + \frac{\Delta\sigma_c}{2E}\left[\frac{2d_x}{ed_y}(b^2 - x_w^2) - e(x_\sigma^2 - x_w^2)\right], \tag{72a}$$

$$\frac{qt_a}{\pi e} = A_\phi\left(\frac{d_y}{d_x^3}\right)^{1/4}\left[\left(\frac{d_x}{d_y} + \frac{1}{2}\right)\int_{x_w}^{x_\sigma}\left(\ln\frac{a}{x}\right)^{1/4} x dx + \frac{d_x}{d_y}\int_{x_\sigma}^{a}\left(\ln\frac{a}{x}\right)^{1/4} x dx\right] + e^{1/2}A_\phi\frac{2^{3/4}}{d_x^{1/2}}\left(\frac{d_x}{d_y} + \frac{1}{2}\right)\int_{x_w}^{a}\left(\ln\frac{a}{x}\right)^{1/4} x dx + \frac{\Delta\sigma_c}{E}\left[\frac{d_x}{d_y}(a^2 - x_w^2) - \frac{1}{2}(x_\sigma^2 - x_w^2)\right], \tag{72b}$$

and $$x_\sigma = a\exp\left[-\frac{8d_x^3}{qd_y}\left(\frac{\Delta\sigma_c}{A_p}\right)^4\right]. \tag{73}$$

Equations (70), (71), (72) and (73) can be combined and solved iteratively for $d_x$, $d_y$ and $\Delta\sigma_c$.

SITUATION III ($d_y<d_x/2$):

With ($d_y<d_x/2$), equations (50a) and (50b) become $$A_{Ex} = \frac{2d_x}{d_y}, \tag{74a}$$

$$A_{Ey} = 1. \tag{74b}$$

Furthermore, equations (51a) and (51b) become $$w_x = \frac{d_y(p - \sigma_{cy})H(p - \sigma_{cy})}{E}, \tag{75a}$$

$$w_y = \frac{2d_y(p - \sigma_{cx})H(p - \sigma_{cx})}{E}. \tag{75b}$$

Furthermore, equation (52) becomes $$\Delta\phi = \frac{1}{E}(p - \sigma_{cy})H(p - \sigma_{cy}) + \frac{2d_y}{d_x E}(p - \sigma_{cx})H(p - \sigma_{cx}). \tag{76}$$

Furthermore, equations (53a) and (53b) become $$k_x = k_{x0} + \frac{d_y^2}{12E^3}(p - \sigma_{cy})^3 H(p - \sigma_{cy}), \tag{77a}$$

$$k_y = k_{y0} + \frac{2d_y^3}{3d_x E^3}(p - \sigma_{cx})^3 H(p - \sigma_{cx}). \tag{77b}$$

Furthermore, equations (24a) and (24b) become $$p - \sigma_{cy} = \frac{A_p}{d_y^{1/2}}\left(q\ln\frac{a}{x}\right)^{1/4}, \tag{78a}$$

$$p - \sigma_{cx} = e^{1/2}A_p\left(\frac{d_x}{8d_y^3}\right)^{1/4}\left(q\ln\frac{b}{y}\right)^{1/4}, \tag{78b}$$

Furthermore, equations (25a) and (25b) become $$p_w - \sigma_{cy} = \frac{A_p}{d_y^{1/2}}\left(q\ln\frac{a}{x_w}\right)^{1/4}, \tag{79a}$$

$$p_w - \sigma_{cx} = e^{1/2}A_p\left(\frac{d_x}{8d_y^3}\right)^{1/4}\left(q\ln\frac{ea}{x_w}\right)^{1/4}, \tag{79b}$$

And furthermore, equation (26) becomes $$\left[1 - \left(\frac{e^2 d_x}{8d_y}\right)^{1/4} A_{ea}\right](p_w - \sigma_{cy}) = \Delta\sigma_c. \tag{80}$$

With ($d_y<d_x/2$), equations (27) and (28) become $$\frac{qt_a}{\pi} = \frac{eA_\phi}{2^{1/4}d_y^{1/2}}\left[\left(1 + \frac{2d_y}{d_x}\right)\int_{x_w}^{x_\sigma}\left(\ln\frac{a}{x}\right)^{1/4} x dx + \int_{x_\sigma}^{a}\left(\ln\frac{a}{x}\right)^{1/4} x dx\right] + \frac{A_\phi d_x^{1/4}}{2e^{1/2}d_y^{3/4}}\left(1 + \frac{2d_y}{d_x}\right)\int_{x_w}^{b}\left(\ln\frac{b}{y}\right)^{1/4} y dy + \frac{\Delta\sigma_c}{2E}\left[\frac{1}{e}(b^2 - x_w^2) - \frac{2ed_y}{d_x}(x_\sigma^2 - x_w^2)\right], \tag{81a}$$

$$\frac{qt_a}{\pi e} = A_\phi\frac{2^{3/4}}{d_y^{1/2}}\left[\left(\frac{1}{2} + \frac{d_y}{d_x}\right)\int_{x_w}^{x_\sigma}\left(\ln\frac{a}{x}\right)^{1/4} x dx + \frac{1}{2}\int_{x_\sigma}^{a}\left(\ln\frac{a}{x}\right)^{1/4} x dx\right] + e^{1/2}A_\phi\left(\frac{d_x}{d_y^3}\right)^{1/4}\left(\frac{1}{2} + \frac{d_y}{d_x}\right)\int_{x_w}^{a}\left(\ln\frac{a}{x}\right)^{1/4} x dx + \frac{\Delta\sigma_c}{E}\left[\frac{1}{2}(a^2 - x_w^2) - \frac{d_y}{d_x}(x_\sigma^2 - x_w^2)\right], \tag{81b}$$

and $$x_\sigma = a\exp\left[-\frac{d_y^2}{q}\left(\frac{\Delta\sigma_c}{A_p}\right)^4\right]. \tag{82}$$

Equations (79), (80), (81) and (82) can be combined and solved iteratively for $d_x$, $d_y$ and $\Delta\sigma_c$.

Figure 4:
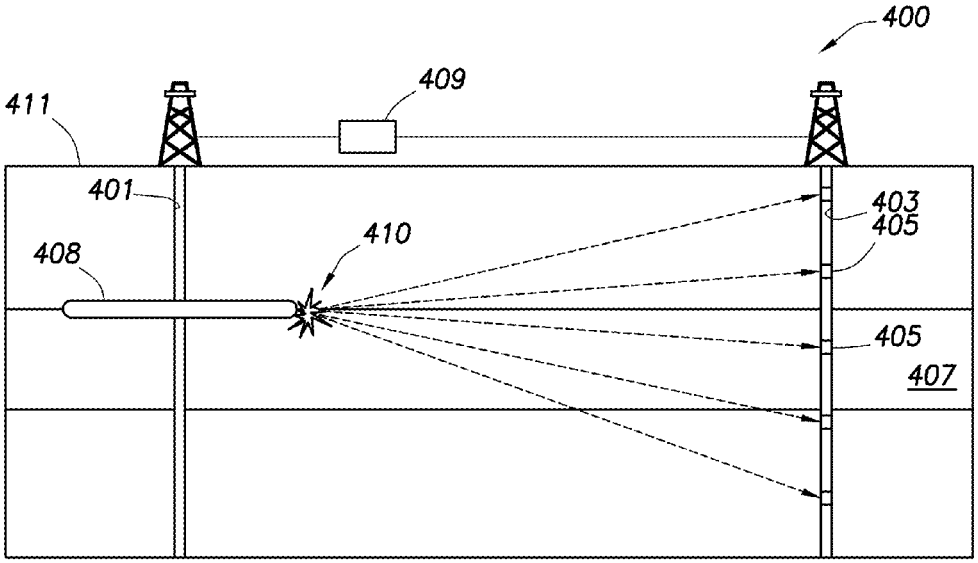
FIG. 4 is a schematic illustration of a hydraulic fracturing site in accordance with the present disclosure.

FIG. 4 illustrates an exemplary operational setting for hydraulic fracturing of a subterranean formation (referred to herein as a "fracture site") in accordance with the present disclosure. The fracture site 400 can be located on land or in a water environment and includes a treatment well 401 extending into a subterranean formation as well as a monitoring well 403 extending into the subterranean formation and offset from the treatment well 401. The monitoring well 403 includes an array of geophone receivers 405 (e.g., three-component geophones) spaced therein as shown.

During the fracturing operation, fracturing fluid is pumped from the surface 411 into the treatment 401 causing the surrounding formation in a hydrocarbon reservoir 407 to fracture and form a hydraulic fracture network 408. Such fracturing produces microseismic events 410, which emit both compressional waves (also referred to as primary waves or P-waves) and shear waves (also referred to as secondary waves or S-waves) that propagate through the earth and are recorded by the geophone receiver array 405 of the monitoring well 403.

The distance to the microseismic events 410 can be calculated by measuring the difference in arrival times between the P-waves and the S-waves. Also, hodogram analysis, which examines the particle motion of the P-waves, can be used to determine azimuth angle to the event. The depth of the event 410 is constrained by using the P- and S-wave arrival delays between receivers of the array 405. The distance, azimuth angle and depth values of such microseismic events 410 can be used to derive a geometric boundary or profile of the fracturing caused by the fracturing fluid over time, such as an elliptical boundary defined by a height h, elliptic aspect ratio e (equation (2)) and major axis a as illustrated in FIG. 3.

The site 401 also includes a supply of fracturing fluid and pumping means (not shown) for supplying fracturing fluid under high pressure to the treatment well 401. The fracturing fluid can be stored with proppant (and possibly other special ingredients) pre-mixed therein. Alternatively, the fracturing fluid can be stored without pre-mixed proppant or other special ingredients, and the proppant (and/or other special ingredients) can be mixed into the fracturing fluid in a controlled manner by a process control system as described in U.S. Pat. No. 7,516,793, hereby incorporated by reference in its entirety. The treatment well 401 also includes a flow sensor S as schematically depicted for measuring the pumping rate of the fracturing fluid supplied to the treatment well and a downhole pressure sensor for measuring the downhole pressure of the fracturing fluid in the treatment well 401.

A data processing system 409 is linked to the receivers of the array 405 of the monitoring well 403 and to the sensor S (e.g., flow sensor and downhole pressure sensor) of the treatment well 401. The data processing system 409 may be incorporated into and/or work with the surface unit 134 (FIGS. 1.1-1.4). The data processing system 409 carries out the processing set forth in FIGS. 5.1.1 and 5.1.2 and described herein. As will be appreciated by those skilled in the art, the data processing system 409 includes data processing functionality (e.g., one or more microprocessors, associated memory, and other hardware and/or software) to implement the disclosure as described herein.

The data processing system 409 can be realized by a workstation or other suitable data processing system located at the site 401. Alternatively, the data processing system 409 can be realized by a distributed data processing system wherein data is communicated (e.g., in real time) over a communication link (e.g., a satellite link) to a remote location for data analysis as described herein. The data analysis can be carried out on a workstation or other suitable data processing system (such as a computer cluster or computing grid). Moreover, the data processing functionality of the present disclosure can be stored on a program storage device (e.g., one or more optical disks or other hand-holdable non-volatile storage apparatus, or a server accessible over a network) and loaded onto a suitable data processing system as needed for execution thereon as described herein.

FIGS. 5.1.1 and 5.1.2 depict a method of performing a fracture operation involving modeling. Portions 501-507 describe fracture modeling. Such fracture modeling may be used to develop and characterize aspects of the wellsite (e.g., fractures) and/or to develop a fracture plan.

In 501, the data processing system 409 stores (or inputs from suitable measurement means) parameters used in subsequent processing, including the plain strain modulus E (Young's modulus) of the hydrocarbon reservoir 407 that is being fractured, location (z) of fluid injection along the wellbore, the radius ($x_w$) of the treatment wellbore, and/or fluid composition temperature ($T_{inj}$), viscosity (μ), density, heat conductivity, and/or heat capacity of the fracturing fluid that is being supplied to the treatment well 401. The fluid viscosity, density, heat conductivity, and/or heat capacity may also be calculated as a function of fluid temperature, pressure, and composition. Selected parameters may be used to determine various aspect of the model. For example, Young's modulus, radius $X_w$, fluid temperature, and viscosity may be used to generate the model.

In 503-517, the data processing system 409 is controlled to operate for successive periods of time (each denoted as Δt) that fracturing fluid is supplied to the treatment well 401.

In 505, the data processing system 409 processes the acoustic signals captured by the receiver array 405 over the period of time Δt to derive the distance, azimuth angle and depth for the microseismic events produced by fracturing of the hydrocarbon reservoir 407 over the period of time Δt. The distance, azimuth and depth values of the microseismic events are processed to derive an elliptical boundary characterizing the profile of the fracturing caused by the fracturing fluid over time. In the preferred embodiment, the elliptical boundary is defined by a height h, elliptic aspect ratio e (Equation (2)), and major axis a as illustrated in FIG. 3.

In 507, the data processing system 409 obtains temperature $T_{inj}$ and the flow rate q, which is the pumping rate divided by the height of the elliptic fractured formation, of the fracturing fluid supplied to the treatment well for the period of time Δt, and derives the net downhole pressure $p_w-\sigma_c$ of the fracturing fluid at the end of the period of time Δt. The wellbore net pressure $p_w-\sigma_c$ can be obtained from the injection pressure of the fracturing fluid at the surface according to the following:

$$p_w-\sigma_c=p_{surface}-BHTP-p_{pipe}-p_{perf}+p_{hydrostatic} \tag{83}$$

where $p_{surface}$ is the injection pressure of the fracturing fluid at the surface; BHTP is the bottom hole treating pressure; $p_{pipe}$ is the friction pressure of the tubing or casing of the treatment well while the fracturing fluid is being injected into the treatment well; this friction pressure depends on the type and viscosity of the fracturing fluid, the size of the pipe and the injection rate; $p_{perf}$ is the friction pressure through the perforations of the treatment well that provide for injection of the fracturing fluid into the reservoir; and $p_{hydrostatic}$ is the hydrostatic pressure due to density of the fracturing fluid column in the treatment well.

The wellbore net pressure $p_w-\sigma_c$ can also be derived from BHTP at the beginning of treatment and the injection pressure $p_{surface}$ at the beginning of the shut-in period. The wellbore net pressure $p_w-\sigma$, at the end of treatment can be calculated by plugging these values into equation (83) while neglecting both friction pressures $p_{pipe}$ and $p_{perf}$, which are zero during the shut-in period. Temperature $T_{inj}$ may also be obtained, and fluid temperature $T_{wb}(t,z)$ along wellbore and $T_f(t,x)$ along fracture or fracture network are determined.

In 509, the data processing system 409 utilizes the parameters (E, $x_w$) stored in 501, the parameters (h, e and a) defining the elliptical boundary of the fracturing as generated in 505, the flow rate q and the pumping period $t_p$, and the net downhole pressure $p_w-\sigma_c$ and temperature $T_{wb}(t,z)$ as generated in 507 and fluid properties as generated in 511, in conjunction with a model for characterizing a hydraulic fracture network as described herein, to solve for relevant geometric properties that characterize the hydraulic fracture network at the end of the time period Δt, such as parameters $d_x$ and $d_y$ and the stress contrast $\Delta\sigma_c$ as set forth above.

In 511, the geometric and geomechanical properties (e.g., $d_x$, $d_y$, $\Delta\sigma_c$) that characterize the hydraulic fracture network as generated in 509 are used in conjunction with a model as described herein to generate data that quantifies and simulates propagation of the fracture network as a function of time and space, such as width w of the hydraulic fractures from equations (10a) and (10b) and the times needed for the front and tail of the fracturing formation, as indicated by the distribution of induced microseismic events, to reach certain distances from equation (19). The geometric and geomechanical properties generated in 509 can also be used in conjunction with the model to derive data characterizing the fractured hydrocarbon reservoir at time t, such as net pressure of fracturing fluid in the treatment well (from equations (17a) and (17b), or (25a) and (25b)), net pressure inside the fractures (from equations (16a) and (16b), or (24a) and (24b)), change in fracture porosity (Δϕ from equation 12), and change in fracture permeability ($k_x$ and $k_y$ from equations (13a) and (13b)).

A visualization portion of the method is depicted 513-519. In optional 513, the data generated in 511 is used for real-time visualization of the fracturing process and/or optimization of the fracturing plan. Various treatment scenarios may be examined using the forward modeling procedure described below. In general, once certain parameters such as the fracture spacing and the stress difference have been determined, one can adjust the other parameters to optimize a treatment. For instance, the injection rate and the viscosity or other properties of fracturing fluid may be adjusted to accommodate desired results. Exemplary display screens for real-time visualization of net pressure change of fracturing fluid in the treatment well along the x-axis, fracture width w along the x-axis, and changes in porosity and permeability along the x-axis are illustrated in FIGS. 6.1-6.4.

In 515, it is determined if the processing has been completed for the last fracturing time period. If not, the operations return to 503 to repeat the operations of 505-513 for the next fracturing time period. If so, the operations continue to 517.

In 517, the model as described herein is used to generate data that quantifies and simulates propagation of the fracture network as a function of time and space during the shut-in period, such as the width w of hydraulic fractures and the distance of the front and tail of the fracturing formation over time. The model can also be used to derive data characterizing the fractured hydrocarbon reservoir during the shut-in period, such as net pressure of fracturing fluid in the treatment well (from equations (17a) and (17b), or (25a) and (25b)), net pressure inside the fractures (from equations (16a) and (16b), or (24a) and (24b)), change in fracture porosity (Δϕ from equation 12), and change in fracture permeability (kx and ky from equations (13a) and (13b)).

Finally, in optional 519, the data generated in 511 and/or the data generated in 517 is used for real-time visualization of the fracturing process and/or shut-in period after fracturing and/or optimization of the fracture plan. Visualization in 517 may include a variety of one or more of the parameters of 501. FIGS. 6.1-7.4 depict various examples of visualization in the form of graphs of various parameters, such as net pressure, fracture width, permeability, porosity, distance, etc.

FIGS. 7.1-7.4 illustrate exemplary display screens for real-time visualization, such as net pressure of fracturing fluid in the treatment well as a function of time during the fracturing process and then during shut-in (which begins at the time of 4 hours in the example given), net pressure inside the fractures as a function of distance at a time at the end of fracturing and at a time during shut-in, the distance of the front and tail of the fracturing formation over time during the fracturing process and then during shut-in, and fracture width as a function of distance at a time at the end of fracturing and at a time during shut-in, respectively. Note that the circles of FIG. 7.3 represent locations of microseismic events as a function of time and distance away from the treatment well during the fracturing process and then during shut-in.

The method may be varied as needed. FIGS. 5.2.1 and 5.2.2 show another version of the method. This version of the application involves temperature. In this version, 501' involves storing (or deriving) parameters used in subsequent processing, including:

plane strain modulus e (Young's modulus) of the hydrocarbon reservoir that is being fractured;

radius $x_w$ of the wellbore; —location (z) of fluid injection along wellbore; —composition, proppant size & concentration, temperature ($t_{inj}$) and flow rate q of the fluid that is supplied to the treatment well; and 503' involves operating over successive periods of time (each denoted as Δt) that hydraulic fluid is supplied to the treatment well. Next, 505' involves processing the acoustic signals captured by the receiver array over the period of time Δt to derive the distance, azimuth angle, and depth for microseismic events produced by fracturing of the hydrocarbon reservoir over the period of time Δt; process the distance, azimuth and depth values of the microseismic events to derive an elliptical boundary defined by a thickness h, major axis a and minor axis b that quantifies growth of the fracture network as a function of time; 507' involves obtaining the flow rate q, temperature $t_{inj}$ and composition of the fluid supplied to the treatment well, deriving the downhole net pressure change $p_w(t, z)-\sigma_c$ and temperature $t_{wb}(t,z)$ of the hydraulic fluid, and calculating fluid properties (e.g., viscosity (μ), density ($\rho_f$), heat conductivity ($\lambda_f$), and heat capacity ($c_f$)) along the wellbore, all of them over the period of time Δt; and 509' involves utilizing the parameters (e, $x_w$) stored in 501', the parameters (h, a and b) defining the elliptical boundary of the fracture network as generated in 505', fluid properties as generated in 511 and the flow rate q and the net downhole pressure change $p_w(t,z)-\sigma_c$, in conjunction with a model for characterizing a hydraulic fracture network as described herein, to solve for relevant geometric properties that characterize the fracture network, such as parameters $d_x$, $d_y$, fracture width and fluid flow velocity as a function of space over the period of time Δt.

The method continues with 511' which involves using the geometric properties derived in 509' in conjunction with a hydraulic fracture model to generate data that quantifies and simulates propagation of the fracture network as a function of time and space; the geometric properties derived in 509' can also be used in conjunction with the model to derive other data characterizing the fractured hydrocarbon reservoir for the time period Δt; 511.1' uses the fluid temperature twb(t,z) derived in 507' and the geometric properties and fluid flow velocity along fractures derived in 509' and 511', in conjunction with a model for heat transport across fracture network as described herein, to calculate temperature $t_f(t,x)$ and generate fluid property data (e.g., viscosity (μ), density ($\rho_f$), heat conductivity ($\lambda_f$), and heat capacity ($c_f$)) of the injected fluid in a fracture or fracture network as functions of space over the time period of Δt, and as needed, as provided by 511.2'. 509'-511.2' may be repeated until convergence is reached.

Next, 511.3' involves using proppant data stored in 501', the geometric properties, fluid properties, and flow velocity along fractures derived in 509', 511' and 513', in conjunction with a model for quantifying proppant transport across the fracture or fracture network as described herein, to calculate the concentration of proppant in the fracture network as a function of space over the period of time Δt, and 513' may involve optionally, using the data generated in 509' to 517' for real-time visualization of the fracturing process and/or real-time optimization of the fracture plan. A decision may then be made at 515' to determine if it is the last fracturing time period. If not, 501'-513' may be repeated until the last fracturing time period is detected.

Once the last time period is detected, the method may continue with 517' using the same models to generate fracture geometric properties, fluid properties (e.g., temperature, viscosity (μ), density ($\rho_f$), heat conductivity ($\lambda_f$), and heat capacity ($c_f$)) and proppant distribution during the shut-in period, 519' using the data generated in 517' for real-time visualization of the shut-in process and/or real-time decision on when to end the shut-in process and/or optimization of the shut-in plan during the design stage, and 519.1' using the data generated in 517', in conjunction with a model for quantifying hydrocarbon transport in the fractured reservoir as described herein, to simulate hydrocarbon production from the reservoir for optimization of the fracturing plan.

The hydraulic fracture model as described herein can be used as part of forward calculations to help in the design and planning stage of a hydraulic fracturing treatment. More particularly, for a given major axis $a=a_i$ at time $t=t_i$, calculations can be done according to the following procedure:

1. assume $$\frac{\partial \phi}{\partial t}$$

if $t=t_0$ (i=0), otherwise 2. knowing $$\frac{\partial \phi}{\partial t}$$

from $t=t_{i-1}$, determine e using equation (18)

3. knowing $$\frac{\partial \phi}{\partial t}$$

and e, calculate $p-\sigma_{cx}$ and $p-\sigma_{cy}$ using equations (15a) and (15b) or equations (16a) and (16b)

4. knowing $p-\sigma_{cx}$ and $p-\sigma_{cy}$, calculate Δϕ using equation (12)
5. knowing e and Δϕ, calculate $t=t_i$ using equations (19), or (27) and (28)
6. knowing $\Delta t=t_i-t_{i-1}$ and Δϕ, calculate $$\frac{\partial \phi}{\partial t}$$

as Δϕ/Δt 7. repeat 2 to 6 till the whole calculation process converges

Carrying out the procedure described above for i=1 to N simulates the propagation of an induced fracture network till front location $a=a_N$. Distributions of net pressure, fracture width, porosity and permeability as functions of space and time for $x<a_N$ and $t<t_N$ are obtained as well.

Advantageously, the hydraulic fracture model and fracturing process based thereon constrains geometric and geomechanical properties of the hydraulic fractures of the subterranean formation by using the field data to reduce the complexity of the fracture model and the processing resources and time required to provide characterization of the hydraulic fractures of the subterranean formation. Such characterization can be generated in real-time to manually or automatically manipulate surface and/or down-hole physical components supplying fracturing fluids to the subterranean formation to adjust the hydraulic fracturing process as desired, such as by optimizing fracturing plan for the site (or for other similar fracturing sites).

Production Operations

In another aspect, these techniques employ fracture models for determining production estimates. Such estimations may be made, for example, by applying the HFN modeling techniques, such as those using a wiremesh HFN model with an elliptical structure, to production modeling. These techniques may be used in cases with multiple or complex fractures, such as shale or tight-sand gas reservoirs. Such models may use, for example, an arbitrarily time-dependent fluid pressure along hydraulic fractures. Corresponding analytical solutions may be expressed in the time-space domain. Such solutions may be used in high speed applications for hydraulic fracturing stimulation job design, optimization or post-job analysis.

These techniques employ an analytical approach that provides a means to forecast production from reservoirs, such as shale reservoirs, using an HFN model of elliptic form. Such forecasts may involve the use of analytical models for forecasting or analyzing production from oil and gas reservoirs with imbedded hydraulic fractures. The forecasting models may be empirical or analytical in nature.

Examples of empirical forecasts are provided in U.S. Pat. Nos. 7,788,074, 6,101,447 and 6,101,447, and disclosed in Arps, "Analysis of Decline Curves", SPE Journal Paper, Chapt. 2, pp. 128-247 (1944). Empirical forecasts may involve an estimate of well production using various types of curves with adjustable parameters for different flow regimes separately during a reservoir's lifespan.

Examples of analytical forecasts are provided in Van Everdingen et al., "The Application of the Laplace Transformation to Flow Problems in Reservoirs", Petroleum Transactions AIME, December 1949, pp. 305-324; van Kruysdijk et al., "Semianalytical Modeling of Pressure Transients in Fractured Reservoirs," SPE 18169, SPE Tech. Conf. and Exhibition, 2-5 Oct. 1988, Houston, Tex.; Ozkan et al., "New Solutions for Well-Test-Analysis Problems: Part 1—Analytical Considerations", SPE 18615, SPE Formation Evaluation, Vol. 6, No. 3, SPE, September 1991; and Kikani, "Pressure-Transient Analysis of Arbitrarily Shaped Reservoirs With the Boundary-Element Method", SPE 18159 SPE Formation Evaluation March 1992. Additional analytical approaches have later been applied by de Swaan et al., "Analytic Solutions for Determining Naturally Fractured Reservoir Properties by Well Testing," SPE Jrnl., pp. 117-22, June 1976; van Kruysdij et al., "A Boundary Element Solution of the Transient Pressure Response of Multiple Fractured Horizontal Wells", presented at the 2nd European Conf. on the Mathematics of Oil Recovery, Cambridge, UK, 1989; Larsen, "Pressure-Transient Behavior of Horizontal Wells With Finite-Conductivity Vertical Fractures", SPE 22076, Soc. of Petroleum Engr., Intl. Arctic Tech. Conf., 29-31 May 1991, Anchorage, AL; Kuchuk et al., "Pressure Behavior of Horizontal Wells with Multiple Fractures", 1994, Soc. of Petroleum Engrs., Inc., Univ. of Tulsa Centennial Petroleum Engr. Symp., 29-31 Aug. 1994, Tulsa, Okla.; Chen et al., "A Multiple-fractured Horizontal Well in a Rectangular Drainage Region", SPE Jrnl. 37072, Vol. 2, No. 4, December 1997. pp. 455-465; Brown et al., "Practical Solutions for Pressure Transient Responses of Fractured Horizontal Wells in Unconventional Reservoirs", SPE Tech. Conf. and Exhibition in New Orleans, La., 2009; Bello, "Rate Transient Analysis in Shale Gas Reservoirs with Transient Linear Behavior", PhD Thesis, 2009; Bello et al., "Multi-stage Hydraulically Fractured Horizontal Shale Gas Well Rate Transient Analysis", North Africa Tech. Conf. and Exhibition, 14-17 Feb. 2010, Cairo, Egypt; Meyer et al, "Optimization of Multiple Transverse Hydraulic Fractures in Horizontal Wellbores", 2010, SPE 131732, SPE Unconventional Gas Conf., 23-25 Feb. 2010, Pittsburgh, Pa., USA; and Thompson et al., "Advancements in Shale Gas Production Forecasting—A Marcellus Case Study," SPE 144436, North American Unconventional Gas Conf. and Exhibition, 14-16 Jun. 2011, The Woodlands, Tex., USA.

The analytical approach may involve obtaining pressure or production rate solutions by solving partial differential equations describing gas flow in the reservoir formation and through the fractures. By way of example, Laplace transform and numerical inversion may be used. In another example, Laplace transformation may be used to obtain asymptotic solutions for early and late production periods, respectively, from a horizontally radial reservoir subject to either a constant pressure drop or a constant production rate at the wellbore. The ordinary differential equations in the Laplace domain may be solved using Green's and point source functions, and then transforming the solutions back to the time-space domain through a numerical inversion to study production from horizontal wells with multiple transverse fractures.

The analytical approach may also involve using the time-space domain. Additional examples of the analytical approach are provided by Gringarten et al., "The Use of Source and Green's Functions in Solving Unsteady-Flow Problems in Reservoirs", Society of Petroleum Engineers Journal 3818, October 1973, Vol. 13, No. 5, pp. 285-96; Cinco et al., "Transient Pressure Behavior for a Well With a Finite-Conductivity Vertical Fracture", SPE 6014, Society of Petroleum Engineers Journal, Aug. 15, 1976; and in U.S. Pat. No. 7,363,162. Green's and point source functions may be corresponded to simplified cases. Some of the functions may be used to study production from a vertical well intersected by a vertical fracture. Time-space domain analytical solutions may also provide fluid pressure in a semi-infinite reservoir with a specified fluid source/sink.

Model and Solutions for Wiremesh HFN

FIGS. 8.1-8.4 depict alternate views of HFN models 800.1-800.4 usable for hydraulic fracture modeling. The HFN models may be created using the HFN techniques described above. Application of the disclosed models to hydraulic fracturing stimulation job design and post-job analysis is described using wiremesh HFN models 800.1, 800.2,800.3 as an example. These figures each depict a wellbore 820 with a hydraulic fracture network (HFN) 822 thereabout.

The HFN 822 is an elliptical structure with a plurality of vertical fractures 824 perpendicular to another a plurality of fractures 826 forming a wiremesh configuration. The plurality of fractures define a plurality of matrix blocks 828 of the HFN 822. The HFN 822 is a complex fracture network having a plurality of intersecting fractures 824 and 826 that are hydraulically connected for fluid flow therebetween. The intersecting fractures may be generated by fracturing of the formation. Fractures as used herein may be natural and/or man made.

As shown in FIG. 8.1, the HFN 822 has a height h along a minor diameter, a radius b along its minor axis and aligned with the wellbore 820, and a radius a along its major axis. Some of the dimensions of the HFN are also shown in FIG. 3. FIG. 8.4 shows another view of the ellipse of FIG. 8.1. As shown in this view, the ellipse is a two-dimensional entity with the wellbore 820 passing through a center of the ellipse. In this view, the major axis a and the height h are shown.

While FIGS. 8.1-8.4 depict complex HFN models 800.1-800.4, the models may also be used with reservoirs having single or parallel hydraulic fractures. Also, while the wellbore 820 is depicted as passing through the HFN 822 parallel to the vertical lines, the HFN 822 may be oriented as desired about the wellbore 820. Application of the disclosed models to hydraulic fracturing stimulation job design and post-job analysis is described using a wiremesh HFN 822 as an example. Application to reservoirs with single or parallel hydraulic fractures or a fracture network of non-elliptic shape can be done in a similar manner, but adjusted as needed to a comparably simpler or more complicated configuration.

Proppant Placement

Information about proppant placement in an HFN, such as the HFN 822 of FIGS. 8.1-8.4, may be used to quantify production from the HFN. One or more types of hydraulic fractures open after a fracturing job is done.

FIGS. 9.1 and 9.2 depict views of proppant placement about an HFN and fractures of an HFN, respectively. FIG. 9.1 shows a cross-sectional view of the HFN 822 of FIG. 8.3 taken along line 9-9. As shown in this view, proppant 823 is positioned in wellbore 820, and extends horizontally through the wellbore 820 along a major fracture and into the surrounding formation. As also shown in FIGS. 9.1 and 9.2, the proppant 823 may transport in different transport patterns 827, 829.

FIG. 9.2 is picture of a fracture 827 with proppant 823 extending therein. Fluid flows through the fracture 827 from the left to the right. The proppant 823 is carried by the fluid, but settles on the left side of the fracture as it travels from left to right. The proppant 823 as depicted enters a left portion of the fracture 827 as indicated by the lighter shaded regions.

The flow of proppant through an HFN may be defined by an analysis of transport of the proppant. For N types of proppant particles each with volume fraction $V_{p,i}$, the total proppant volume fraction is $$V_p = \sum_{i=1}^{N} V_{p,i} \tag{84}$$

The placement of proppant along the fractures of an HFN involves horizontal transport, vertical settling and possible bridging of the proppant. As shown in FIG. 9.1, proppant type i is transported in all directions by the transport pattern 827. This can be mathematically described by the following:

$$2\pi\gamma x\frac{\partial(\phi V_{p,i})}{\partial t} - \frac{\partial}{\partial x}\left(\frac{2\pi\gamma x k_x}{\mu}\frac{\partial p}{\partial x}V_{p,i}\right) = 0 \tag{85}$$

This equation also describes the horizontal flow of fluid in FIG. 9.2.

If the proppant remains in the primary fracture along the x-axis as shown in transport pattern 829 of FIG. 9.1, then the proppant transport can be described by $$\frac{\partial(w_x V_{p,i})}{\partial t} - \frac{\partial}{\partial x}\left(\frac{w_x^3}{12\mu}\frac{\partial p}{\partial x}V_{p,i}\right) = 0 \tag{86}$$

For a uniform horizontal volume flow rate q, the above equations reduce to, respectively, $$2\pi\gamma x\frac{\partial(\phi V_{p,i})}{\partial t} + \frac{\partial(qV_{p,i})}{\partial x} = 0 \tag{87}$$

For transport along a fairway, the following equation applies:

$$\frac{\partial(w_x V_{p,i})}{\partial t} + \frac{\partial}{\partial x}\left(\frac{q}{2\pi\gamma x}V_{p,i}\right) = 0 \tag{88}$$

When fluid leakoff $q_l$ is taken into consideration, the above equations become, respectively, $$2\pi\gamma x\frac{\partial(\phi V_{p,i})}{\partial t} + \frac{\partial\lfloor(q-q_l)V_{p,i}\rfloor}{\partial x} = 0 \tag{89}$$

where $$\frac{\partial(w_x V_{p,i})}{\partial t} + \frac{\partial}{\partial x}\left(\frac{q}{2\pi\gamma x}V_{p,i}\right) = 0 \tag{90}$$

As shown in FIG. 9.2, vertical settling may also occur as the proppant 823 is carried through the fracture 827. Proppant settling may be quantified by the Stokes particle terminal velocity $$v_{ps,i} = \frac{g(\rho_{p,i}-\rho_f)d_{p,i}^2}{18\mu_f} \tag{91}$$

where $\rho_f$ and $\mu_f$ and are are the density and viscosity of the suspension fluid, $\rho_{p,i}$ and $d_{pi,i}$ are the density and mean particle diameter of proppant type i. When the size or concentration of the proppant is too large, bridging of proppant may occur. This is described by a modification to the settling velocity $$v_{ps,i} = v_{st,i} f(V_p, d_{p,i}, w) \tag{92}$$

where $$f(V_p, d_{p,i}, w) = \begin{cases} \left(1-\frac{w_{cr,i}}{w}\right)^{0.25} & \text{if } w \geq w_{cr,i} \\ 0 & \text{if } w < w_{cr,i} \end{cases} \tag{93}$$

$$w_{cr,i} = \min\left(B_{cr}, 1 + V_p\frac{B_{cr}-1}{0.17}\right)d_{p,i} \quad B_{cr} = 2.5$$

Hindering factors may account for effects of fracture width, proppant size & concentration, fiber, flow regime, etc. Proppant movement may be further hindered by other factors such as fluid flow regime and the presence of fiber.

Production

FIG. 10.1 shows the HFN 822 taken along line 9-9. As shown in this view, the HFN 822 is depicted as having a plurality of concentric ellipses 930 and a plurality of radial flow lines 932. The radial flow lines 932 initiate from a central location about the wellbore 820 and extend radially therefrom. The radial flow lines 932 represent a flow path of fluid from the formation surrounding the wellbore 820 and to the wellbore 820 as indicated by the arrows. The HFN 822 may also be represented in the format as shown in FIG. 3.

Due to an assumed contrast between the permeability of the matrix and that of the HFN 822, global gas flow through the reservoir consisting of both the HFN 822 and the formation matrix can be separated into the gas flow through the HFN 822 and that inside of the matrix blocks 828. The pattern of gas flow through the HFN 822 may be described approximately as elliptical as shown in FIG. 10.1.

The HFN 822 uses an elliptical configuration to provide a coupling between the matrix and HFN flows that is treated explicitly. A partial differential equation is used to describe fluid flow inside a matrix block that is solved analytically. Three-dimensional gas flow through an elliptic wiremesh HFN can be approximately described by:

$$\frac{\partial p_f}{\partial t} - \frac{1}{x}\frac{\partial}{\partial x}\left(x\kappa_f\frac{\partial p_f}{\partial x}\right) = \frac{q_g}{\phi_f\frac{\partial\rho_f}{\partial p}} \tag{94}$$

where t is time, x is the coordinate aligned with the major axis of the ellipse, $p_f$ and $\rho_f$ are fluid pressure and density of fluid, $\Phi_f$ and $\kappa_f$ are the porosity and the x-component of the pressure diffusivity of the HFN, and $q_g$ is the rate of gas flow from the matrix into the HFN. All involved properties may be a function of either t or x or both.

For each time t, calculations of fluid pressure using equation (94) may begin from the outmost ring of the elliptical reservoir domain and end at the center of the HFN 822 at wellbore 820, or in the reverse order. Fluid pressure along the elliptical domain's boundary is taken as that of the reservoir before production. It may be assumed that no production takes place outside of the domain.

Outside of the HFN, equation (94) still applies nominally, but with $q_g=0$, $\phi_f=\phi_m$ and $\kappa_f=\kappa_m$, where $\phi_m$ and $\kappa_m$ are the porosity and the pressure diffusivity of the reservoir matrix.

Given $q_g$ there are various ways available to solve equation (94), either analytically or numerically. Due to the complex nature of the HFN and fluid properties, numerical approaches may be used for the sake of accuracy. An example of numerical solution is given below.

Dividing the elliptic reservoir domain containing the HFN into N rings, the rate of gas production from a reservoir matrix into the HFN contained by the inner and outer boundaries of the k-th ring is $$q_{gk}=q_{gxk}A_{xk}+q_{gyk}A_{yk} \tag{95}$$

where $A_{xk}$ and $A_{yk}$ are the total surface area of the fractures inside of the ring, parallel to the major axis (the x-axis) and the minor axis (the y-axis), respectively, and $q_{gxk}$ and $q_{gyk}$ are the corresponding rates of fluid flow per unit fracture surface area from the matrix into the fractures parallel to the x- and y-axis, respectively. Fluid pressure $p_f$ and the rate of gas production at the wellbore can be obtained by numerically (either finite difference, finite volume, or a similar method) solving equation (94) for any user specified initial and boundary conditions and by coupling the model with a wellbore fluid flow model.

Total surface area of fractures contained inside of the k-th ring can be calculated by:

$$A_{xk} = 4h_k\left[\sum_{j=-N_{xo}}^{N_{xo}}\sqrt{x_k^2-4(jL_{my}/\gamma)^2}-\sum_{j=-N_{xi}}^{N_{xi}}\sqrt{x_{k-1}^2-4(jL_{my}/\gamma)^2}\right] \tag{96}$$

$$A_{yk} = 4h_k\gamma\left[\sum_{j=-N_{yo}}^{N_{yo}}\sqrt{x_k^2-4(iL_{mx})^2}-\sum_{i=-N_{yi}}^{N_{yi}}\sqrt{x_{k-1}^2-4(iL_{mx})^2}\right]$$

where $\gamma$ is the aspect ratio of the elliptical HFN, $x_k$ and $h_k$ are the location and the height of the k-th ring, $L_{mx}$ and $L_{my}$ are the distances between neighboring fractures parallel to the x-axis and the y-axis, respectively, as shown in FIG. 10.2. The $N_{xo}$ and $N_{xi}$ are the number of fractures parallel to and at either side of the x-axis inside the outer and the inner boundaries, respectively, of the k-th ring, and $N_{yo}$ and $N_{yi}$ are the number of fractures parallel to and at either side of the y-axis inside the outer and the inner boundaries, respectively, of the k-th ring.

The pattern of gas flow through the HFN 822 may also be described based on fluid flow through individual matrix blocks 828 as shown in FIG. 10.2. FIG. 10.2 is a detailed view of one of the blocks 828 of HFN 822 of FIG. 10.1. As shown in this view, the direction of gas flow inside of a matrix block 828 can be approximated as perpendicular to the edges of the matrix block 828. Fluid flow is assumed to be linear flow toward outer boundaries 1040 of the block 828 as indicated by the arrows, with no flow boundaries 1042 positioned within the block 828.

Fluid flow inside a rectangular matrix block 828 can be approximately described by $$\frac{\partial p_m}{\partial t}-\kappa_m\frac{\partial^2 p_m}{\partial s^2}=0 \tag{97}$$

$$p_m(t,s)=p_r$$

$$p_m(t,L_s)=p_f(t)$$

$$\left.\frac{\partial p_m}{\partial s}\right|_{s=0}=0$$

where s is the coordinate, aligned with the x-axis or y-axis, L is the distance between the fracture surface and the effective no-flow boundary, $p_m$ is fluid pressure and $p_r$ is the reservoir pressure. Equation (97) can be solved to obtain the rate of fluid flow from the matrix into the fractures inside the k-th ring $$q_{gxk} = \phi_m\frac{\partial\rho_m}{\partial p}\frac{\partial}{\partial t}\int_0^t\frac{dp_{fk}}{du}\left[\frac{L_y}{2}\operatorname{erfc}\left(\frac{L_y}{4\sqrt{\kappa_m(t-u)}}\right)+2\sqrt{\frac{\kappa_m(t-u)}{\pi}}\left(1-e^{\frac{L_y^2}{16\kappa_m(t-u)}}\right)\right]du \tag{98}$$

$$q_{gyk} = \phi_m\frac{\partial\rho_m}{\partial p}\frac{\partial}{\partial t}\int_0^t\frac{dp_{fk}}{du}\left[\frac{L_y}{2}\operatorname{erfc}\left(\frac{L_x}{4\sqrt{\kappa_m(t-u)}}\right)+2\sqrt{\frac{\kappa_m(t-u)}{\pi}}\left(1-e^{\frac{L_x^2}{16\kappa_m(t-u)}}\right)\right]du$$

where $p_{fk}$ is the pressure of the fluid residing in fractures in the k-th ring and $\rho_m$ is the density of the fluid residing in the matrix. The coupling of $p_{fk}$ and $q_{gk}$ calculations can be either explicit or implicit. It may be implicit for the first time step even if the rest of the time is explicit.

Conventional techniques may also be used to describe the concept of fluid flow through a dual porosity medium. Some such techniques may involve a 1D pressure solution with constant fracture fluid pressure, and depict an actual reservoir by identifying the matrix, fracture and vugs therein as shown in FIG. 11.1, or depicting the reservoir using a sugar cube representation as shown in FIG. 11.2. Examples of conventional fluid flow techniques are described in Warren et al., "The Behavior of Naturally Fractured Reservoirs", SPE Journal, Vol. 3, No. 3, September 1963.

Examples of fracture modeling that may be used in the modeling described herein are provided in Wenyue Xu et al., "Quick Estimate of Initial Production from Stimulated Reservoirs with Complex Hydraulic Fracture Network," SPE 146753, SPE Annual Tech. Conf. and Exhibition, Denver, Colo., 30 Oct.-2 Nov., 2011, the entire content of which is hereby incorporated by reference.

Fluid Temperature

Fluid temperature of wellsite fluids, such as wellbore, injection (e.g., fracturing, stimulating, etc.), reservoir, and/or other fluids, may impact wellbore conditions. Such impact may affect various wellsite parameters, such as fluid rheology, fracture growth, proppant transport, fluid leakoff, additive performance, thermally activated crosslinker, breaker scheduling, fiber degradation, post-job cleanup, degradation of crosslinked gel & filter cake, and/or duration of shut-in, among others. For example, injection fluids pumped into surrounding formations may affect fluid density, viscosity and, hence, the geometry of a hydraulic fracture or fracture network, the pressure loss and proppant transport along the fracture or fracture network, and the timing of gel breaking or fiber degradation or dissolution. In another example, rapid injection of injection fluids at a lower temperature (e.g., colder than the formation temperature) may introduce additional near-wellbore fracturing.

To take into consideration potential changes to the HFN caused by fluid temperature, hydraulic fracturing models may use an empirical heat transfer coefficient to estimate the heating to the injected fluid by the reservoir formation being fractured. Analytical solutions for temperature of fluids in the wellbore and along a growing hydraulic fracture or HFN initiated at the wellbore are intended to increase accuracy and/or computer processing speed of performing temperature calculations.

In cases of a laminar flow the heat transfer coefficient may be accurately calculated in a non-empirical manner. The solution is applicable to both Newtonian and non-Newtonian fluids in both laminar and turbulent flow regimes. The speed of calculation may be increased by introducing accurate incremental computation methods for the involved mathematical convolution calculations.

Fluid temperature may be determined using conventional techniques, such as conventional measurement, empirical heat transfer coefficient between fracture and matrix, superposition of constant-rate solutions for matrix, numerical for fracture, and/or convolution-type computation. By analyzing fluid properties relating to flow through fractures of an HFN, fluid temperature may also be estimated based on, for example, a heat transfer coefficient, heat transfer along the fracture (e.g., analytically coupled fracture & matrix heat transfer, accurate transient temperature solution for matrix, piecewise analytical for fracture fluid temperature), piecewise analytical for fracture network fluid temperature, analytically calculated wellbore fluid temperature, and/or incremental computation of convolution.

First, a heat transfer coefficient may be analytically calculated based on laminar flow. FIG. 12.1 is a schematic diagram 1200.1 depicting laminar flow of fluid through a horizontal fracture 1221 having a width w. Laminar flow along a fracture may be determined based on a balance of forces for power-law fluids using the following:

$$\frac{dp}{dx} = \frac{d}{dy}\left[K\left(\frac{du}{dy}\right)^n\right] \tag{99}$$

$$u(y) = v_f \frac{2n+1}{n+1}\left[1 - \left(\frac{2y}{w}\right)^{(n+1)/n}\right] \tag{100}$$

with $$v_f = \frac{n}{2n+1}\left(-\frac{1}{K}\frac{dp}{dx}\right)^{1/n}\left(\frac{w}{2}\right)^{(n+1)/n} \tag{101}$$

where p is fluid pressure, K and n are the flow consistency and behavior indexes, respectively, of the fluid, u is the velocity of fluid flow along the fracture in the x direction, and $v_f$ is the flow velocity u averaged across fracture width w in the y direction. For Newtonian fluids, K=μ and n=1. See, e.g., Kays et al. "Convective Heat, Mass Transfer", fourth ed., McGraw-Hill, N.Y., 2005.

Temperature profile of the fluid in the fracture may be determined by describing well developed flow as follows:

$$\rho_f c_f u(y)\frac{\partial T}{\partial x} = \lambda_f \frac{\partial^2 T}{\partial y^2} \tag{101}$$

where T, $\rho_f$, $c_f$ and $\lambda_f$ are the temperature, density, specific heat capacity and heat conductivity, respectively, of the fluid in the fracture. Using equation (101), the temperature profile may be described as follows:

$$T(y) = T_{fs} - \frac{A}{2}\left[\left(\frac{w}{2}\right)^2 - y^2\right] + \frac{An^2}{(2n+1)(3n+1)}\left[\left(\frac{w}{2}\right)^2 - \left(\frac{2y}{w}\right)^{(n+1)/n} y^2\right] \tag{102}$$

where $$A = \frac{2n+1}{n+1}\frac{\rho_f c_f v_f}{\lambda_f}\frac{\partial T}{\partial x} \tag{103}$$

where A is a mass expression and $T_{fs}$ is the temperature along the fracture surface, Average fluid temperature may be described as follows:

$$T_f = T_{fs} - \frac{Aw^2}{12}\left[1 - \frac{3n^2}{(2n+1)(4n+1)}\right] \tag{104}$$

Heating along fracture walls may be described as follows:

$$\lambda_f \frac{\partial T}{\partial y}\Big|_{y=w/2} = \frac{A\lambda_f w}{2}\left(1 - \frac{n^2}{2n+1}\right) = q_h = \gamma(T_{fs} - T_f) \tag{105}$$

where $q_h$ is the rate of healing to the fluid by fracture surface.

From equation (105), the following heat transfer coefficient (γ) may be determined:

$$\gamma = \frac{6(1+6n+7n^2-4n^3)\lambda_f}{(1+6n+5n^2)w} \tag{106}$$

For Newtonian fluids, the heat transfer coefficient (γ) may be described as follows:

$$\gamma = \frac{5\lambda_f}{w} \tag{107}$$

As indicated by equations (106, 107), the heat transfer coefficient is inversely proportional to fracture width (w). While the heat transfer coefficient may be treated as an empirical constant, additional accuracy may be provided by further analyzing this coefficient.

Second, heat transport along the fracture may be analyzed, for example, by analytically coupling fracture & matrix heat transfer, determining a transient temperature solution for a matrix, and piecewise analysis for a fracture fluid temperature. As shown in FIG. 12.2, heat transport along the fracture 1221 may be affected by temperature differentials with the surrounding formation 1223. In this example, fluid flows through fracture 1221 at a fluid velocity ($v_f$) and is subjected to heating $q_h$ from the formation 1223. In this situation, fluid leakoff may be accounted for using the following governing equation:

$$wh\rho_f \frac{\partial(c_f T_f)}{\partial t} + wh\rho_f v_f \frac{\partial(c_f T_f)}{\partial x} - \frac{\partial}{\partial x}\left(wh\lambda_f \frac{\partial T_f}{\partial x}\right) = 2hq_h \tag{108}$$

Assuming negligible conductive heat transport, the following equation may be generated:

$$w\rho_f \frac{\partial(c_f T_f)}{\partial t} + w\rho_f v_f \frac{\partial(c_f T_f)}{\partial x} = 2q_h \tag{109}$$

Assuming constant fluid property, the following equation results:

$$w\rho_f c_f \frac{\partial T_f}{\partial t} + w\rho_f v_f c_f \frac{\partial T_f}{\partial x} = 2q_h \tag{110}$$

FIG. 12.2 schematically depicts one dimensional heat transport from a formation to fluid in a vertical fracture. This figure is similar to FIG. 12.1, except with flow in a vertical direction and heat ($q_h$) in a horizontal direction parallel to the x axis. The problem of heat transfer may be described by the following equation:

$$\frac{\partial T}{\partial t} - \frac{\lambda_r}{\rho_r c_r}\frac{\partial^2 T}{\partial x^2} = 0 \tag{111}$$

where $T(0, x) = T_r$, $T(t, 0) = T_{fs}(t)$, and $\left.\frac{\partial T(t, x)}{\partial x}\right|_{x-x} = 0$ Where t is time, and x is a horizontal distance from the fracture. Based on equation (111) the temperature along the fracture T(i,x) may be described as follows:

$$T(t, x) = T_r \mathrm{erf}\left(\frac{x}{2}\sqrt{\frac{\rho_r c_r}{\lambda_r t}}\right) + \frac{x}{2}\sqrt{\frac{\rho_r c_r}{\pi\lambda_r}}\int_0^t T_{fs}(u)(t-u)^{3;2} e^{-\frac{x^2}{4n(f-u)}} du \tag{112}$$

The heating ($q_h$) from the formation may be described as follows:

$$q_h = \lambda_r \left.\frac{\partial T}{\partial x}\right|_{x=0} = -\sqrt{\frac{\rho_r c_r \lambda_r}{\pi}}\int_0^t \frac{1}{\sqrt{t-u}}\frac{dT_{fs}(u)}{du} du \tag{113}$$

In view of equations (112,113) and FIG. 12.2, an assumption may be made that fluid temperature approaches its average for fractures having small fracture width. Fluid temperature may be close to average for a large fracture width, for example, when turbulence may develop. Based on these assumptions, heat transport along the fracture may be described as follows:

$$w\rho_f c_f \frac{\partial T_f}{\partial t} + w\rho_f v_f c_f \frac{\partial T_f}{\partial x} = -2\sqrt{\frac{\rho_r c_r \lambda_r}{\pi}}\int_0^t \frac{1}{\sqrt{t-u}}\frac{dT_f(u)}{du} du \tag{114}$$

In view of equation (112), the problem of heat transport along the fracture may be described as follows:

$$\frac{\partial T_f}{\partial t} + v_f \frac{\partial T_f}{\partial x} = -\frac{2}{w\rho_f c_f}\sqrt{\frac{\rho_r c_r \lambda_r}{\pi}}\int_0^t \frac{1}{\sqrt{t-u}}\frac{dT_f(u)}{du} du \tag{115}$$

where $T_f(0,x)=T_r$, and $T_f(t,0)=T_{wb}(t)$

The solution may be rewritten as follows:

$$T_f(t, x) = \begin{cases} T_r + \left.\int_0^{t-x/v_f} \frac{dT_{wb}}{dt}\right|_{(u)} \mathrm{erfc}\left(\frac{\sqrt{\rho_r c_r \lambda_r}}{\rho_f c_f v_f w}\frac{x}{\sqrt{\frac{t-x}{v_f-u}}}\right) du, & x < tv_f \\ T_r & x \geq tv_f \end{cases} \tag{116}$$

In cases where fracture width (w) is neither a constant nor uniform, the fracture length may be divided into segments with the solution of equation (116) applied individually to each segment.

Third, piecewise analysis may be used for a fracture network fluid temperature. FIGS. 13.1 and 13.2 show temperature predictions for fluid flowing through a wellbore 820. FIGS. 13.1 and 13.2 are similar to FIGS. 10.1 and 10.2, except that an injection fluid is passed into the HFN 822 from the wellbore 820 as indicated by the radially outgoing arrows. FIG. 13 also shows a cell 828 similar to FIG. 10.2, with the temperature increasing with the flow of the fracture fluid into the formation.

As demonstrated by FIG. 13, during a hydraulic fracturing job, fluid is injected through a wellbore into a growing fracture or fracture network originated from the wellbore 820. Due to a temperature difference between the formation and the injected fluid, the injected fluid is heated or cooled by the hosting reservoir formation. Thus, the temperature of the injection fluid varies with both space and time as it passes from the wellbore and into fractures of the fracture network. As also shown in this view, the HFN 822 is subject to stresses $\sigma_h$ in the vertical direction and $\sigma_H$ in the horizontal direction.

As also demonstrated by FIG. 13, heat transport flows along growing hydraulic fractures in low-permeability formations. Based on this analysis, predictions of the temperature of fluid flowing through a wellbore and a growing hydraulic fracture or fracture network during a hydraulic fracturing stimulation may be made. Information thus obtained may be used for the design and optimization of hydraulic fracturing stimulation (e.g., for unconventional reservoirs). Using the wiremesh fracture network, heat transport is represented by elliptic advective transport across the fracture network, and linear hating from a reservoir matrix.

Based on the heat transport represented by the elliptic advective transport across the HFN and linear heating from the formation, the governing equation is provided:

$$w_{xy}\rho_f c_f \frac{\partial T_f}{\partial t} + w_{xy}\rho_f c_f v_{fx}\frac{\partial T_f}{\partial x} = -2q_h \tag{117}$$

where $v_{fx}$ is the true (not Darcy) flow velocity along the x-axis and $w_{xy}$ is the averaged fracture width of both x-fractures and y-fractures. In this manner, fluid leakoff may be accounted. Using the wiremesh structure of FIGS. 13.1 and 13.2, the problem of heat transport through the HFN may be described as follows:

$$w_{xy}\rho_f c_f \frac{\partial T_f}{\partial t} + w_{xy}\rho_f c_f v_{fx}\frac{\partial T_f}{\partial x} = -2\sqrt{\frac{\rho_r c_r \lambda_r}{\pi}}\int_0^t \frac{1}{\sqrt{t-u}}\frac{dT_f(u)}{du}du \tag{118}$$

$$T_f(0, x) = T_r$$

$$T_f(t, 0) = T_{wb}(t)$$

The solution may be described as follows:

$$T_f(t, x) = \begin{cases} T_r + \int_0^{t-x/v_{fx}} \left.\frac{dT_{wb}}{dt}\right|_{(u)} \operatorname{erfc}\left(\frac{\sqrt{\rho_r c_r \lambda_r}}{\rho_f c_f v_{fx} w_{xy}}\frac{x}{\sqrt{t-x/v_{fx}-u}}\right)du, & x < tv_{fx} \\ T_r & x \geq tv_{fx} \end{cases} \tag{119}$$

In cases where fracture width ($w_{xy}$) is neither a constant nor uniform, the fracture length may be divided into segments with the solution of equation (119) applied individually to each segment.

Fourth, wellbore fluid temperature may be analytically calculated based on heat transport along the wellbore. This analysis may be based on several assumptions, such as that fluid flow is turbulent, that the fluid temperature is close to its average across the wellbore radius, that fluid initial temperature is identical to formation temperature, and that heating/cooling to the fluid from the formation is radial in one direction. Given these assumptions, heat transport along the wellbore may be described as follows:

$$\frac{\partial T}{\partial t} + v_f\frac{\partial T}{\partial z} = \frac{q_h}{\pi v_w^2 \rho_f c_f} \tag{120}$$

In cases where fracture width ($w_{xy}$) is neither a constant nor uniform, the fracture length may be divided into segments with the solution of equation (119) applied individually to each segment.

The problem of heating from the reservoir formation may be described as follows:

$$\frac{\partial T}{\partial t} = \frac{\lambda_r}{\rho_r c_r r}\frac{\partial}{\partial r}\left(r\frac{\partial T}{\partial r}\right) \tag{121}$$

where $T = T_r$ at $t = 0,$ $T = T_r$ or $\frac{\partial T}{\partial r} = 0$ as $r \to \infty,$ and $T = T_{wb}(t)$ at $r = r_w$ A transform (s) for equation (120) may be described as follows:

$$s = \frac{\rho_r c_r r^2}{4\lambda_r t} \tag{122}$$

Based on this transform, the solution may be described as follows:

$$T(t, r) = T_r - [T_r - T_{wb}(t)]\frac{Ei\left(-\frac{\rho_r c_r r^2}{4\lambda_r t}\right)}{Ei\left(-\frac{\rho_r c_r r_w^2}{4\lambda_r t}\right)} \tag{123}$$

The heating of the fluid may then be described as follows:

$$q_h = -\frac{4\pi\lambda_r e^{-u}}{Ei(-u)}[T_r - T_{wb}(t)] \tag{124}$$

where $$u = \frac{\rho_r c_r r_w^2}{4\lambda_r t}.$$

Based on the solution of equation (123), the problem of heat transport along the wellbore may be described as follows:

$$\frac{\partial T_{wb}}{\partial t} + v_f\frac{\partial T_{wb}}{\partial z} = -\frac{4\lambda_r[T_r - T_{wb}(t)]\exp\left(-\frac{\rho_r c_r r_w^2}{4\lambda_r t}\right)}{r_w^2 \rho_f c_f Ei\left(-\frac{\rho_r c_r r_w^2}{4\lambda_r t}\right)} \tag{125}$$

where $T_{wb}(0, z) = T_r(z),$ $T_{wb}(t, 0) = T_{inj},$ where Ei(z) stands for the exponential integral of z. The solution may then be provided as follows:

$$T_{wb}(t, z) = T_r(z) + e^{-B(t)}[T_r(z - v_f t) - T_{inj}] + v_f e^{-B(t)}\int_t e^{B(u)}\left.\frac{\partial T_r(s)}{\partial s}\right|_{[s=z-v_f(t-u)]}du \tag{126}$$

-continued where (127)

$$B(t) = \int A(t)dt$$

and A(t) is an indefinite article that may be defined as follows:

$$A(t) = -\frac{4\lambda_r \exp\left(-\frac{\rho_r c_r r_w^2}{4\lambda_r t}\right)}{r_w^2 \rho_f c_f Ei\left(-\frac{\rho_r c_r r_w^2}{4\lambda_r t}\right)} \tag{128}$$

Fifth, an incremental computation of convolution may be provided. A convolution may be a mathematical operation where two function (F, G) may be used to generate a third function as described by the following equation:

$$I(t)=\int_0^t F(t-u)G(u)du \tag{129}$$

A polynomial expansion of equation (129) may be described as follows:

$$F(s) = \sum_{k=m_1}^{m_2} C_k (e^{Bs})^k = \sum_{k=m_1}^{m_2} f_k(s) \tag{130}$$

Polynomial expansion may be provided based on the following:

$$\frac{1}{\sqrt{s}} = \sum_{k=m_1}^{m_2} C_k e^{ks/B} \tag{131}$$

Tables 1.1 and 1.2 below provides an example expansion using equation (131):

TABLE 1.1

| POLYNOMIAL EXPANSION | | | |
|---|---|---|---|
| Time | 1 s < s < 1 min | 1 min < s < 1hr | 1 hr < s < 1 d |
| 1/B | $10^9$ s | $10^7$ s | $10^6$s |
| m1 | −7 | −7 | −7 |
| m2 | 1 | 1 | 1 |
| C-7 | 53.366129917 | 11.329016551 | 8.527483684 |
| C-6 | −155.084787725 | −34.124306021 | −31.064476240 |
| C-5 | 184.222017539 | 41.549765346 | 45.765995427 |
| C-4 | −113.937294518 | −26.137070897 | −34.422065873 |
| C-3 | 39.637488341 | 9.124708198 | 13.525080212 |
| C-2 | −7.698172899 | −1.760502335 | −2.389509289 |
| C-1 | 1.157744131 | 0.215106207 | 0.075620591 |
| C0 | 0.141874447 | 0.009194114 | 0.001160081 |
| C1 | −0.000039725 | 0.000073056 | 0.005787015 |

TABLE 1.2

| POLYNOMIAL EXPANSION | | | |
|---|---|---|---|
| Time | 1 d < s < 1 mo | 1 mo < s < 1 yr | 1 yr < s < 30 yr |
| 1/B | $10^5$s | $10^3$ s | $10^1$ s |
| m1 | −7 | −5 | −7 |
| m2 | 1 | 1 | 1 |

TABLE 1.2-continued

| POLYNOMIAL EXPANSION | | | |
|---|---|---|---|
| Time | 1 d < s < 1 mo | 1 mo < s < 1 yr | 1 yr < s < 30 yr |
| C-7 | 0.335458087 | | 0.191415040 |
| C-6 | −1.090841106 | | −0.700087838 |
| C-5 | 1.475973845 | 0.002793543 | 1.009125887 |
| C-4 | −1.070924318 | −0.004525720 | −0.704478690 |
| C-3 | 0.452024331 | 0.003454346 | 0.222782254 |
| C-2 | −0.111989219 | −0.001237233 | −0.013181816 |
| C-1 | 0.016849607 | 0.000581247 | −0.004310986 |
| C0 | −0.000559641 | 0.000162844 | −0.001554663 |
| C1 | 0.000029024 | −0.000000324 | 0.000567371 |

Using incremental calculation applied to equation (128), the following equations may be generated:

$$I(t+\Delta t) \approx A(t) + B(t+\Delta t/2) \tag{131}$$

$$A(t) = \sum_{k=m_1}^{m_2} e^{Bk\Delta t} f_k(t) \tag{132}$$

$$B(t) = G(t+\Delta t/2)\Delta t \sum_{k=m_2}^{m_2} C_k e^{Bk\Delta t/2} \tag{133}$$

Hydraulic Fracturing Design and Optimization

For each design of a particular stage of a planned hydraulic fracturing job, the wiremesh fracturing model may be applied to generate an HFN and associated proppant placement using reservoir formation properties and fracturing job parameters as the input. The result, including the geometry of the fracture network and individual fractures and proppant distribution along the fractures, can be used as part of the input for production simulation using the wiremesh production model described above.

For example, for design of a particular stage of a planned job, hydraulic fracturing software, such as MANGROVE™ software commercially available from Schlumberger Technology Corporation (see:www.slb.com), may be used to produce an HFN with the information needed for production calculations. Production from the HFN can be calculated using the models described above. Production rates calculated for various designs may then be compared and analyzed in combination with other economic, environmental and logistic considerations. The job parameters can then be adjusted accordingly for a better design. The best design for each of the stages may be chosen for the job.

Figure 14:
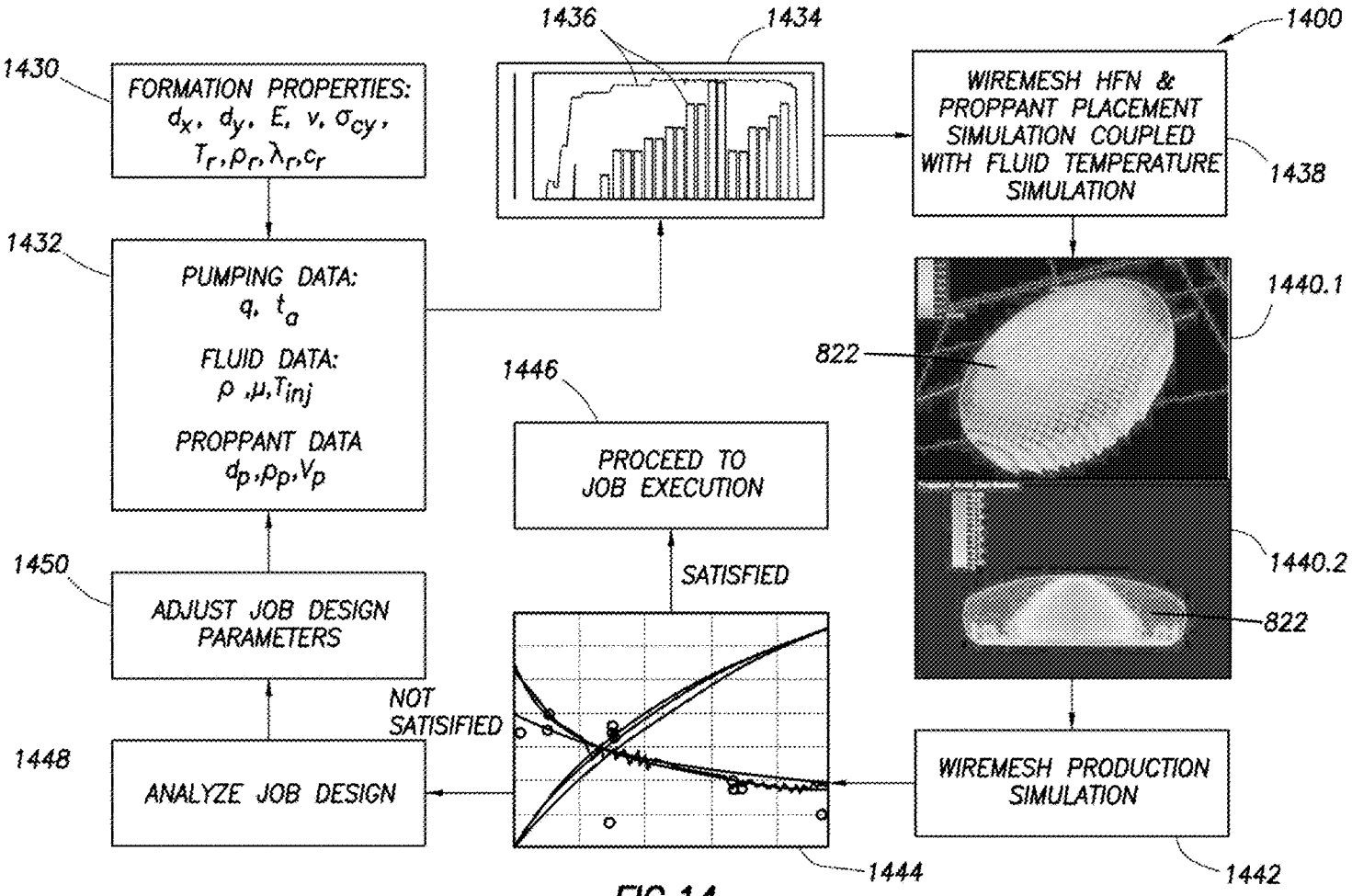
FIGS. 14-15 are flow charts depicting pre- and post-production operations, respectively in accordance with the present disclosure.

FIG. 14 depicts an example fracture operation 1400 involving fracture design and optimization. The fracture operation 1400 includes 1430—obtaining job parameters relating to formation parameters (e.g., dimensions, stresses, temperature, pressure, etc.) and 1432—obtaining job parameters relating to stimulation parameters, such as pumping (e.g., flow rate, time), fluid (e.g., viscosity, density, injection temperature), and proppant parameters (e.g., dimension, material). The fracture operation 1400 also includes 1434—generating plots of formation parameters 1436 (e.g., slurry rate and proppant concentration over time) from the obtained parameters.

A wiremesh HFN and proppant placement simulation 1438 may be performed to model the HFN based on the plots 1436 and obtained parameters 1430, 1432. Visualization 1440.1 of an HFN 822 and its proppant placement 1440.2 may be generated. A wiremesh production simulation 1442 may then be performed to generate an analysis 1444 of the simulation, for example, by comparison of actual with simulated results to evaluate the fracture operation 1400. If satisfied, a production operation may be executed 1446. If not, job design may be analyzed 1448, and adjustments to one or more of the job parameters may be made 1450. The fracture operation may then be repeated.

In a given example, formation properties 1430 may be obtained using, for example, the techniques of FIGS. 1.1-2.4 and/or other conventional means, such as measurement at the wellsite. Real time optimization may be performed during an injection operation using the data collected during 1430. This data may be used to generate parameters as in 1432 and/or plotted as in 1434, 1436. The parameters are then used to generate a wiremesh simulation as in 1438 and visualizations as in 1440.1, 1440.2 using the method of FIGS. 5.1.1 and 5.1.2. These simulations provide a fracture network 1440.1 and distribution 1440.2 used to run production simulations as in 1442.

The results of the production simulation may be used for predicting production as in 1444 to analyze the job design 1448 and determine if an adjustment 1450 is needed. For applications involving temperature as a factor, temperature properties may be included in 1430 and temperature parameters in 1432. Simulations in 1438 may include a combination of wiremesh HFN & proppant placement simulations with temperature effects to consider the effects of temperature as described herein.

Post Fracture Operation

Reservoir properties and hydraulic fracturing treatment data can be used to obtain information about the created HFN, such as fracture spacing $d_x$ and $d_y$ and stress anisotropy $\Delta\sigma$, by matching the modeled HFN with a cloud of microseismic events recorded during the job. The techniques for hydraulic fracture modeling as described with respect to FIGS. 3-7 may be used to simulate the growth and proppant placement of the HFN. Examples of hydraulic fracture modeling that may be used are provided in Wenyue Xu, et al., "Characterization of Hydraulically-Induced Fracture Network Using Treatment and Microseismic Data in a Tight-Gas Sand Formation: A Geomechanical Approach", SPE 125237, SPE Tight Gas Completions Conf., 15-17, Jun. 2009, San Antonio, Tex., USA; Wenyue Xu, et al., "Characterization of Hydraulically-Induced Shale Fracture Network Using An Analytical/Semi-Analytical Model", SPE 124697, SPE Annual Tech. Conf. and Exh., 4-7 Oct. 2009, New Orleans, LA; Wenyue Xu et al., "Fracture Network Development and Proppant Placement During Slickwater Fracturing Treatment of Barnett Shale Laterals", SPE 135484, SPE Tech. Conf. and Exhibition, 19-22 Sep. 2010, Florence, Italy; and Wenyue Xu, et al., "Wiremesh: A Novel Shale Fracturing Simulator", SPE 1322188, Intl. Oil and Gas Conf. and Exh. in China, 10 Jun. 2010, Beijing, China, the entire contents of which are hereby incorporated by reference. Production from the HFN model 800 can be calculated using the models described above to help in understanding the effectiveness and efficiency of the job done.

Figure 15:
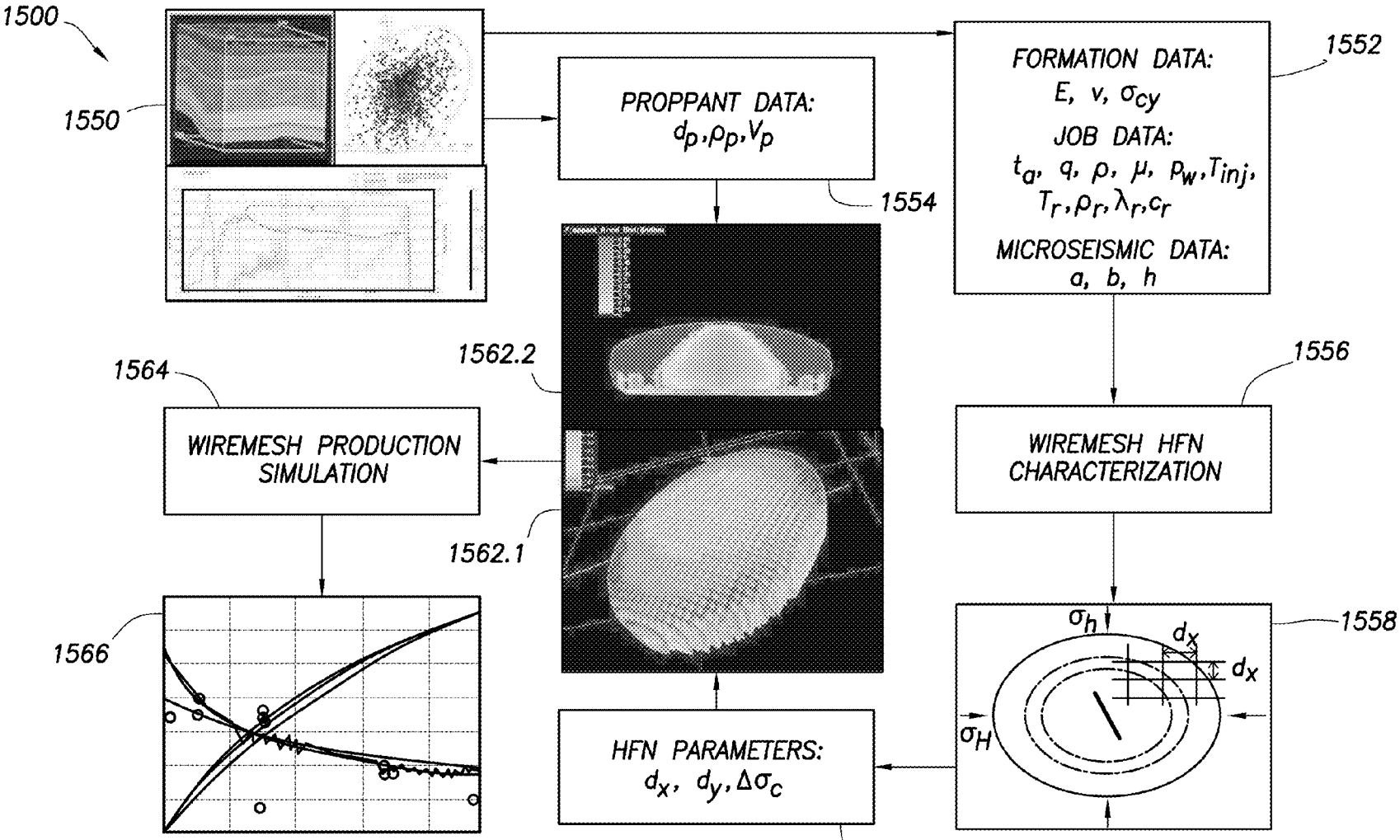

FIG. 15 depicts an example of a post-fracture operation 1500. The post-fracture operation involves 1550—obtaining job parameters such as formation, microseismic, fluid/proppant, and other data. From this information, wellsite parameters such as formation, job, microseismic, and other data, may be determined 1552. Proppant data may also be determined 1554 from the job parameters. The wellsite parameters may be used to characterize a wiremesh HFN 1556. The wiremesh HFN can be configured in an elliptical configuration 1558. The HFN parameters (e.g., matrix and ellipse dimensions) may then be defined 1560. The HFN parameters (e.g., dimensions, stresses) and the proppant parameters may be used to define the HFN model as shown in visualization 1562.1, and proppant placement as shown in visualization 1562.2.

A wiremesh production simulation 1564 may then be performed based on the HFN model. An analysis 1566 of the simulation may be performed, for example, by comparison of actual with simulated results to evaluate the fracture operation 1500. If satisfied, a production operation may be executed. If not, job design may be analyzed, and adjustments to one or more of the job parameters may be made. The fracture operation may then be repeated.

In a given example, formation properties 1550 may be obtained using, for example, the techniques of FIGS. 1.1-2.4 and/or other conventional means, such as measurement at the wellsite. Real time optimization may be performed during an injection operation using the data collected during 1552 and 1554. This data may be used to generate a wiremesh HFN characterization as in 1556, to generate a plot as in 1558, and/or to generate parameters as in 1560. The parameters are then used to generate a wiremesh simulation as in 1556 and visualizations as in 1562.1 and 1562.2 using the method of FIGS. 5.1.1 and 5.1.2. These simulations may provide a wiremesh production simulation, as in 1564, used to run production simulations as in 1566.

The results of the production simulation may be used for predicting production to analyze the job design and determine if an adjustment is needed similar to FIG. 14. For applications involving temperature as a factor, temperature properties may be included in 1552. Simulations in 1556 may include a combination of wiremesh HFN with temperature effects to consider the effects of temperature as described herein. Simulations in 1564 may include a combination of wiremesh production simulation with temperature effects to consider the effects of temperature as described herein.

FIG. 16.1 illustrates a method 1600.1 of performing a production operation. This method 1600 depicts how the models and solutions are applied to a wiremesh HFN obtained by hydraulic fracturing modeling. The method involves performing a fracture operation 1660. The fracture operation involves 1662—designing a fracture operation, 1664—optimizing a fracture operation, 1667—generating fractures by injecting fluid into the formation, 1668—measuring job parameters, and 1670—performing a post-fracture operation. The method also involves 1672—generating a fracture network about the wellbore. The fracture network includes a plurality of the fractures and a plurality of matrix blocks. The fractures are intersecting and hydraulically connected, and the plurality of matrix blocks are positioned about the intersecting fractures.

The method also involves 1674—placing proppants in the elliptical hydraulic fracture network, 1676—generating a fluid distribution through the hydraulic fracture network, 1678—performing a production operation, the production operation comprising generating a production rate from the fluid pressure distribution, and 1680—repeating over time. Part or all of the method may be performed in any order and repeated as desired. The generating 1676 may be performed based on viscosity of fluid flow as set forth with respect to FIGS. 9.1-11.1. The generating 1676 may also be performed based on fluid temperature as set forth with respect to FIGS. 12-14.3.

FIG. 16.2 illustrates another version of the method 1600.2 of performing a production operation. This version is intended to also take into consideration the effects of temperature. This method 1600.2 involves 1660-1670 as previously described. The performing 1660 may involve collecting data at the wellsite (see, e.g., FIGS. 1.1-2.4) and performing fracture operations at the wellsite (see, e.g., FIG. 4).

The method 1600.2 continues by performing real time simulations by performing 1672, 1674, and 1676 as in FIG. 16.1, and repeating as needed until a desired result is reached. Such simulations may involve performing portions of the method of FIGS. 14-15 (e.g., 1438) in real time. For example, the generating 1676 may be performed based on viscosity of fluid flow as set forth with respect to FIGS. 12.1-13. The generating 1676 may also be performed based on fluid temperature as set forth with respect to FIGS. 14-15. A production operation may then be performed 1678 in real time based on the simulations. Part or all of the method may be performed in any order and repeated as desired.

The preceding description has been presented with reference to some embodiments. Persons skilled in the art and technology to which this disclosure pertains will appreciate that alterations and changes in the described structures and methods of operation can be practiced without meaningfully departing from the principle and scope of this application. Accordingly, the foregoing description should not be read as pertaining to the precise structures described and shown in the accompanying drawings, but rather should be read as consistent with, and as support for, the following claims, which are to have their fullest and fairest scope.

There have been described and illustrated herein a methodology and systems for monitoring hydraulic fracturing of a subterranean hydrocarbon formation and extension thereon. While particular embodiments of the disclosure have been described, it is not intended that the disclosure be limited thereto, as it is intended that the disclosure be as broad in scope as the art will allow and that the specification be read likewise. Thus, while a specific method of performing fracture and production operations is provided, various combinations of portions of the methods can be combined as desired. Also, while particular hydraulic fracture models and assumptions for deriving such models have been disclosed, it will be appreciated that other hydraulic fracture models and assumptions could be utilized. It will therefore be appreciated by those skilled in the art that yet other modifications could be made to the provided disclosure without deviating from its spirit and scope as claimed.

It should be noted that in the development of any actual embodiment, numerous implementation—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the disclosure and this detailed description, each numerical value should be read once as modified by the term "about" (unless already expressly so modified), and then read again as not so modified unless otherwise indicated in context. Also, in the summary of the disclosure and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to a few specific items, it is to be understood that inventors appreciate and understand that any and all data points within the range are to be considered to have been specified, and that inventors possessed knowledge of the entire range and all points within the range.

Although a few example embodiments have been described in detail above, those skilled in the art will readily appreciate that many modifications are possible in the example embodiments without materially departing from the system and method for performing wellbore stimulation operations. Accordingly, all such modifications are intended to be included within the scope of this disclosure as defined in the following claims. In the claims, means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

I claim:

1. A method of performing an oilfield operation about a wellbore penetrating a subterranean formation, the method comprising:

performing a fracture operation comprising injecting fluid into the formation and generating fractures about the wellbore, the fractures forming a fracture network about the wellbore;

collecting during the performing data comprising injection temperature and pressure;

generating a fluid distribution through the fracture network by performing real time simulations of the fracture network based on the collected data, the fluid distribution comprising temperature distribution; and performing a production operation comprising generating production based on the temperature distribution.

2. The method of claim 1, further comprising measuring actual production and comparing the predicted production with the actual production.

3. The method of claim 2, further comprising adjusting the performing based on the comparing.

4. The method of claim 3, further comprising repeating the generating until the generated production is within a desired range of the actual production.

5. The method of claim 1, further comprising optimizing the fracture operation by adjusting the fracture operation based on a comparison of the predicted production with actual production.

6. The method of claim 1, wherein the performing the fracture operation comprises perforating the formation.

7. The method of claim 1, wherein the performing the fracture operation comprises simulating hydraulic fracturing about the wellbore.

8. The method of claim 1, wherein the performing the fracture operation further comprises injecting proppants into the formation.

9. The method of claim 1, further comprising designing the fracture operation based on job parameters.

10. The method of claim 1, wherein the data comprises at least one of fracture dimension, formation stress, wellbore temperature, viscosity, flow rate, and combinations thereof.

11. The method of claim 1, further comprising repeating the method over time.

12. The method of claim 1, wherein the performing the production operation comprises simulating production using the fracture network.

13. The method of claim 1, wherein the performing the production operation comprises deploying tubing into the wellbore and producing fluid from the wellbore therethrough.

14. The method of claim 1, wherein the fluid distribution further comprises one of a pressure distribution, a density distribution, and combinations thereof.

15. A method of performing an oilfield operation about a wellbore penetrating a subterranean formation, the method comprising:

performing a fracture operation comprising injecting fluid into the formation and generating fractures about the wellbore, the fractures forming a fracture network about the wellbore;

collecting during the performing data comprising injection temperature and pressure;

generating a fluid distribution through the fracture network by performing real time simulations of the fracture network based on the collected data, the fluid distribution comprising temperature distribution;

predicting production based on the fluid distribution; and performing a production operation comprising drawing fluid from a subsurface reservoir to a surface location.

16. The method of claim 15, wherein the performing the production operation comprises deploying tubing into the wellbore and producing fluid from the wellbore therethrough.

17. A method of performing an oilfield operation about a wellbore penetrating a subterranean formation, the method comprising:

performing a fracture operation comprising injecting fluid into the formation and generating fractures about the wellbore, the fractures forming a fracture network about the wellbore;

collecting during the performing data comprising injection temperature and pressure;

generating a fluid distribution through the fracture network by performing real time simulations of the fracture network based on the collected data, the fluid distribution comprising temperature distribution;

predicting production based on the fluid distribution;

optimizing the fracture operation by adjusting the generating based on a comparison of the predicted production with actual production; and performing a production operation drawing fluid from a subsurface reservoir to a surface location.

18. The method of claim 17, further comprising visualizing the fracture network.

19. The method of claim 17, wherein the optimizing comprises adjusting the fracture operation based on the comparison.

* * * * *